US007960081B2

(12) United States Patent
Orito et al.

(10) Patent No.: US 7,960,081 B2
(45) Date of Patent: Jun. 14, 2011

(54) ELECTROPHOTOGRAPHIC PHOTORECEPTOR HAVING N-ALKOXYMETHYLATED NYLON INTERMEDIATE LAYER, AND IMAGE FORMING APPARATUS HAVING THE ELECTROPHOTOGRAPHIC PHOTORECEPTOR

(75) Inventors: Takeshi Orito, Numazu (JP); Naohiro Toda, Yokohama (JP); Yasuyuki Yamashita, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 1299 days.

(21) Appl. No.: 11/505,860

(22) Filed: Aug. 18, 2006

(65) Prior Publication Data

US 2007/0042281 A1 Feb. 22, 2007

(30) Foreign Application Priority Data

Aug. 18, 2005 (JP) ..... 2005-237588

(51) Int. Cl.
*G03G 5/147* (2006.01)

(52) U.S. Cl. ..... 430/65; 430/64; 399/159

(58) Field of Classification Search ..... 430/60, 430/64, 65; 399/159
See application file for complete search history.

(56) References Cited

U.S. PATENT DOCUMENTS

| | | | | |
|---|---|---|---|---|
| 5,017,449 | A * | 5/1991 | Yoshihara | 430/58.4 |
| 5,079,117 | A * | 1/1992 | Koyama et al. | 430/59.6 |
| 5,236,796 | A * | 8/1993 | Koyama et al. | 430/59.6 |
| 5,565,289 | A * | 10/1996 | Yoshihara et al. | 430/64 |
| 7,371,491 | B2 | 5/2008 | Niimi et al. | |
| 7,534,538 | B2 * | 5/2009 | Niimi et al. | 430/64 |
| 7,537,872 | B2 * | 5/2009 | Toda et al. | 430/59.5 |
| 7,560,203 | B2 | 7/2009 | Tamoto et al. | |
| 2005/0026058 | A1 | 2/2005 | Kami et al. | |
| 2005/0053853 | A1 | 3/2005 | Sugino et al. | |
| 2005/0058918 | A1 | 3/2005 | Kurimoto et al. | |
| 2005/0118518 | A1 | 6/2005 | Ikegami et al. | |
| 2006/0057479 | A1 * | 3/2006 | Niimi et al. | 430/59.4 |
| 2006/0134540 | A1 * | 6/2006 | Kondo et al. | 430/59.5 |

FOREIGN PATENT DOCUMENTS

| | | |
|---|---|---|
| JP | 47-6341 | 4/1972 |
| JP | 52-082238 | 7/1977 |
| JP | 54-036859 | 3/1979 |
| JP | 58-058556 | 4/1983 |
| JP | 58-093062 | 6/1983 |
| JP | 58-105155 | 6/1983 |
| JP | 59-017557 | 1/1984 |
| JP | 60-066258 | 4/1985 |
| JP | 60-111255 | 6/1985 |
| JP | 63-018185 | 1/1988 |
| JP | 63-019869 | 1/1988 |
| JP | 64-051183 | 2/1989 |
| JP | 64-068762 | 3/1989 |

(Continued)

OTHER PUBLICATIONS

U.S. Appl. No. 12/030,886, filed Feb. 14, 2008, Toda, et al.

*Primary Examiner* — Christopher RoDee
(74) *Attorney, Agent, or Firm* — Oblon, Spivak, McClelland, Maier & Neustadt, L.L.P.

(57) ABSTRACT

An electrophotographic photoreceptor, including an electroconductive substrate; an intermediate layer, located overlying the electroconductive substrate; and a photosensitive layer, located overlying the intermediate layer, wherein the intermediate layer includes a N-alkoxymethylated nylon including a component having a molecular weight not greater than 5,000 in an amount of from 3 to 10% by weight.

20 Claims, 13 Drawing Sheets

FOREIGN PATENT DOCUMENTS

| | | |
|---|---|---|
| JP | 64-068763 | 3/1989 |
| JP | 64-073352 | 3/1989 |
| JP | 64-073353 | 3/1989 |
| JP | 01-118848 | 5/1989 |
| JP | 01-177556 | 7/1989 |
| JP | 2-193152 | 7/1990 |
| JP | 04-170552 | 6/1992 |
| JP | 04-240862 | 8/1992 |
| JP | 05-011483 | 1/1993 |
| JP | 05-080572 | 4/1993 |
| JP | 04-330455 | 11/1993 |
| JP | 06-019174 | 1/1994 |
| JP | 06-020238 | 1/1994 |
| JP | 6-43665 | 2/1994 |
| JP | 06-093129 | 4/1994 |
| JP | 06-222600 | 8/1994 |
| JP | 6-332202 | 12/1994 |
| JP | 7-134435 | 5/1995 |
| JP | 08-184979 | 7/1996 |
| JP | 09-043886 | 2/1997 |
| JP | 09-152731 | 6/1997 |
| JP | 09-190005 | 7/1997 |
| JP | 09-265202 | 10/1997 |
| JP | 09-288367 | 11/1997 |
| JP | 2000-056496 | 2/2000 |
| JP | 2002-107984 | 4/2002 |
| JP | 2005-128495 | 5/2005 |
| JP | 2005-128496 | 5/2005 |
| JP | 2005-128497 | 5/2005 |
| JP | 2005-129495 | 5/2005 |
| JP | 2005-165274 | 6/2005 |
| JP | 2005-189821 | 7/2005 |

* cited by examiner

ELECTROPHOTOGRAPHIC PHOTORECEPTOR HAVING N-ALKOXYMETHYLATED NYLON INTERMEDIATE LAYER, AND IMAGE FORMING APPARATUS HAVING THE ELECTROPHOTOGRAPHIC PHOTORECEPTOR

BACKGROUND OF THE INVENTION

1. Field of the Invention

The present invention relates to an electrophotographic photoreceptor for use in laser beam printers, facsimiles and digital copiers, and to an image forming apparatus and a process cartridge therefor using the electrophotographic photoreceptor.

2. Discussion of the Background

In place of conventional inorganic materials such as Se, CdS and ZnO as photoconductive materials for electrophotographic photoreceptors, organic photoconductive materials having better sensitivity, thermostability and nontoxicity than the inorganic materials therefor have widely been developed, and many copiers and printers are now equipped with electrophotographic photoreceptors using organic photoconductive materials. When a photosensitive layer of the electrophotographic photoreceptors using organic photoconductive materials is formed, a functionally-separated photosensitive layer including a charge generation layer (CGL) and a charge transport layer (CTL) overlying the CGL is widely used because of having good sensitivity and durability. Typically, image forming apparatuses such as printers, copiers and facsimiles form images by a successive process of charging, irradiating, developing, transferring and fixing, and as electrophotographic image forming apparatuses have higher printing speed and higher durability recently, the photoreceptor is strongly required to have reliability to keep producing high quality images even when repeatedly used. Particularly, when an ultrahigh-speed image forming apparatus producing many images stops working to replace photoreceptors, this results in a large deterioration of productivity. In addition, full-color image forming apparatuses mostly using tandem methods, lining four color developing systems in parallel, need photoreceptors having smaller diameters than the conventional photoreceptors to avoid growing in size, and therefore the photoreceptors are required to have higher durability.

One of the abnormal images caused due to the durability of photoreceptors is background fouling in image forming systems mainly using nega-posi development. Sources of background fouling include dirt, a defect of the electroconductive substrate, an electrical insulation breakdown of the photosensitive layer, a carrier (charge) injection from the substrate, increase of darkness attenuation of the photoreceptor and generation of heat carrier in the photosensitive layer. Dirt and defects of the electroconductive substrate can be avoided by excluding such substrates before forming a photosensitive layer thereon, and in a sense, is human-induced and not a substantial source. Therefore, improvement of the voltage resistance, carrier (charge) injection from the substrate and deterioration of electrostatic fatigue of the photoreceptor is thought to be essential solutions.

In consideration of these points, methods of forming an undercoat layer or an intermediate layer between the photosensitive layer and the electroconductive substrate have been disclosed in the past. For example, Japanese Laid-Open Patent Publication No. 47-6341 discloses an intermediate layer formed of a cellulose resin; Japanese Laid-Open Patent Publication No. 60-66258 discloses an intermediate layer formed of a nylon resin; Japanese Laid-Open Patent Publication No. 52-10138 discloses an intermediate layer formed of a maleic acid resin; and Japanese Laid-Open Patent Publication No. 58-105155 discloses an intermediate layer formed of a polyvinylalcohol resin.

However, these intermediate layers including a resin alone have high electric resistivities, and therefore the residual potential increases, resulting in occasional deterioration of image density and image gradation in negative and positive images. In addition, the intermediate layers have ion conductivities due to impurities and have particularly high electric resistivities, and therefore the residual potential noticeably increases. Therefore, the intermediate layers need to be thinner, resulting in insufficient chargeability of a photoreceptor after repeated use.

In order to control the electric resistivity of an intermediate layer, methods of dispersing an electroconductive additive are disclosed. For example, Japanese Laid-Open Patent Publication No. 51-65942 discloses an intermediate layer wherein a carbon-containing or a chalcogen-containing material is dispersed in a hardening resin; Japanese Laid-Open Patent Publication No. 52-82238 discloses a heat-polymerized intermediate layer formed by using an isocyanate hardener including a quaternary ammonium salt; Japanese Laid-Open Patent Publication No. 55-113045 discloses a resin intermediate layer including a resistivity regulator; and Japanese Laid-Open Patent Publication No. 58-93062 discloses a resin intermediate layer including an organic metallic compound. However, these resin intermediate layers alone occasionally have problems of producing moiré images due to light interference in image forming apparatus using coherent light such as a laser beam.

In order to prevent the moiré images from being produced as well as to control the electric resistivity of an intermediate layer, photoreceptors having an intermediate layer including a filler are disclosed. For example, Japanese Laid-Open Patent Publication No. 58-58556 discloses a resin intermediate layer wherein aluminum oxide or tin oxide is dispersed; Japanese Laid-Open Patent Publication No. 60-111255 discloses an intermediate layer wherein an electroconductive particulate material is dispersed; Japanese Laid-Open Patent Publication No. 59-17557 discloses an intermediate layer wherein magnetite is dispersed; Japanese Laid-Open Patent Publication No. 60-32054 discloses a resin intermediate layer wherein titanium oxide and tin oxide are dispersed; and Japanese Laid-Open Patent Publications Nos. 64-68762, 64-68763, 64-73352, 64-73353, 1-118848 and 1-118849 disclose resin intermediate layers wherein powders of borides such as calcium, magnesium and aluminum; nitrides; fluorides; and oxides are dispersed. The filler-dispersed intermediate layer needs to include a large amount of the filler (namely, to decrease the amount of the resin) because the potential properties of the intermediate layer depends on the amount of the filler. As the resin decreases, the adhesiveness thereof to the electroconductive substrate decreases, resulting in peeling of the intermediate layer from the substrate. Particularly, when the substrate is a flexible belt, this problem is noticeable.

In order to solve this problem, a multilayered intermediate layer is disclosed. The multilayered intermediate layer is broadly classified into two types. One includes a resin layer wherein a filler is dispersed on an electroconductive substrate and a resin layer not including a filler on the resin layer wherein a filler is dispersed (FIG. 1), and the other includes a resin layer not including a filler on an electroconductive substrate and a resin layer wherein a filler is dispersed on the resin layer not including a filler (FIG. 2).

The former multilayered intermediate layer includes an electroconductive resin layer wherein a low-resistivity filler on an electroconductive substrate to hide defects thereof, and the above-mentioned resin layer is formed on the electroconductive resin layer. These are disclosed in, e.g., Japanese Laid-Open Patent Publications Nos. 58-95351, 59-93453, 4-170552, 6-208238, 6-222600, 8-184979, 9-43886, 9-190005 and 9-288367. These have the same electrostatic defects as the photoreceptor having an intermediate layer including a resin alone because a lower electroconductive layer plays a role of an electrode of the electroconductive substrate. Only, the photoreceptors have moiré prevention capability because the electroconductive layer is a filler-dispersed layer scattering writing light. When the photoreceptor is charged, a charge having a reverse polarity to that of the surface thereof reaches an interface between the lower (electroconductive) layer and the upper (resin intermediate) layer. However, when the electroconductive layer does not have so low resistivity, the charge injection from the electrode is not fully performed, and the residual potential largely increases because the lower layer becomes a resistive component. Particularly, the lower layer needs to have sufficient thickness not less than 10 μm to cover defects of the electroconductive substrate, and this problem noticeably occurs.

On the other hand, the latter multilayered intermediate layer includes the resin layer on an electroconductive substrate, and a resin layer wherein a low-resistivity or an electron-conductive filler is dispersed on the resin layer. These are disclosed in, e.g., Japanese Laid-Open Patent Publications Nos. 5-80572, 6-19174 and 2005-128495. These having positive-hole blocking capability is effective in background fouling. In addition, since the upper layer is a filler-dispersed layer, the residual potential is less accumulated. Since charge (positive-hole) injection from the electroconductive substrate into the photosensitive layer can be prevented, background fouling can considerably be reduced in nega-posi development. In addition, the charge blocking layer below can reduce residual potential more than the above.

Resins for use in the intermediate layers need the following capabilities:

(1) solvent resistance such that it is not easily soluble or deformed in a solvent used for coating a photosensitive layer including a CGL and a CTL on the intermediate layer;

(2) uniform coated layer without coating defects to obtain electrical barrier or not to influence the coatability of the upper layer; and (3) good adhesiveness to the electroconductive substrate.

For these purposes, a polyamide resin, particularly a N-alkoxymethylated polyamide is preferably used in the intermediate layer. For example, Japanese Laid-Open Patent Publication No. 9-265202 discloses a method of including an alkoxy methylated copolymer nylon resin having an alkoxy methylation of from 5 to 30% in an undercoat layer; Japanese Laid-Open Patent Publication No. 2002-107984 discloses a method of including an inorganic pigment and a crosslinked N-alkoxy methylated polyamide resin as a binder resin in an intermediate layer; Japanese Patent No. 3086965 discloses a method of including a N-alkoxy methylated polyamide copolymer mainly constituted of a λ-amino-n-lauric acid in an intermediate layer; and Japanese Patent No. 3226110 discloses a method of including a polyamide resin including a unit having a structure in an intermediate layer. Methods of including a N-alkoxymethylated nylon in an undercoat layer or an intermediate layer are known, and effective in preventing charge injection from the electroconductive substrate to prevent background fouling.

However, although the above-mentioned plural undercoat layers or intermediate layers including N-alkoxymethylated nylon are effective in preventing background fouling, they have an influence on increase of the residual potential more than a little. Particularly, the increase of the residual potential due to repeated use is serious and is a large problem. When a resin having high hygroscopicity is used, the resistivity of the undercoat or the intermediate layer changes and such photoreceptors tend to largely depend on the environment, e.g., they largely increase in residual potential in an environment of low temperature and low humidity, and are charged less in an environment of high temperature and high humidity, resulting in background fouling. In order to solve this problem, Japanese Patent No. 2718044 discloses a method of including a N-alkoxy methylated polyamide resin, wherein each of Na, Ca and P atoms which are impurities has an elemental concentration not greater than 10 ppm in an undercoat layer; Japanese Laid-Open Patent Publication No. 6-93129 discloses a method of including N-methoxymethylated nylon 6 including components having a molecular weight not greater than 1,000 not greater than 10 ppm therein; and Japanese Patent No. 2887209 discloses a method of using an alcohol-soluble nylon contacted to a mixed solvent including alcohols and ketones. These remove impurities included in the N-alkoxymethylated nylon resin to solve electrostatic problems.

However, although the method in Japanese Patent No. 2718044 prevents defective images when repeatedly used in an environment of high temperature and high humidity, the resistivity of the undercoat layer increases and the residual potential inevitably increases in an environment of low temperature and low humidity. The method disclosed in Japanese Laid-Open Patent Publication No. 6-93129 can prepare a photoreceptor having long stability at room temperature, but the chargeability deteriorates and the residual potential increases in an environment of low temperature and low humidity or high temperature and high humidity, resulting in background fouling. The method disclosed in Japanese Patent No. 2887209 can prepare a photoreceptor having stable potential contrast in an environment of low temperature and low humidity, and of high temperature and high humidity, but still has problems in durability for long periods when having a small diameter or installed in a high-speed image forming apparatus.

Japanese Laid-Open Patent Publications Nos. 2005-128495, 2005-128496 and 2005-128497 disclose a photoreceptor that is much improved in background fouling after use for long periods, including at least an intermediate layer and a functionally-separated photosensitive layer on an electroconductive substrate, wherein the intermediate layer includes an antimoire layer and a charge blocking layer, and wherein the charge blocking layer includes an alcohol-soluble nylon AMILAN CM8000 from Toray industries, Inc. and the photosensitive layer includes a CGL including a titanylphthalocyanine crystal having an average primary particle diameter not greater than 0.25 μm as a charge generation material, having at least a maximum diffraction peak at a Bragg (2θ) angle of 27.2±0.2°; main peaks at 9.4°, 9.6° and 24.0°, a minimum diffraction peak at 7.3°; not having peaks at greater than 7.3° and less than 9.4°; and further not having a peak at 26.3° when irradiated with a specific X-ray of CuKα having a wavelength of 1.542 Å. However, the alcohol-soluble nylon AMILAN CM8000 from Toray industries, Inc. has a conductivity less than 1.5 μS/cm and high hygroscopicity, and the resistivity stability and potential contrast stability in an environment of high temperature and high humidity still need improvement.

The N-alkoxymethylated nylons are insoluble in alcohol solvents with some exceptions thereof. When the N-alkoxymethylated nylon is used in an intermediate layer, the N-alkoxymethylated nylon dissolved therein is used. However, a coating liquid including the N-alkoxymethylated nylon dissolved therein becomes clouded when stored for long periods and at low temperature, and the coating liquid is often coated on a substrate defectively.

Japanese Laid-Open Patent Publication No. 9-152731 discloses a method of including a halogenated hydrocarbon in an alcohol solvent when forming a coating liquid including an alcohol-soluble nylon such that the coating liquid has long storage stability. However, the halogenated hydrocarbon is neither preferable nor practical in terms of an environmental problem.

Japanese Laid-Open Patent Publication No. 2000-56496 discloses a method of including benzyl alcohol in a coating liquid including an alcohol-soluble nylon. Although having a long life, the coating liquid needs a long time to become dry to touch, and tends to be coated unevenly. Further, since the benzyl alcohol has a high boiling point, the drying temperature of the coating liquid needs to considerably be high.

Because of these reasons, a need exists for a photoreceptor with less increase of residual potential and not producing abnormal images such as background fouling and black spots even when repeatedly used for long periods, and stably producing quality images even in an environment of high temperature and high humidity or low temperature and low humidity.

SUMMARY OF THE INVENTION

Accordingly, an object of the present invention is to provide a photoreceptor with less increase of residual potential and not producing abnormal images such as background fouling and black spots even when repeatedly used for long periods, and stably producing quality images even in an environment of high temperature and high humidity or low temperature and low humidity.

Another object of the present invention is to provide an image forming apparatus using the photoreceptor.

A further object of the present invention is to provide a process cartridge using the photoreceptor.

These objects and other objects of the present invention, either individually or collectively, have been satisfied by the discovery of an electrophotographic photoreceptor, comprising an electroconductive substrate;

an intermediate layer, located overlying the electroconductive substrate; and a photosensitive layer, located overlying the intermediate layer, wherein the intermediate layer comprises a N-alkoxymethylated nylon comprising a component having a molecular weight not greater than 5,000 in an amount of from 3 to 10% by weight;

and an image forming apparatus and process cartridge using the photoreceptor.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
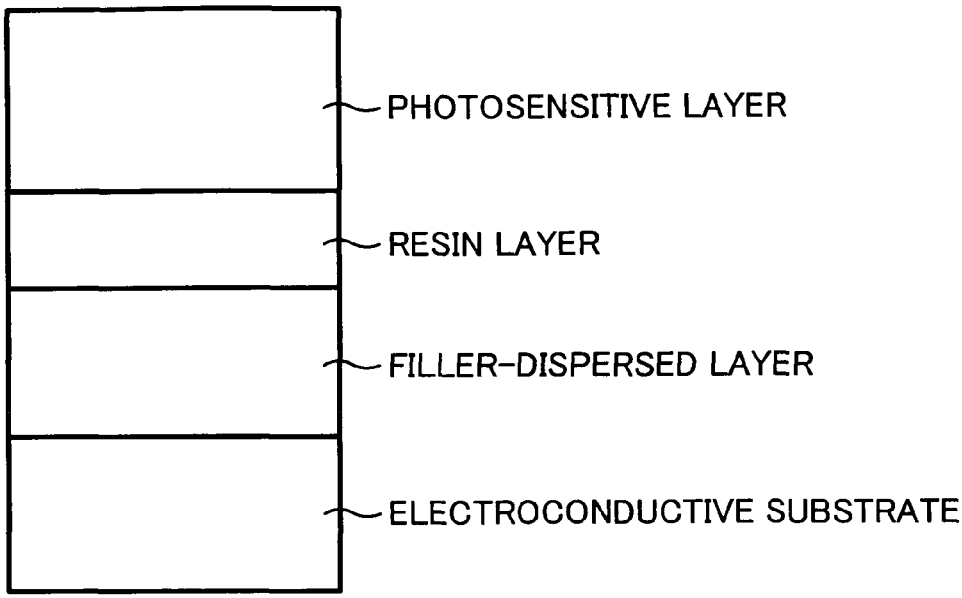
FIG. 1 is a cross-sectional view illustrating an example of layer composition of a conventional photoreceptor.
Figure 2:
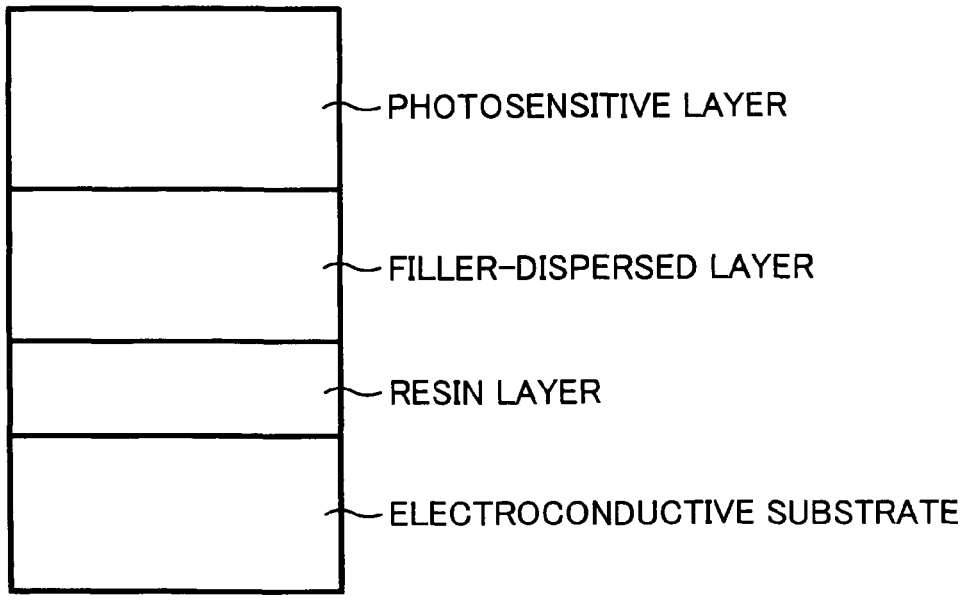
FIG. 2 is a cross-sectional view illustrating another example of layer composition of a conventional photoreceptor.

The present invention relates to an electrophotographic photoreceptor, comprising an electroconductive substrate;

an intermediate layer, located overlying the electroconductive substrate; and a photosensitive layer, located overlying the intermediate layer, wherein the intermediate layer comprises a N-alkoxymethylated nylon comprising a component having a molecular weight not greater than 5,000 in an amount of from 3 to 10% by weight.

In addition, the N-alkoxymethylated nylon preferably comprises a component having a molecular weight not greater than 1,000 in an amount of from 0.3 to 5% by weight.

Further, the N-alkoxymethylated nylon preferably has a conductivity of from 1.5 to 15 S/cm, and more preferably from 2 to 10 μS/cm.

The present invention provides a photoreceptor with less increase of residual potential and not producing abnormal images such as background fouling and black spots even when repeatedly used for long periods, and stably producing quality images even in an environment of high temperature and high humidity or low temperature and low humidity.

The N-alkoxymethylated nylon for use in the intermediate layer of the photoreceptor of the present invention can be prepared by modifying a copolyamide by the method disclosed by T. L. Cairns (J. Am. Chem. Soc. 71. P 651 (1949)). The amide-linked hydrogen of the original polyamide is substituted with a methoxy methyl group to form the N-alkoxymethylated nylon. The substitutional rate thereof is largely dependent on the modifying conditions, however, preferably not greater than 40 mol %, and more preferably from 15 to 35 mol % in terms of suppressing the hygroscopicity, and the environmental stability and coated stability (uniformity) of the intermediate layer.

The present inventors found that it is essential that the N-alkoxymethylated nylon used in the intermediate layer includes a component having a molecular weight not greater than 5,000 in an amount of from 3 to 10% by weight so as not to increase the residual potential and to stably produce good images regardless of the environment.

The intermediate layer including the N-alkoxymethylated nylon of the present invention blocks charge injection from the substrate to prevent background fouling, but when the N-alkoxymethylated nylon includes a component having a molecular weight not greater than 5,000 in an amount greater than 10% by weight, the effect deteriorates. When less than 3% by weight, an intermediate layer coating liquid increases its viscosity and is irregularly coated, resulting in production of abnormal images. When the N-alkoxymethylated nylon includes a component having a molecular weight not greater than 1,000 in an amount of from 0.3 to 5% by weight, abnormal images such as background fouling are less produced. Further, when the N-alkoxymethylated nylon has a conductivity of from 1.5 to 15 μS/cm, charge injection from the substrate is well blocked and a charge from a charge generation layer transports well, and therefore the residual potential increases less and good images, with less abnormal images such as black spotted images, are more stably produced.

Specific examples of solvents for use in the intermediate layer include, but are not limited to, alcoholic solvents such as methanol, ethanol, propanol, butanol and their mixtures because the N-alkoxymethylated nylon is soluble in alcohol. Among these solvents, methanol is most preferably used because the N-alkoxymethylated nylon is most soluble therein.

However, when methanol is used alone, having a high evaporation rate and a high latent heat, methanol causes defective coating, namely brushing when dried to touch. Therefore, methanol is preferably used with another (or other) alcohol solvent(s) having a lower evaporation rate. Specific examples thereof include, but are not limited to, alcohol solvents having three or more carbon atoms such as n-propanol, iso-propanol, n-butanol, iso-butanol, tert-butanol and n-pentanol because alcohol solvents having less carbon atoms are not effective in preventing brushing. When the alcohol solvent has so many carbon atoms, it takes a longer time to dry the resultant coating liquid to touch and the N-alkoxymethylated nylon is less soluble therein. Therefore, the alcohol solvents having 3 to 6 carbon atoms are preferably used.

In addition, it is more preferable that water is further added to the coating liquid besides the alcohol solvents because the compatibility thereof and the N-alkoxymethylated nylon increases. Water is preferably included in the alcohol solvents in an amount of from 5 to 20% by weight in terms of coatability and stability of the coating liquid.

Tap water can be used in the present invention, however, distilled water without impurities and ion-exchanged water are preferably used, and further it is more preferable that the distilled water and ion-exchanged water are filtered with a filter having a proper size.

The intermediate layer coating liquid may optionally include a filler such as titanium oxide, calcium fluoride, calcium oxide, silicon oxide, magnesium oxide and aluminum oxide; and additives such as an electron accepting material, a hardener and a dispersant. In addition, an organic solvent besides the alcohol solvents may optionally be included therein.

The intermediate layer may be separated into a filler-dispersed resin layer (antimoire layer) and a resin layer including no dispersed filler (charge blocking layer). In this case, the charge blocking layer includes the N-alkoxymethylated nylon.

The molecular weight is measured as follows.

The gel permeation chromatograph (GPC) of the N-alkoxymethylated nylon is measured by HLC-802A from Tosoh Corporation under the following conditions:

Column: Shodex one HFI-LG and two HFIP-806M
Eluent: HFIP+10 mM CF3COONa
Flow speed: 0.8 ml/min
Flow pressure: 30 kgf/cm$^2$
Concentration: about 1 mg/ml
Injection rate: 500 μl
Pretreatment: filtration with 0.2 μm filter
Detector: RI-8011
Auto sampler: As-8020

The polymethacrylate-converted molecular weight distribution is measured to determine the molecular weight of the present invention.

The conductivity is measured as follows.

A conductivity meter ECT-101 having a cell constant of 0.100 from SIBATA SCINTIFIC TECHNOLOGY LTD. or the like meter is used.

A beaker (or a container pursuant thereto), a measuring cylinder and a stirring bar are fully washed with ion-exchanged water (0.1 to 1.0 μS/cm) before measuring. Assuring that an electrode port of the conductivity meter is free from stain, connecting the electrode to a connector of the body, and turning on the power to warm up the meter for not less than 30 min.

(1) 150±5 ml of ion-exchanged water is poured into the beaker including the stirring bar, and 0.75±0.005 g of the N-alkoxymethylated nylon is added thereto and stirred with a stirrer for 3 min at about 400 rpm. Then, the opening of the beaker is covered with a lid such as aluminum foil such that dust and the like are not mixed therein.

(2) After stirring, the ion-exchanged water including the N-alkoxymethylated nylon is left for 3 min until the N-alkoxymethylated nylon is mostly precipitated.

(3) The electrode is dipped into the clear upper portion thereof until the protection cover thereof is wholly dipped therein, and lightly shaken left and right for a few times. When an air bubble remains in an air-bleeding hole, the electrode is further shaken to completely remove the air bubble. The protection cover is to be located 1 cm or more apart from the internal surface.

(4) A stable indicative value is determined as the conductivity.

Figure 3:
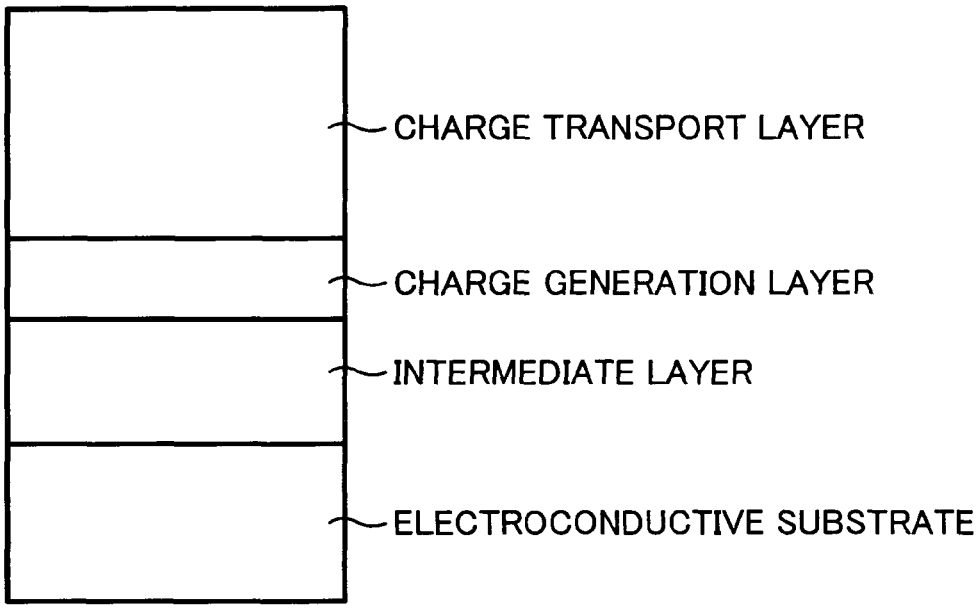
FIG. 3 is a cross-sectional view illustrating an embodiment of layer composition of the photoreceptor of the present invention.

FIG. 3 is a cross-sectional view illustrating an embodiment of layer composition of the photoreceptor of the present invention, wherein an intermediate layer, a CGL and a CTL are layered in this order on an electroconductive substrate.

Figure 4:
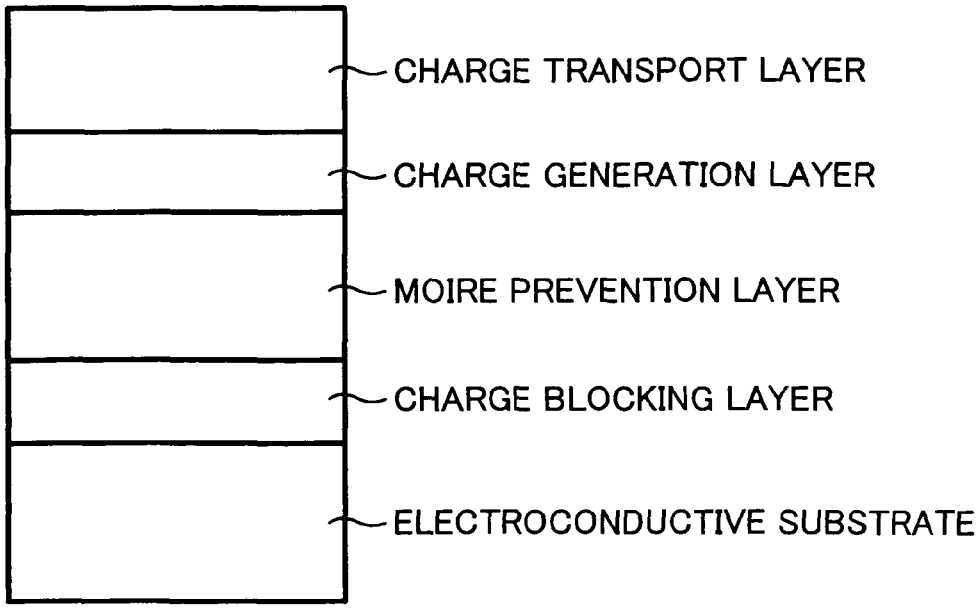
FIG. 4 is a cross-sectional view illustrating another embodiment of layer composition of the photoreceptor of the present invention.

FIG. 4 is a cross-sectional view illustrating another embodiment of layer composition of the photoreceptor of the present invention, wherein a charge blocking layer, an antimoire layer, a CGL and a CTL are layered in this order on an electroconductive substrate.

Figure 5:
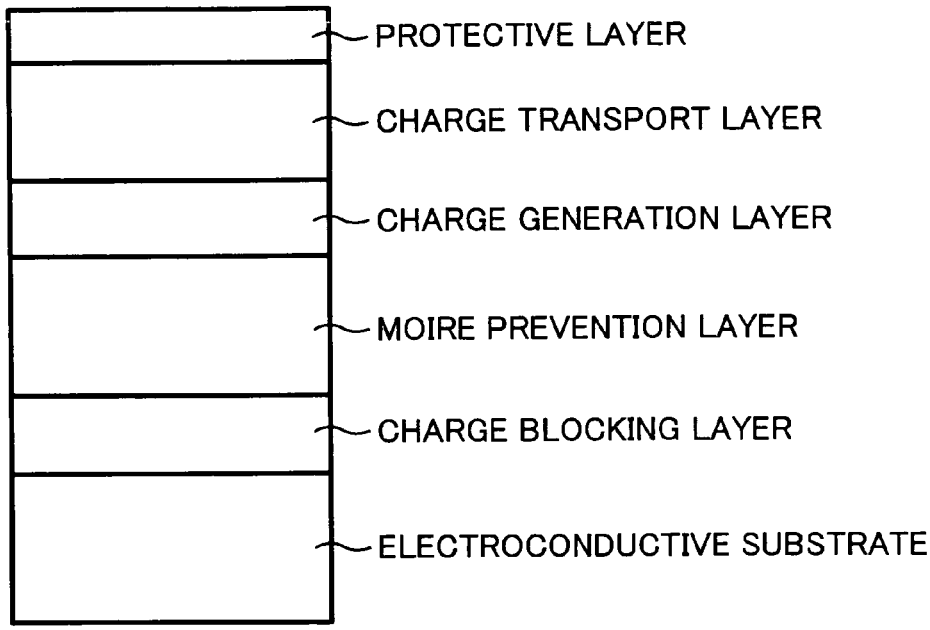
FIG. 5 is a cross-sectional view illustrating a further embodiment of layer composition of the photoreceptor of the present invention.

FIG. 5 is a cross-sectional view illustrating a further embodiment of layer composition of the photoreceptor of the present invention, wherein a charge blocking layer, an antimoire layer, a CGL, a CTL and a protection layer are layered in this order on an electroconductive substrate.

Suitable materials for use as the electroconductive substrate include, but are not limited to, materials having a volume resistance not greater than $10^{10}$ Ω·cm. Specific examples of such materials include, but are not limited to, a plastic cylinder, a plastic film or a paper sheet, on the surface of which a metal such as aluminum, nickel, chromium, nichrome, copper, gold, silver, platinum or a metal oxide such as tin oxides, indium oxides is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Laid-Open Patent Publication No. 52-36016, can also be used as the substrate.

Furthermore, substrates, in which a coating liquid including a binder resin and an electroconductive powder is coated on the supporters mentioned above, can be used as the substrate. Specific examples of such an electroconductive powder include, but are not limited to, carbon black, acetylene black, powders of metals such as aluminum, nickel, iron, Nichrome, copper, zinc, silver, and metal oxides such as electroconductive tin oxides, ITO. Specific examples of the binder resin include, but are not limited to, known thermoplastic resins, thermosetting resins and photo-crosslinking resins, such as polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, polyarylate, a phenoxy resin, polycarbonate, a cellulose acetate resin, an ethyl cellulose resin, a polyvinyl butyral resin, a polyvinyl formal resin, polyvinyl toluene, poly-N-vinyl carbazole, an acrylic resin, a silicone resin, an epoxy resin, a melamine resins, a urethane resin, a phenolic resin, an alkyd resin. Such an electroconductive layer can be formed by coating a coating liquid in which an electroconductive powder and a binder resin are dispersed in a solvent such as tetrahydrofuran, dichloromethane, methyl ethyl ketone, toluene, etc., and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and TEFLON (registered brand), with an electroconductive material, can also be preferably used as the substrate.

The intermediate layer comprises the N-alkoxymethylated nylon comprising a component having a molecular weight not greater than 5,000 in an amount of from 3 to 10% by weight. The intermediate layer has a function of preventing the charges, which are induced at the electroconductive substrate side of the layer in the charging process, from being injected into the photosensitive layer. Specifically, when negative charging is performed, the intermediate layer prevents injection of positive holes to the photosensitive layer. In contrast, when positive charging is performed, it prevents injection of electrons to the photosensitive layer.

In addition, an electroconductive polymer having a rectification property, and a resin or a compound having an electron accepting or donating property which is determined depending on the polarity of the charges formed on the surface of the photoreceptor can also be used therein.

The intermediate layer preferably has a thickness not less than 0.1 to 10 μm, and more preferably from 0.5 to 5 μm. When greater than 10 μm, the residual potential of the photoreceptor increases after imagewise light irradiation is repeatedly performed particularly under low temperature and low humidity conditions. In contrast, when less than 0.1 μm, the charge blocking effect becomes small. The intermediate layer can optionally include one or more materials such as crosslinking agents, solvents, additives and crosslinking promoters. The intermediate layer can be prepared by coating a coating liquid by a coating method such as blade coating, dip coating, spray coating, bead coating and nozzle coating, followed by drying and crosslinking using heat or light.

When the intermediate layer includes a charge blocking layer and an antimoire layer, the charge blocking layer including the N-alkoxymethylated nylon preferably has a thickness of from 0.1 to 2.0 μm, and more preferably from 0.5 to 1.5 μm. This is because when the intermediate layer is too thick, the residual potential of the photoreceptor increases after imagewise light irradiation is repeatedly performed particularly under low temperature and low humidity conditions, and when too thin, the charge blocking effect becomes small.

The function of the antimoire layer is to prevent occurrence of moire fringe in the resultant images due to interference of light, which is caused when coherent light (such as laser light) is used for optical writing. Namely, the antimoire layer scatters the light used for optical writing. In order to carry out this function, the layer preferably includes a material having a high refractive index. The antimoire layer typically includes a binder resin and an inorganic pigment. Suitable inorganic pigments include, but are not limited to, white inorganic pigments. Specific examples of the white inorganic pigments include, but are not limited to, titanium oxide, calcium fluoride, calcium oxide, silica, magnesium oxide and aluminum oxide. Among these pigments, titanium oxide is preferably used because of having high hiding power.

As FIGS. 4 and 5 show, since the injection of charges from the substrate is blocked by the charge blocking layer in the present invention, the antimoire layer preferably has an ability to transport charges having the same polarity as that of the charges formed on the surface of the photoreceptor, to prevent increase of residual potential. For example, in a negative charge type photoreceptor, the antimoire layer preferably has an electron conducting ability. Therefore it is preferable to use an electroconductive inorganic pigment or a conductive inorganic pigment for the antimoire layer. Alternatively, an electroconductive material (such as acceptors) may be added to the antimoire layer.

Specific examples of the binder resin for use in the antimoire layer include the resins for use in the charge blocking layer. Since the photosensitive layer is formed on the antimoire layer by coating a coating liquid, the binder resin preferably has a good resistance to the solvent included in the photosensitive layer coating liquid. Among the resins, thermosetting resins, and more preferably mixtures of alkyd and melamine resins, are preferably used as the binder resin of the antimoire layer. The mixing ratio of an alkyd resin to a melamine resin is an important factor influencing the structure and properties of the antimoire layer, and the weight ratio thereof is preferably from 5/5 to 8/2 (i.e., from 1 to 4). When the mixing ratio of an alkyd resin to a melamine resin is less than 1, the coated film is shrunk in the thermosetting process, and thereby coating defects are formed in the resultant film. In addition, the residual potential increasing problem occurs. In contrast, when the mixing ratio of an alkyd resin to a melamine resin is greater than 4, the electric resistance of the layer seriously decreases, and thereby the resultant images have background fouling, although residual potential of the photoreceptor is reduced.

The mixing ratio of the inorganic pigment to the binder resin in the antimoire layer is also an important factor, and the volume ratio thereof is preferably from 1/1 to 3/1 (i.e., from 1 to 3). When the ratio is less than 1 (i.e., the content of the inorganic pigment is too low), not only the antimoire effect deteriorates but also the residual potential increases after repeated use. In contrast, when the ratio is greater than 3, the film formability of the layer deteriorates, resulting in deterioration of surface conditions of the resultant layer. In addition, a problem in that the upper layer (e.g., the photosensitive layer) cannot form a good film thereon because penetration of the coating liquid into the antimoire layer occurs. This problem is fatal to the photoreceptor having a layered photosensitive layer including a thin charge generation layer as a lower layer because such a thin CGL cannot be formed on such an antimoire layer. In addition, when the ratio is greater than 3, a problem occurs in that the surface of the inorganic pigment cannot be covered with the binder resin. In this case, a charge generation material is directly contacted with the inorganic pigment and thereby the possibility of occurrence of a problem whereby carriers are thermally produced increases, resulting in occurrence of a background development problem.

By using two kinds of titanium oxides having different average particle diameters for the antimoire layer, the substrate 31 is effectively hidden by the antimoire layer and thereby occurrence of moire fringes can be well prevented and formation of pinholes in the layer can also be prevented. In this regard, the average particle diameters (D1 and D2) of the two kinds of titanium oxides preferably satisfy the following relationship:

$$0.2 < D2/D1 \leqq 0.5.$$

When the ratio D2/D1 is less than 0.2, the surface of the titanium oxide becomes more active, and thereby stability of the electrostatic properties of the resultant photoreceptor seriously deteriorates. In contrast, when the D2/D1 ratio is greater than 0.5, the electroconductive substrate 31 cannot be well hidden by the antimoire layer and thereby the moire preventing effect deteriorates and abnormal images such as moire fringes are produced. In this regard, the average particle diameter of the pigment means the average particle diameter of the pigment in a dispersion prepared by dispersing the pigment in water while applying a strong shear force thereto.

Further, the average particle diameter (D2) of the titanium oxide (T2) having a smaller average particle diameter is also an important factor, and is preferably greater than 0.05 μm and less than 0.20 μm. When D2 is less than 0.05 μm, hiding power of the layer deteriorates. Therefore, moire fringes tend to be caused. In contrast, when D2 is greater than 0.2 μm, the filling factor of the titanium oxide in the layer is small, and thereby background development preventing effect cannot be well produced.

The mixing ratio of the two kinds of titanium oxides in the antimoire layer is also an important factor, and is preferably determined such that the following relationship is satisfied:

$$0.2 \leqq T2/(T1+T2) \leqq 0.8,$$

wherein T1 represents the weight of the titanium oxide having a larger average particle diameter, and T2 represents the weight of the titanium oxide having a smaller average particle diameter.

When the mixing ratio (T2/T1+T2) is less than 0.2, the filling factor of the titanium oxide in the layer is small, and thereby background development preventing effect cannot be well produced. In contrast, when the mixing ratio (T2/(T1+T2) is greater than 0.8, the hiding power of the layer deteriorates, and thereby the antimoire effect cannot be well produced.

The antimoire layer preferably has a thickness of from 1 to 10 μm, and more preferably from 2 to 5 μm. When the layer is less than 1 μm, the antimoire effect cannot be well produced. In contrast, when the antimoire layer is greater than 10 μm, the residual potential increases after repeated use.

The antimoire layer is formed by a wet coating method using a solvent not eroding the lower charge blocking layer. Particularly, alcohol solvents should not be used because the charge blocking layer includes the N-alkoxymethylated nylon.

The photosensitive layer may be either a single-layered layer or a multilayered layer including a CGL and a CTL.

The CGL can include known charge generation materials. Specific examples thereof include, but are not limited to, metallophthalocyanines such as titanylphthalocyanine and chlorogalliumphthalocyanine; metal-free phthalocyanine; an azulenium salt pigment; a squaric acid methine pigment; a symmetric or an asymmetric azo pigment having a carbazole skeleton; a symmetric or an asymmetric azo pigment having a triphenyl amine skeleton; a symmetric or an asymmetric azo pigment having a diphenyl amine skeleton; a symmetric or an asymmetric azo pigment having a fluorenone skeleton; a symmetric or an asymmetric azo pigment azo pigment having an oxadiazole skeleton; a symmetric or an asymmetric azo pigment azo pigment having a bisstilbene skeleton; a symmetric or an asymmetric azo pigment having a distyryloxadiazole skeleton; a symmetric or an asymmetric azo pigment having a distyrylcarbazole skeleton; perylene pigments; anthraquinone pigments; polycyclic quinone pigments; quinone imine pigments; diphenylmethane pigments; triphenylmethane pigments; benzoquinone pigments; naphthoquinone pigments; cyanine pigments; azomethine pigments; indigoide pigments; bisbenzimidazole pigments; etc.

The phthalocyanine pigments for use in the present invention include, but are not limited to, a metallophthalocyanine and a metal-free phthalocyanine, obtained by the method disclosed in "Phthalocyanine Compounds" (published by LINEHOLD in 1963) written by Moser and Thomas and the like methods.

Specific examples of the metallophthalocyanine include, but are not limited to, metallophthalocyanines having copper, silver, beryllium, magnesium, calcium, zinc, indium, sodium, lithium, titanium, tin, lead, vanadium, chrome, manganese, iron, cobalt, etc. as a central metal. The central metal may be a halogenated metal having three or more atomic valences. The phthalocyanine may have known crystalline forms such as α-form, β-form, Y-form, ϵ-form, τ-form and X-form or a noncrystalline form.

Among the phthalocyanines, a titanylphthalocyanine having titanium as a central metal (TiOPc) and the following formula is more preferably used because of its high sensitivity:

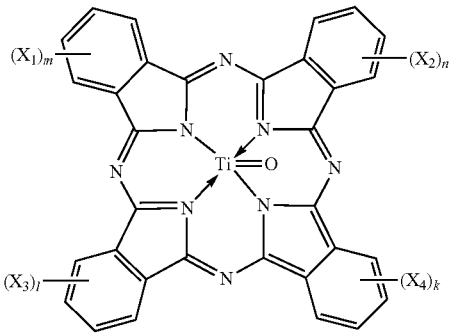

wherein $X_1$, $X_2$, $X_3$ and $X_4$ each, independently, represent a halogen atom; and n, m, l and k each, independently, represent 0 or integers of from 1 to 4.

Further, the titanylphthalocyanine preferably has an X-ray diffraction spectrum such that a maximum peak is observed at a Bragg (2θ) angle (±0.2°) of 27.2°; or an X-ray diffraction spectrum such that a maximum peak is observed at a Bragg (2θ) angle of 27.2±0.2°, a lowest angle peak at an angle of 7.3±0.2°, and a main peak at each of Bragg (2θ) angles (±0.2°) of 9.4°, 9.6°, and 24.0°, wherein no peak is observed between the peaks of 7.3° and 9.4° and at an angle of 26.3 (±0.2°).

Japanese Laid-Open Patent Publication No. 2001-19871 discloses this crystal form forming a stable electrophotographic photoreceptor without losing its high sensitivity and deterioration of its chargeability even in repeated use. However, when repeatedly used for very long periods, background fouling occurs and the life thereof is not satisfactory yet. This is because background fouling caused by the CGL is improved, but background fouling caused by the charge injected by the electroconductive substrate is not.

Further, the present inventors found that a CGL including the titanylphthalocyanine having an average primary particle diameter not greater than 0.25 μm increases the photosensitivity and largely improves background fouling. Therefore, the titanylphthalocyanine having the above-mentioned crystalline form and an average primary particle diameter not greater than 0.25 μm is most effectively used. The method of controlling the average primary particle diameter will be mentioned later.

Japanese Laid-Open Patent Publication No. 5-80572 discloses a method of including plural undercoat layers or intermediate layers between an electroconductive substrate and a photosensitive layer. However, when the photosensitive layer has high sensitivity, a heat carrier generated therein causes background fouling, which cannot completely be prevented. This is more frequently caused by use of a charge generation material absorbing long-wavelength light, typified by the titanylphthalocyanine for use in the present invention.

Although methods of preventing background fouling caused by a CGL or an undercoat layer are disclosed, there are plural causes thereof and background fouling cannot be prevented for long periods unless the plural causes are all resolved at the same time. Even though the background fouling is not serious at the beginning, the causes thereof grow as the photoreceptor fatigues due to repeated use and the constituents thereof deteriorate. Therefore, the causes of the background fouling need to be eliminated as much as possible, and the fatigue of the photoreceptor needs to be stabilized at the same time.

In the present invention, the background fouling raised by many causes are prevented, the temporal stability of the chargeability of a photoreceptor is increased, and side effects due to the residual potential and the environment are minimized.

Now, a method of synthesizing the titanylphthalocyanine crystal having a specific crystal form for use in the present invention will be explained.

First, a method of synthesizing a crude titanylphthalocyanine crystal will be explained.

Methods of synthesizing phthalocyanines have been known for a long time, and are disclosed in "Phthalocyanine compounds" published in 1963 and "The Phthalocyanines" published in 1983, which are written by Moser and other authors, and in Japanese Laid-Open Patent Publication No. 6-293769.

For example, a first method is to heat a mixture of phthalic anhydrides, metals or halogenated metals and urea in the presence or absence of a solvent having a high boiling point. In this method, catalysts such as ammonium molybdate are optionally used. A second method is to heat phthalonitriles and halogenated metals in the presence or absence of a solvent having a high boiling point. This method is used to produce phthalocyanine which cannot be produced by the first method, such as aluminium phthalocyanine, indium phthalocyanine, oxovanadium phthalocyanine, oxotitanium phthalocyanine and zirconium phthalocyanine. A third method is to react phthalic anhydrides or phthalonitrile with ammonia first to prepare an intermediate such as 1,3-diiminoisoindoline and to react the intermediate with halogenated metals in a solvent having a high boiling point. A fourth method is to react phthalonitrile with metalalkoxide in the presence of urea, etc. Particularly, the fourth method is significantly an effective method to synthesize a material for electrophotography because chlorination (halogenation) of a benzene ring does not occur.

In the present invention, halogenated titanium is most preferably not used as a material, the best merit of which is that the resultant titanylphthalocyanine crystal is halogen free. Photoreceptors using the titanylphthalocyanine crystal including a halogenated titanylphthalocyanine crystal as an impurity deteriorate in their photosensitivities and chargeabilities in many cases (Japan Hardcopy '89 p. 103 1989). In the present invention, a halogen-free titanylphthalocyanine crystal disclosed in Japanese Laid-Open Patent Publication No. 2001-19871 is effectively used. In order to synthesize the halogen-free titanylphthalocyanine crystal, a halogenated material is not used as a material. Specifically, the method will be mentioned later.

Next, a method of synthesizing an amorphous titanylphthalocyanine (low crystallinity titanylphthalocyanine) will be explained. This is a method of dissolving phthalocyanine in sulfuric acid, diluting the mixture with water and re-precipitating. An acid paste method or an acid slurry method can be used.

A specific method is to dissolve the above-mentioned synthesized crude titanylphthalocyanine crystal in an amount of concentrated sulfuric acid that is 10 to 50 times as much as the crude titanylphthalocyanine crystal, optionally remove insolubles with a filter, etc. and slowly put the mixture into an amount of sufficiently cooled or iced water that is 10 to 50 time as much as the concentrated sulfuric acid to re-precipitate the titanylphthalocyanine. After the precipitated titanylphthalocyanine is filtered, the titanylphthalocyanine is washed with ion-exchanged water and filtered. This operation is sufficiently repeated until the filtrate becomes neutral. Finally, the titanylphthalocyanine is washed with clear ion-exchanged water and is filtered to prepare a water paste having a solid concentration of from 5 to 15 by weight.

It is important to sufficiently wash the titanylphthalocyanine with ion-exchanged water so as not to leave the concentrated sulfuric acid therein. Specifically, the ion-exchanged water after washing preferably has a pH of from 6 to 8 or a specific conductivity not greater than 8 μS/cm, more preferably not greater than 5 μS/cm, and furthermore preferably not greater than 3 μS/cm. The pH and specific conductivity in these ranges prove that the residual sulfuric acid does not affect the resultant photoreceptor. The pH and specific conductivity can be measured by a marketed pH meter and a marketed conductivity meter respectively. When the pH or specific conductivity is out of the range, the chargeability and photosensitivity of the resultant photoreceptor deteriorate.

Thus, the amorphous titanylphthalocyanine (low crystallinity titanylphthalocyanine) for use in the present invention is prepared. The amorphous titanylphthalocyanine (low crystallinity titanylphthalocyanine) preferably has at least a maximum diffraction peak at a Bragg (2θ) of from 7.0 to 7.5±0.2° when irradiated with a specific X-ray of CuKα having a wavelength of 1.542 Å. Particularly, half width of the diffraction peak is preferably not less than 10. Further, the amorphous titanylphthalocyanine (low crystallinity titanylphthalocyanine) preferably has an average primary particle size not greater than 0.1 μm.

Next, the crystal conversion method will be explained.

The crystal conversion is a process of converting the above-mentioned amorphous titanylphthalocyanine (low crystallinity titanylphthalocyanine) to a crystal form having at least a maximum diffraction peak at a Bragg (2θ) angle of 27.2±0.2° when irradiated with a specific X-ray of CuKα having a wavelength of 1.542 Å, main peaks at 9.4°, 9.6° and 24.0°, a minimum diffraction peak at 7.3°, not having peaks at from 7.4° to 9.4°, and further not having a peak at 26.3°.

A specific method of obtaining such titanylphthalocyanine crystal is to mix and stir the amorphous titanylphthalocyanine (low crystallinity titanylphthalocyanine) with an organic solvent in the presence of water without drying the amorphous titanylphthalocyanine (low crystallinity titanylphthalocyanine).

Any organic solvent for use in this method can be used if only a desired crystal form can be obtained. In particular, a solvent selected from the group consisting of tetrahydrofuran, toluene, dichloromethane, carbon bisulfide, o-dichlorobenzene and 1,1,2-trichloroethane is preferably used. These solvents are preferably used alone, but can also be used in combination or with other solvents. The organic solvent for use therein preferably has a weight not less than 10 times, and more preferably not less than 30 times as much as the amorphous titanylphthalocyanine. This is because the crystal conversion can quickly be performed, and impurities included in the amorphous titanylphthalocyanine are sufficiently removed.

Japanese Laid-Open Patent Publication No. 8-110649 discloses a method of putting titanylphthalocyanine dissolved in sulfuric acid and ion-exchanged water into an organic solvent to perform a crystal conversion. Although this method can prepare a titanylphthalocyanine crystal having an X-ray diffraction spectrum similar to that of the present invention, the titanylphthalocyanine crystal having high sulfate ion density has poor light attenuation (photosensitivity). The reason is as mentioned previously.

This crystal conversion method is disclosed in Japanese Laid-Open Patent Publication No. 2001-19871.

In the present invention, the titanylphthalocyanine crystal preferably has a smaller particle diameter.

There are two methods of controlling the particle diameter of the titanylphthalocyanine crystal. One is synthesizing crystals having a particle diameter not greater than 0.25 μm, and the other is removing crystals having a particle diameter greater than 0.25 μm after dispersing the crystals. They can be used in combination.

Figure 6:
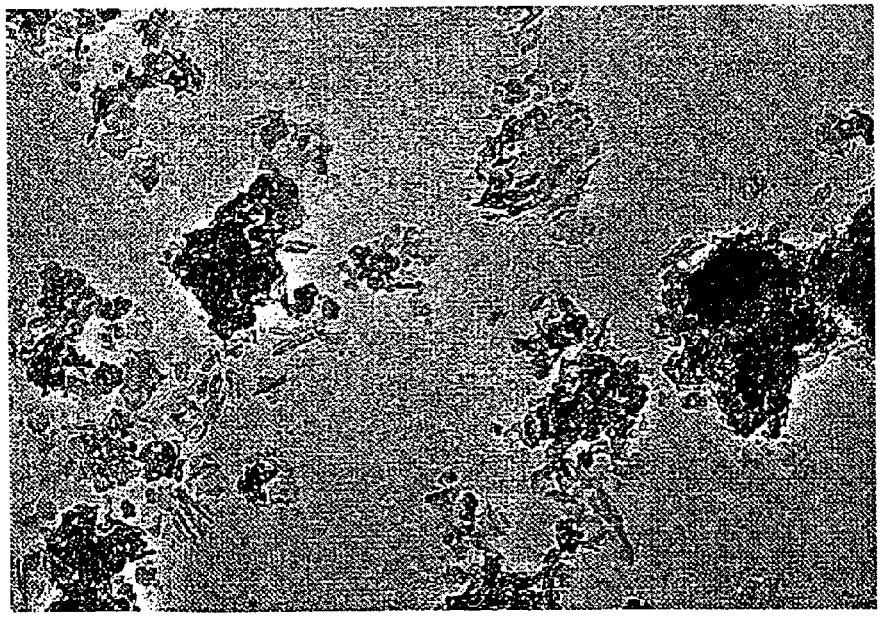
FIG. 6 is an electron microscopic picture of a preferred particle condition of the amorphous titanylphthalocyanine of the present invention.
Figure 7:
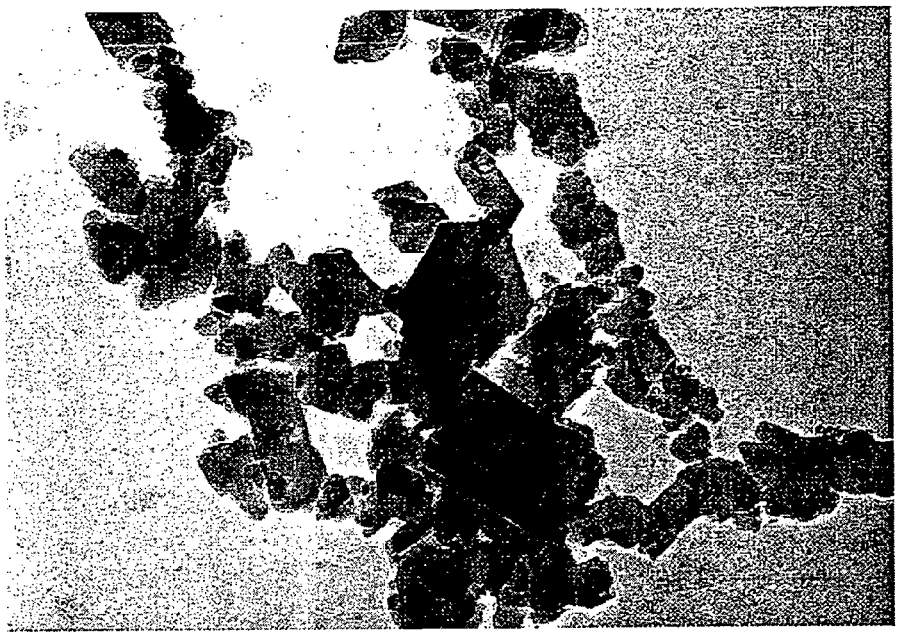
FIG. 7 is an electron microscopic picture of an embodiment of the crystal-converted titanylphthalocyanine of the present invention.

The present inventors observed in the crystal conversion that the amorphous titanylphthalocyanine (low crystallinity titanylphthalocyanine) has a primary particle diameter not greater than 0.1 μm (almost all the particles have a diameter of from about 0.01 to 0.05 μm as shown in FIG. 6 wherein a scale bar is 0.2 μm), and that the crystal grows at the same time. Usually, in such a crystal conversion, a sufficient time is spent for the crystal conversion such that the materials do not remain and a filtered titanylphthalocyanine crystal having a desired crystal form is obtained after the sufficient crystal conversion. Therefore, the crystal after the crystal conversion has large primary particles (about 0.3 to 0.5 μm in diameter as shown in FIG. 7 wherein a scale bar is 0.2 μm) although the material having sufficiently small primary particles is used.

When the thus prepared titanylphthalocyanine crystal is dispersed, a strong shear is applied to make the particle size small (not greater than about 0.2 μm in diameter). Further, high energy is optionally applied to pulverize the primary particles. Consequently, a part of the particles has an undesired crystal form as mentioned above.

On the other hand, the present invention is to obtain a titanylphthalocyanine crystal having a primary particle size as small as possible by finding out the time when the crystal conversion is completed before the crystal hardly grows, i.e., before the amorphous titanylphthalocyanine particle size becomes greater than about 0.2 μm. The particle size becomes large in proportion to the crystal conversion time. Therefore, it is essential to enhance the crystal conversion efficiency and complete the conversion in a short time. For this purpose, there are two important points.

One is to select a suitable crystal conversion solvent as mentioned above to enhance the crystal conversion efficiency. The other is to strongly stir the solvent and titanylphthalocyanine water paste prepared as above such that they sufficiently contact each other in order to complete the crystal conversion in a short time. Specifically, stirring methods using strong stirrers, such as propeller stirrers and homogenizers (homomixers), are used to perform the crystal conversion in a short time. These methods can obtain a titanylphthalocyanine crystal sufficiently converted without crystal growth and remaining materials. In this case, the quantity of the organic solvent is also important. Specifically, the organic solvent is preferably used not less than 10 times, and more preferably not less than 30 times as much as a solid content of the amorphous titanylphthalocyanine. This is because the crystal conversion can quickly be performed, and impurities included in the amorphous titanylphthalocyanine are sufficiently removed.

In addition, as mentioned above, because the crystal particle size grows in proportion to the crystal conversion time, when a predetermined reaction (crystal conversion) is completed, it is an effective method to stop the reaction immediately. For example, after the crystal conversion is performed, a large amount of a solvent preventing a crystal conversion is immediately included in the mixture. Suitable solvents preventing a crystal conversion include alcohol solvents, ester solvents, etc. These solvents having an amount of approximately ten times as much as the crystal conversion solvent can stop the crystal conversion.

The smaller the thus prepared primary particle size, the better for the resultant photoreceptor. However, in consideration of the following filtering process to prepare a pigment and dispersion stability thereof in a dispersion liquid, primary particles having too small a size occasionally have an adverse effect. Namely, when the primary particle size is too small, it takes quite a long time to filter the particles in the filtering process. In addition, because the primary particles having too small a size totally have a large surface area, the probability of re-agglomeration of the pigment particles increases. Therefore, the pigment particles preferably have a particle size of from about 0.05 to 0.2 μm.

Figure 8:
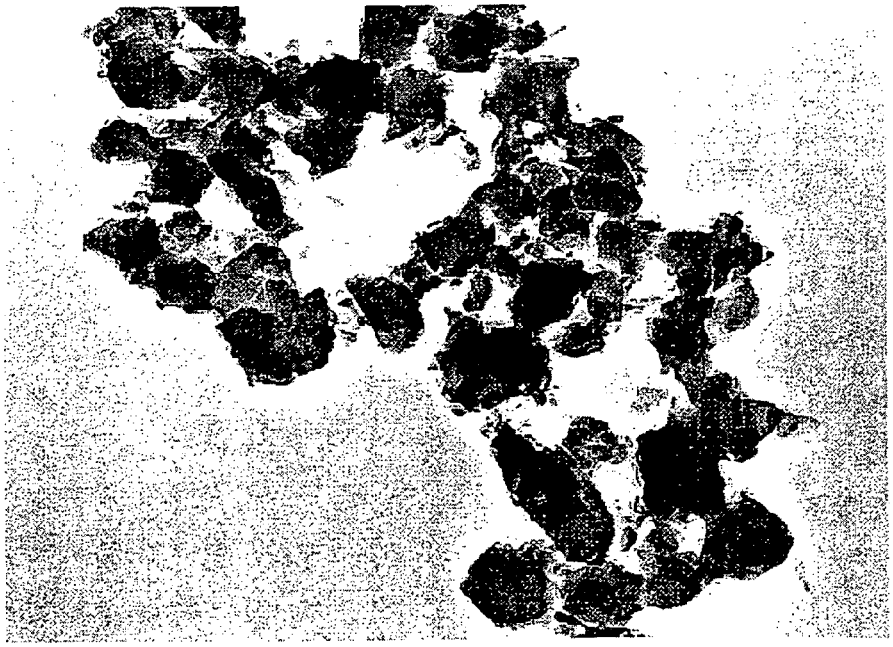
FIG. 8 is an electron microscopic picture of another embodiment of the crystal-converted titanylphthalocyanine of the present invention.

FIG. 8 is an electron microscopic picture of another embodiment the crystal-converted titanylphthalocyanine in a short time, wherein a scale bar is 0.2 μm. Different from the crystal-converted titanylphthalocyanine in FIG. 7, the crystal-converted titanylphthalocyanine in FIG. 8 is small and uniform in the particle size, and has no coarse particle.

When the titanylphthalocyanine crystal having a small primary particle diameter is dispersed, a shearing strength just for breaking secondary particles (agglutinated primary particles) has only to be applied thereto to have a dispersed particle size not greater than 0.25 μm, and more preferably not greater than 0.2 μm. Since more energy than necessary is not applied thereto, the particles do not partially have undesired crystal forms and the resultant dispersion includes the titanylphthalocyanine crystal having a sharp particle diameter distribution.

The particle diameter means the volume average particle diameter, and can be determined by a centrifugal automatic particle diameter analyzer, CAPA-700 from Horiba Ltd. The volume average particle diameter means the cumulative 50% particle diameter (i.e., Median diameter). However, by using this particle diameter determining method, there is a case where a small amount of coarse particles cannot be detected. Therefore, it is preferable to directly observe the dispersion including a charge generation material with an electron microscope, to determine the particle diameter of the crystal.

In addition, with respect to minute coating defects included in a layer using a dispersion, the following knowledge can be acquired. Whether coarse particles are present in the dispersion can be detected by a particle diameter measuring instrument if the concentration of coarse particles is on the order of a few percent or more. However, when the concentration is not greater than 1%, the presence of coarse particles cannot be detected by such an instrument. Therefore, even when it is confirmed that the average particle diameter of the crystal in a dispersion falls in the preferable range, a problem in that the resultant charge generation layer has minute coating defects can occur.

Figure 9:
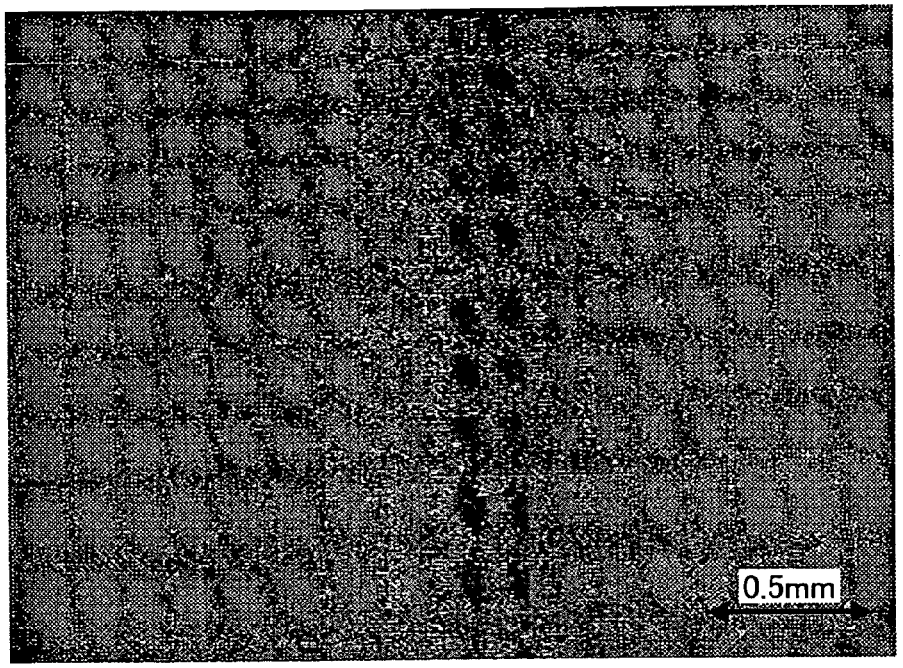
FIG. 9 is an electron microscopic picture of the status of a dispersion.
Figure 10:
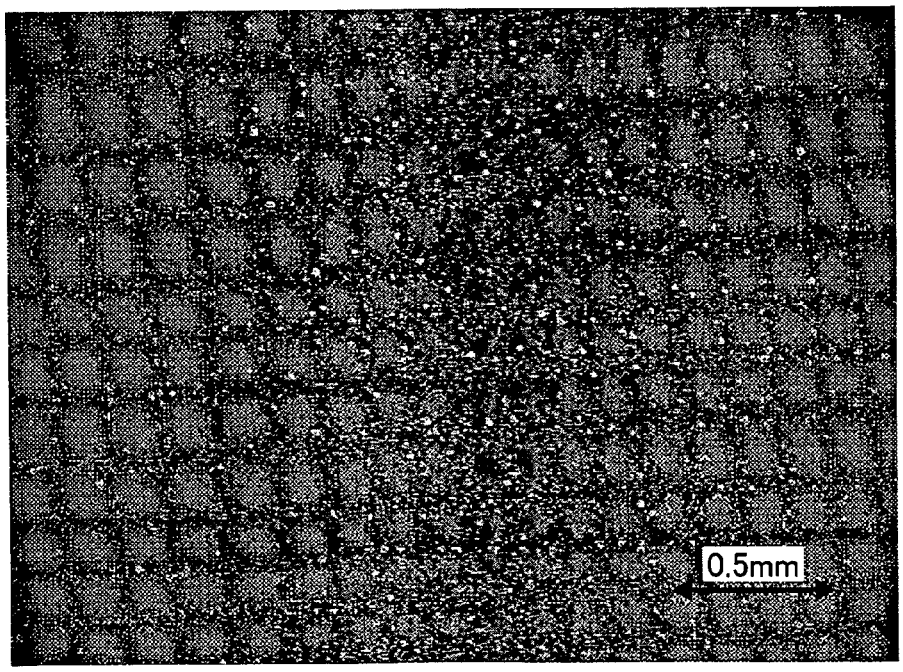
FIG. 10 is an electron microscopic picture of the status of another dispersion.

FIGS. 9 and 10 are photographs showing the dispersion status in different dispersions which are prepared by the same method except that the dispersion time is changed. The dispersion time for the dispersion in FIG. 9 is shorter than that in FIG. 10. It is clear from the comparison of FIG. 9 with FIG. 10 that coarse particles are present in the dispersion illustrated in FIG. 9. Coarse particles are observed as black spots in FIG. 10.

Figure 11:
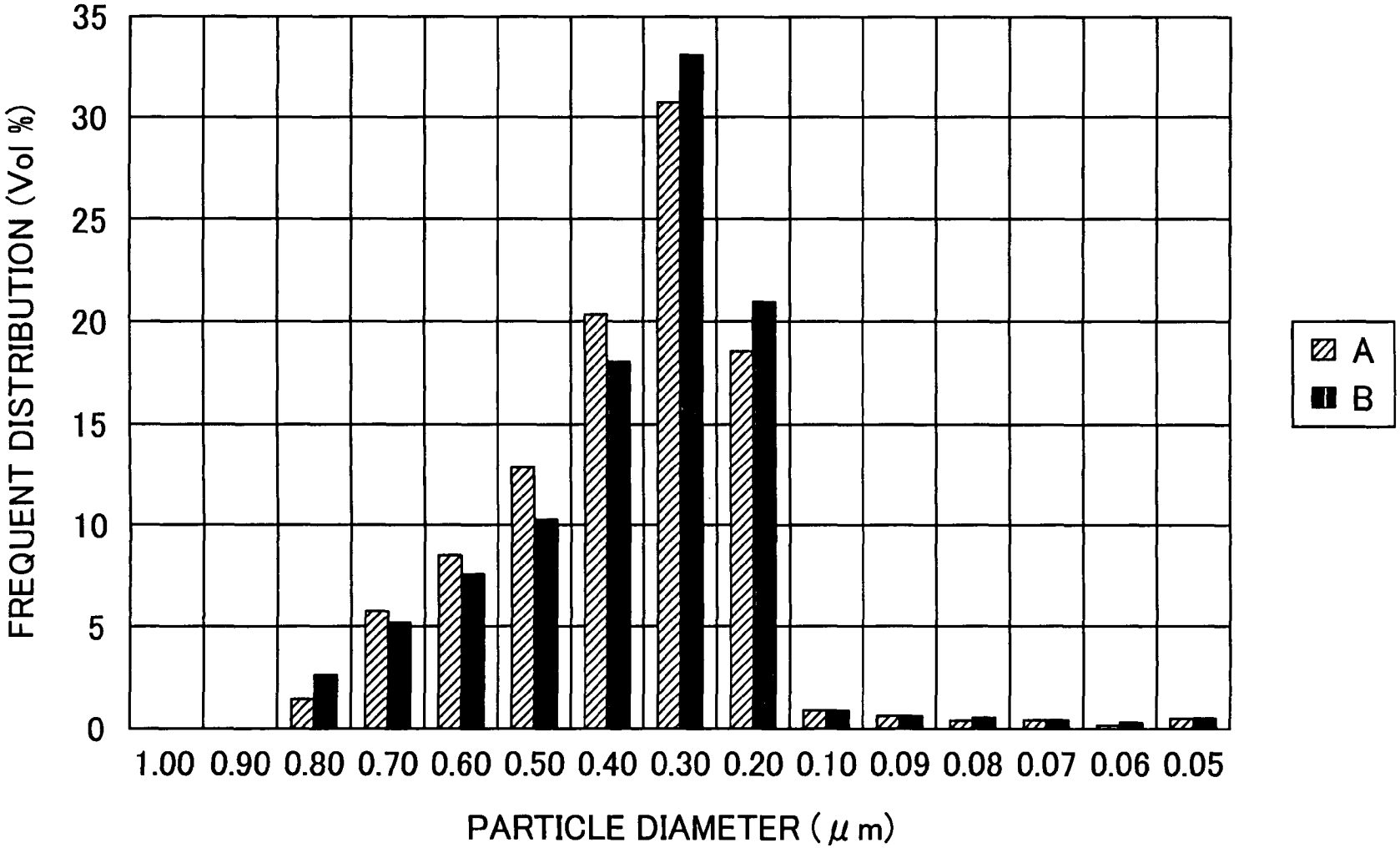
FIG. 11 is a graph showing an average particle diameter and a particle diameter distribution of the dispersions in FIGS. 9 and 10.

The particle diameter distributions of the dispersions A and B, which are measured with a centrifugal automatic particle diameter analyzer, CAPA-700 from Horiba Ltd., are illustrated in FIG. 11. In FIG. 11, characters A and B represent the particle diameter distributions of the dispersions in FIG. 9 and FIG. 10, respectively. As can be understood from the graph, the particle diameter distributions are almost the same. The average particle diameters of A and B are 0.29 μm and 0.28 μm, respectively, which are the same when considering the measurement error. Thus, whether or not coarse particles are present cannot be determined using such a particle diameter measuring instrument. As mentioned above, whether coarse particles are present in a dispersion can be detected only by the method in which the dispersion is directly observed using a microscope.

It is effective to make the primary particle diameter as small as possible. Therefore, it is effective to select a suitable crystal conversion solvent to increase the crystal conversion efficiency, and strongly stir such that the solvent and the water paste of the titanylphthalocyanine fully contact each other to complete the crystal conversion in a short time.

Thus, the titanylphthalocyanine crystal having a primary particle diameter not greater than 0.25 μm, and more preferably not greater than 0.2 μm can be prepared. In addition to the crystal conversion method disclosed in Japanese Laid-Open Patent Publication No. 2001-19871, the above-mentioned crystal conversion method of preparing a microscopic titanylphthalocyanine crystal is optionally used in the present invention.

Next, the converted titanylphthalocyanine crystal is immediately filtered to be separated from the crystal conversion solvent. A filter having a proper size is used for the filtration. Filtration under reduced pressure is most preferably used.

Then, the separated titanylphthalocyanine crystal is optionally heated and dried. A known drier can be used for heating and drying the crystal. However, a fan drier is preferably used when heating and drying of the crystal are performed in the atmosphere. Further, in order to increase drying speed and an effect of the present invention, drying under reduced pressure is quite an effective method. Particularly, drying under reduced pressure is an effective method for a material which is dissolved at a high temperature or a material the crystal form of which changes. In particular, drying in a degree of vacuum which is higher than 10 mmHg is effective (i.e. pressure in the drying vessel is less than 10 mmHg absolute).

The thus prepared titanylphthalocyanine crystal having a specific crystal form is effectively used for a charge controlling agent for an electrophotographic photoreceptor. However, as mentioned above, the crystal form is unstable and has a drawback of easily transforming. However, in the present invention, the primary particles which are as small as possible can prepare a dispersion liquid including the particles having a small average particle diameter and can make the crystal form quite stable.

Next, a method of removing coarse particles after dispersing the titanylphthalocyanine crystal.

The dispersion liquid is prepared by typical methods using a ball mill, an attritor, a sand mill, a beads mill, an ultrasonic, etc., in which the titanylphthalocyanine crystal is optionally dispersed with a binder resin in a proper solvent. The binder resin may be selected for electrostatic properties of the resultant photoreceptor, and the solvent may be selected for wettability to the pigment and dispersibility thereof.

As previously mentioned, the titanylphthalocyanine crystal having a maximum diffraction peak at a Bragg (2θ) angle of 27.2±0.2° when irradiated with a specific X-ray of CuKα having a wavelength of 1.542 Å is known to easily transform the crystal with heat energy or mechanical shear. Therefore, stabilizing and microparticulating the crystal form have trade-off relations. In order to solve this problem, the following method is effectively used.

Namely, a dispersion, wherein the crystal is microparticulated as small as possible before the crystal is transformed, is filtered with a suitable filter. This method can remove even visually-unobservable (or nondetectable with a particle diameter measurer) coarse particles, and quite effectively uniform the particle diameter distribution. Specifically, the dispersion is filtered with a filter having an effective pore diameter not greater than 3 μm, and more preferably not greater than 1 μm. This is because, for a photoreceptor used in an image forming apparatus producing 600 dpi images, removing the coarse particles having a diameter greater than 3 μm is recommended. In addition, the titanylphthalocyanine crystal having a particle diameter not greater than 0.25 μm, and more preferably not greater than 0.2 μm can be prepared thereby.

When the pore diameter is too small, filtering takes too much time, the filter is clogged, or a pump is too loaded for transferring the dispersion. The filter should be resistant to a solvent used in the dispersion.

When the coarse particles are too many in the dispersion and all removed, the solid contents therein changes after filtered. Therefore, a suitable particle size and a standard deviation are used. In order to efficiently filter without loss or clogging, the dispersion before filtered preferably has a volume-average particle diameter not greater than 0.3 μm, and a standard deviation thereof not greater than 0.2 μm.

The smaller the pore diameter, the more effective (assured) to remove coarse particles. However, when too small, even preferred particles are also removed. Therefore, a combination of microparticulating the primary particles of the titanylphthalocyanine crystal mentioned above and filtering the dispersion is quite effective.

Namely, (i) microparticulated titanylphthalocyanine reduces the dispersion time, stress and possibility of the crystal transformation. (ii) The remaining coarse particles after being dispersed have particle diameters smaller than those when not microparticulated, and a smaller filter can be used and the coarse particles are more effectively removed. In addition, the removed titanylphthalocyanine is reduced and the dispersion constituents change less before and after filtered.

The CGL includes an organic charge generation material (CGM) as a main component, and is typically prepared by coating a coating liquid, which is prepared by dispersing an organic CGM in a solvent optionally together with a binder resin using a dispersing machine such as ball mills, attritors, sand mills and supersonic dispersing machines, on an electroconductive substrate, followed by drying.

Specific examples of the binder resins, which are optionally included in the CGL coating liquid, include, but are not limited to, polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. Among the binder resins, polyvinyl acetal represented by polyvinyl butyral is preferably used. The content of the binder resin in the CGL is preferably from 0 to 500 parts by weight, and preferably from 10 to 300 parts by weight, per 100 parts by weight of the CGM included in the layer.

The charge transport layer (CTL) can be formed by dissolving or dispersing a charge transport material (CTM) and a binder resin in a proper solvent to prepare a coating liquid, coating the coating liquid on the CGL, and drying the coated liquid. Additives such as a plasticizer, a leveling agent and an antioxidant may optionally be included in the CTL.

The CTM includes a positive-hole transport material and an electron transport material. Specific examples of the electron transport material include, but are not limited to, electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno [1,2-b]thiophene-4-one, 1,3,7-trinitrodibenzothiphene-5,5-dioxide, benzoquinone derivatives, etc.

Specific examples of the positive-hole transport material include, but are not limited to, known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, etc. These CTMs can be used alone or in combination.

Specific examples of the binder resin include, but are not limited to, thermoplastic resins or thermosetting resins such as polystyrene, a styrene-acrylonitrile copolymer, a styrene-butadiene copolymer, a styrene-maleic anhydride copolymer, polyester, polyvinyl chloride, a vinylchloride-vinylacetate copolymer, polyvinyl acetate, polyvinylidene chloride, polyarylate, a phenoxy resin, polycarbonate, a cellulose acetate resin, an ethyl cellulose resin, a polyvinyl butyral resin, a polyvinyl formal resin, polyvinyl toluene, poly-N-vinyl carbazole, an acrylic resin, a silicone resins, an epoxy resin, a melamine resin, a urethane resin, a phenolic resin and an alkyd resin.

The CTL preferably includes a CTM in an amount of from 20 to 300 parts by weight, and more preferably from 40 to 150 parts by weight per 100 parts by weight of the binder resin. The CTL preferably has a thickness of from 5 to 100 μm. Suitable solvents for use in the coating liquid include, but are not limited to, tetrahydrofuran, dioxane, toluene, dichloromethane, monochlorobenzene, dichloroethane, cyclohexanone, methyl ethyl ketone, acetone and the like solvents.

Particularly, a non-halide solvent is preferably used for the purpose of lessening the burden on the environment, and preventing background fouling. Specific examples of the solvent include, but are not limited to, tetrahydrofuran, dioxolane, cyclic ethers such as dioxane, toluene, aromatic carbon hydrides such as xylene and their derivatives.

In addition, the CTL preferably includes a polymer CTM, which has both a binder resin function and a charge transport function, because the resultant CTL has good abrasion resistance. Suitable charge transport polymer materials include known polymer CTMs. Among these materials, polycarbonate resins having a triarylamine structure in their main chain and/or side chain are preferably used. In particular, polymer CTMs having the following formulae (I) to (X) are preferably used:

(I)

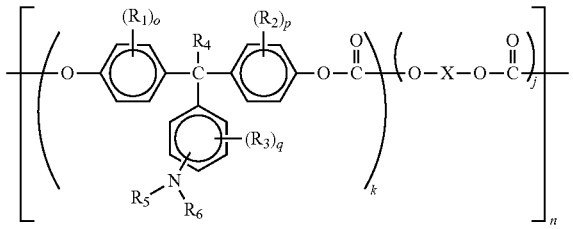

wherein, $R_1$, $R_2$ and $R_3$ each, independently, represent a substituted or unsubstituted alkyl group, or a halogen atom; $R_4$ represents a hydrogen atom, or a substituted or unsubstituted alkyl group; $R_5$, and $R_6$ each, independently, represent a substituted or unsubstituted aryl group; o, p and q each, independently, represent 0 or an integer of from 1 to 4; k is a number of from 0.1 to 1.0 and j is a number of from 0 to 0.9; n represents a repeating number and is an integer of from 5 to 5000; and X represents a divalent aliphatic group, a divalent alicyclic group or a divalent group having the following formula:

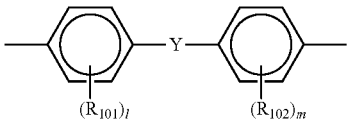

wherein, $R_{101}$ and $R_{102}$ each, independently, represent a substituted or unsubstituted alkyl group, an aromatic ring group or a halogen atom; l and m each, independently, represent 0 or an integer of from 1 to 4; and Y represents a direct bonding, a linear alkylene group, a branched alkylene group, a cyclic alkylene group, —O—, —S—, —SO—, —SO2-, —CO—, —CO—O—Z—O—CO— (Z represents a divalent aliphatic group), or a group having the following formula:

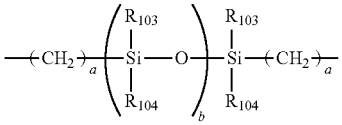

wherein, a is an integer of from 1 to 20; b is an integer of from 1 to 2000; and $R_{103}$ and $R_{104}$ each, independently, represent a substituted or unsubstituted alkyl group, or a substituted or unsubstituted aryl group, and wherein $R_{101}$, $R_{102}$, $R_{103}$ and $R_{104}$ may be the same or different from the others; and the two copolymers in the formula (I) may be random copolymers;

(II)

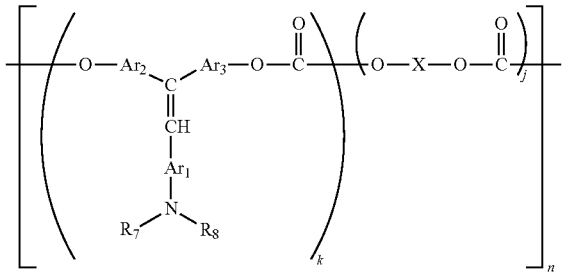

wherein, $R_7$ and $R_8$ each, independently, represent a substituted or unsubstituted aryl group; $Ar_1$, $Ar_2$ and $Ar_3$ each, independently, represent an arylene group; and X, k, j and n are as in formula (I); and the two copolymers in the formula (II) may be random copolymers;

(III)

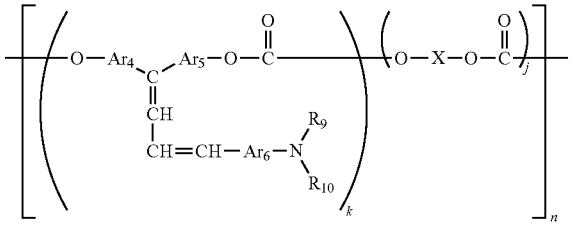

wherein, $R_9$ and $R_{10}$ each, independently, represent a substituted or unsubstituted aryl group; $Ar_4$, $Ar_5$ and $Ar_6$ each, independently, represent an arylene group; and X, k, j and n are as in formula (I); and the two copolymers in the formula (III) may be random copolymers;

(IV)

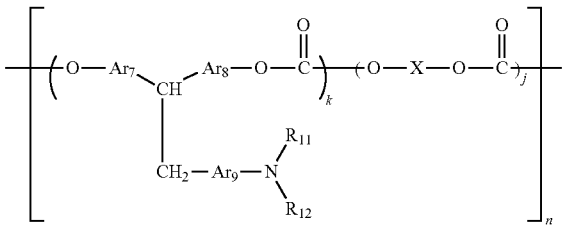

wherein, $R_{11}$ and $R_{12}$ each, independently, represent a substituted or unsubstituted aryl group; $Ar_7$, $Ar_8$ and $Ar_9$ each, independently, represent an arylene group; p is an integer of from 1 to 5; and X, k, j and n are as in formula (I); and the two copolymers in the formula (IV) may be random copolymers;

(V)

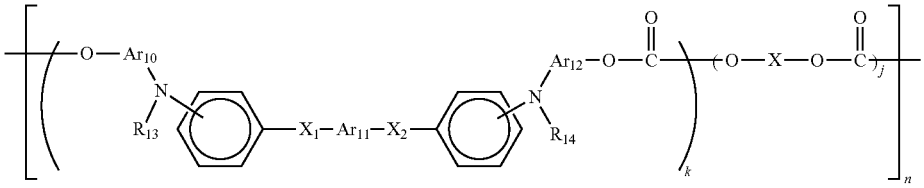

wherein, $R_{13}$ and $R_{14}$ each, independently, represent a substituted or unsubstituted aryl group; $Ar_{10}$, $Ar_{11}$ and $Ar_{12}$ each, independently, represent an arylene group; $X_1$ and $X_2$ each, independently, represent a substituted or unsubstituted ethylene group, or a substituted or unsubstituted vinylene group; and X, k, j and n are as in formula (I); and the two copolymers in the formula (V) may be random copolymers;

(VI)

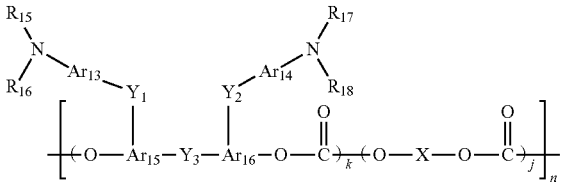

wherein, $R_{15}$, $R_{16}$, $R_{17}$ and $R_{18}$ each, independently, represent a substituted or unsubstituted aryl group; $Ar_{13}$, $Ar_{14}$, $Ar_{15}$ and $Ar_{16}$ each, independently, represent an arylene group; $Y_1$, $Y_2$ and $Y_3$ each, independently, represent a direct bonding, a substituted or unsubstituted alkylene group, a substituted or unsubstituted cycloalkylene group, a substituted or unsubstituted alkyleneether group, an oxygen atom, a sulfur atom, or a vinylene group; and X, k, j and n are as in formula (I); and the two copolymers in the formula (VI) may be random copolymers;

(VII)

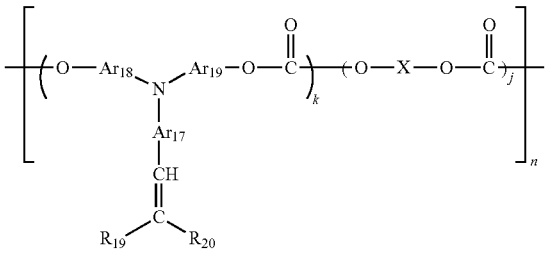

wherein, $R_{19}$ and $R_{20}$ each, independently, represent a hydrogen atom, or substituted or unsubstituted aryl group, or $R_{19}$ and $R_{20}$ may form a ring; $Ar_{17}$, $Ar_{18}$ and $Ar_{19}$ each, independently, represent an arylene group; and X, k, j and n are as in formula (I); and the two copolymers in the formula (VII) may be random copolymers;

(VIII)

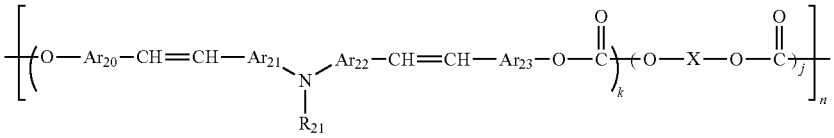

wherein, $R_{21}$ represents a substituted or unsubstituted aryl group; $Ar_{20}$, $Ar_{21}$, $Ar_{22}$ and $Ar_{23}$ each, independently, represent an arylene group; and X, k, j and n are as in formula (I); and the two copolymers in the formula (VIII) may be random copolymers;

(IX)

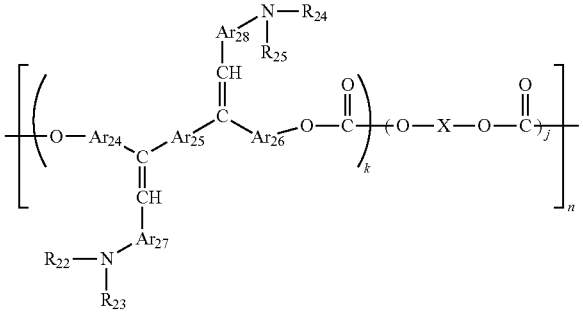

wherein, $R_{22}$, $R_{23}$, $R_{24}$ and $R_{25}$ each, independently, represent a substituted or unsubstituted aryl group; $Ar_{24}$, $Ar_{25}$, $Ar_{26}$, $Ar_{27}$ and $Ar_{28}$ each, independently, represent an arylene group; and X, k, j and n are as in formula (I); and the two copolymers in the formula (IX) may be random copolymers;

(X)

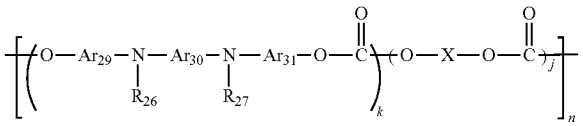

wherein, $R_{26}$ and $R_{27}$ each, independently, represent a substituted or unsubstituted aryl group; $Ar_{29}$, $Ar_{30}$ and $Ar_{31}$ each, independently, represent an arylene group; and X, k, j and n are as in formula (I); and the two copolymers in the formula (X) may be random copolymers.

In addition, other than the above-mentioned polymer CTMs, the polymer CTMs for use in the CTL include polymers finally having a two-dimensional or three-dimensional crosslinking structure, which is a monomer or an oligomer having an electron-releasing group when the CTL is formed and hardened or crosslinked after the CTL is formed.

The CTL constituted of these polymers having an electron-releasing group or a crosslinking structure has a good abrasion resistance. Usually, in an electrophotographic process, charge potential (unexposed parts potential) is fixed, and when a surface of a photoreceptor is abraded due to repeated use, electric intensity increases in proportion to the abrasion. Accompanied with an increase of the electric intensity, occurrence of background fouling increases, and therefore, a photoreceptor having a high abrasion resistance has an advantage against background fouling. The CTL constituted of these polymers having an electron-releasing group is easily coated because the CTL itself is a polymer compound. In addition, the CTL has a good charge transportability because of having a higher-density charge transport portion than a CTL constituted of a polymer in which a low-molecular-weight compound is dispersed. Therefore, a high-speed response can be expected from a photoreceptor having a CTL using a polymer CTM.

Other polymers having an electron-releasing group include copolymers of known monomers, block polymers, graft polymers, star polymers and crosslinked polymers having an electron-releasing group disclosed in Japanese Laid-Open Patent Publications Nos. 3-109406, 2000-206723 and 2001-34001.

The CTL in the present invention may include additives such as plasticizers and leveling agents. Specific examples of the plasticizers include known plasticizers, which are used for plasticizing resins, such as dibutyl phthalate and dioctyl phthalate. The addition quantity of the plasticizer is 0 to 30% by weight of the binder resin. Specific examples of the leveling agents include silicone oils such as dimethyl silicone oil and methyl phenyl silicone oil; polymers or oligomers including a perfluoroalkyl group in their side chain; and the like. The addition quantity of the leveling agents is 0 to 1% by weight of the binder resin.

The multilayer photosensitive layer has been explained so far, and the photosensitive layer may be single-layered in the present invention. The single-layered photosensitive layer includes at least the above-mentioned CGM and binder resin used in the CGL and CTL. In addition, a CTM is preferably used at the same time in the single-layered photosensitive layer for high photosensitivity and charge transportability, and low residual potential. The CTM is selected from the positive-hole transport materials and electron transport materials according to the surface polarity of the resultant photoreceptor. Further, the above-mentioned charge transport polymer material is preferably used because of having both functions of the binder resin and CTM.

In the photoreceptor of the present invention, a protection layer is optionally formed overlying the photosensitive layer. Recently, personal computers are used on a daily basis, and printers are required to produce images at a higher speed and to be downsized. Therefore, the photoreceptor of the present invention having high sensitivity without producing abnormal images and improved durability with the protection layer can effectively be used.

Suitable materials for use in the protection layer include, but are not limited to, ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyarylate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, etc. Among these resins, polycarbonate resins or polyarylate resins are preferably used.

Other than these resins, the protection layer can include fluorocarbon resins such as polytetrafluoroethylene, silicone resins and materials constituted of these resins in which inorganic fillers such as titanium oxide, tin oxide, kalium titanate and silica or organic fillers are dispersed for the purpose of improving abrasion resistance thereof.

Specific examples of the organic fillers include, but are not limited to, powders of fluorocarbon resins such as polytetrafluoroethylene, silicone resin powders and a-carbon powders. Specific examples of the inorganic fillers include, but are not limited to, powders of metals such as copper, tin, aluminum and indium; metal oxides such as silica, tin oxide, zinc oxide, titanium oxide, indium oxide, antimony oxide, bismuth oxide, tin oxide doped with antimony, indium oxide doped with tin and potassium titanate. Among these fillers, inorganic fillers are preferably used in view of their hardness. In particular, silica, titanium oxide and alumina are preferably used.

Although concentration of the filler in the protection layer depends on the kind of filler and electrophotographic process conditions using the resultant photoreceptor, the protection layer preferably includes the filler in an amount of from 5 to 50% by weight, and more preferably from 10 to 30% by weight based on total weight of solid contents in the outermost surface of the protection layer.

In addition, the filler preferably has a volume-average particle diameter of from 0.1 to 2 μm, and more preferably from 0.3 to 1 μm. When the average particle diameter is too small, the protection layer does not have sufficient abrasion resistance. When too large, the protection layer has a poor surface smoothness and cannot be formed in some cases.

The average particle diameter of the filler in the present invention is a volume-average particle diameter thereof unless otherwise specified, and measured by an ultracentrifugal automatic particle-size-distribution measurer CAPA-700 from Horiba, Ltd. This is determined as a particle diameter which is equivalent to 50% of cumulative distribution (Median value) Further, it is important that a standard deviation of each particle measured at the same time is not greater than 1 μm. When the standard deviation is greater than 1 μm, the particle diameter distribution is so wide that the effect of the present invention is occasionally not exerted.

The pH of the filler largely affects the resolution of the resultant image and dispersibility of the filler. It is considered that one of the reasons is that hydrochloric acid and the like acid remains in the filler, particularly in the metal oxide. When the remaining amount of the acids is large, production of the resultant blurred images cannot be avoided, and dispersibility of the filler is occasionally influenced thereby depending on the remaining amount.

The other reason is a difference of chargeability of the filler, particularly the metal oxide. Usually, particles dispersed in a liquid are positively or negatively charged, and ions having the opposite charge gather to keep the particles neutral. Then, an electric double layer is formed to stabilize the dispersibility of the particles. As the layer leaves from the particles, the potential (zeta potential) gradually decreases and a potential of an electrically neutral area sufficiently a part from the particles becomes zero. Therefore, when an absolute value of the zeta potential increases, a force of repulsion of the particles increases and stability thereof increases. As the zeta potential closes to zero, the particles tend to agglutinate and become unstable. On the other hand, according to pH of the dispersion liquid, the zeta potential greatly fluctuates. The potential becomes zero at a certain pH and the dispersion liquid has an isoelectric point. Therefore, the particles are kept away from the isoelectric point as far as possible to stabilize the dispersion liquid.

In the present invention, the filler preferably has a pH at least not less than 5 at the isoelectric point to prevent the resultant blurred images, and the effect increases when the filler is more basic. Dispersibility and stability of the basic filler having a high pH improves when the dispersion liquid is acidic because the zeta potential further increases.

The pH values of the filler in the present invention are values from the zeta potential to isoelectric point, and the zeta potential is measured by a laser zeta electrometer from Otsuka Electronics Co., Ltd.

In order to prevent occurrence of blurred images, fillers having a relatively high specific resistance not less than $10^{10}$ Ω·cm are preferably used in the protection layer. In addition, fillers having a pH not less than 5 or a dielectric constant not less than 5 are preferably used. These fillers can be used alone or in combination. For example, a combination of two or more kinds of a filler having a pH not less than 5 and a filler having a pH not greater than 5; or a combination of two or more kinds of a filler having a dielectric constant not less than 5 and a filler having a dielectric constant not greater than 5 can be used. Among these fillers, α-form alumina, which has a hexagonal close-packed structure, is preferably used to improve abrasion resistance of the resultant protection layer and to prevent the blurred image problem, because the alumina has high insulation property, heat stability and good abrasion resistance.

The resistivity of the filler for use in the present invention is determined as follows. Because a powder like the filler has a different resistivity according to the filling factor, the resistivity has to be measured under fixed conditions. In the present invention, a measurer having an equivalent structure to a measurer disclosed in each FIG. 1 of Japanese Laid-Open Patent Publications Nos. 5-94049 and 5-113688 is used to measure the resistivity of the filler. The measurer has an electrode area of 4.0 $cm^2$. An amount of a sample is controlled such that a distance between the electrodes is 4 mm by applying a load of 4 kg to one of the electrodes for 1 min before measurement. The measurement is performed on loaded status of the upper electrode having a weight of 1 kg with an applied voltage of 100 V. A scope not less than $10^6$ Ω·cm is measured by HIGH RESISTANCE METER from Yokogawa Hewlett Packard Ltd. and a scope less than that is measured by Digital Multimeter from Fluke Corp.

The dielectric constant of the filler is measured as follows. A cell which is similar to that used in the measurement of resistivity is used, and capacitance is measured after a load is applied thereto to measure the dielectric constant. The capacitance is measure by a dielectric loss measurer from Ando Electric Co., Ltd.

Further, the fillers are preferably treated with at least one surface treating agent to improve the dispersibility thereof. Deterioration of dispersibility of a filler included in the protection layer causes not only increase of residual potential but also decrease of transparency of the protection layer, generation of coating deficiencies and deterioration of abrasion resistance. Therefore, a photoreceptor having good durability and capable of producing good images cannot be provided. Suitable surface treating agents include known surface treating agents, but surface treating agents which can maintain the insulating properties of the filler in the protection layer are preferably used. Specific examples of such surface treating agents include, but are not limited to, titanate coupling agents, aluminum coupling agents, zircoaluminate coupling agents, higher fatty acids, and combinations of these agents with silane coupling agents; and $Al_2O_3$, $TiO_2$, $ZrO_2$, silicones, aluminum stearate, and their mixtures. These are preferably used because of being capable of imparting good dispersibility to fillers and preventing blurred images. When silane coupling agents are used, the blurred image problem tends to occur. However, when used in combination with the surface treating agents mentioned above, there is a case in which the problem can be avoided. The content of a surface treating agent in a coated filler, which depends on the primary particle diameter of the filler, is from 3 to 30% by weight, and more preferably from 5 to 20% by weight. When the content is too low, good dispersibility cannot be obtained. To the contrary, when the content is too high, residual potential seriously increases. These fillers can be used alone or in combination. An amount of the surface treatment of the filler is determined by a weight ratio of the surface treating agents to an amount of the filler.

The filler materials can be dispersed by a proper disperser. In addition, it is preferable that the filler is dispersed to primary particles and has less agglutinated bodies in respect of transmittance of the protection layer.

The protection layer may include a CTM to decrease residual potential and to improve the response of the resultant photoreceptor. The CTMs mentioned above for use in the CTL can be used. When a low-molecular-weight CTM is used in the protection layer, the concentration gradient of the low-molecular-weight CTM may be formed therein. In this case, it is preferable that the concentration of the CTM at the surface of the protection layer is lower than that at the bottom thereof to improve the abrasion resistance of the resultant photoreceptor. The concentration is a weight ratio of the low-molecular-weight CTM to a total weight of all the materials included in the protection layer. The concentration gradient means such a gradient as lowers the concentration of the CTM at the surface of protection layer. In addition, using a charge transport polymer material is quite advantageous to increase durability of the resultant photoreceptor.

The protection layer is formed by a conventional coating method. The protection layer preferably has a thickness of from 0.1 to 10 μm. In addition, a protection layer formed by a vacuum thin film forming method using known materials such as a-C and a-SiC can be used.

Further, as another embodiment of the protection layer, a crosslinked protection layer having a charge transport structure is effectively used. The crosslinked protection layer having a charge transport structure can inhibit the increase of the electric field intensity due to repeated use. The damage resistance thereof is high and the resultant photoreceptor has good durability, and is hard to have filming and reduces the production of defective images. Further, the crosslinked protection layer has higher homogeneity than the filler-dispersed protection layer. This means the crosslinked protection layer is uniformly abraded and the resultant photoreceptor has uniform electrostatic properties.

The crosslinked protection layer having a charge transport structure has a crosslinked three-dimensional network structure having high crosslink density, wherein a radical polymerizing monomer having tri- or more functional groups is hardened. Therefore the crosslinked protection layer has high hardness and elasticity, high uniformity and smoothness, and high abrasion and scratch resistance. It is important to increase the crosslink density, i.e., the number of crosslinked bonds per unit volume of the surface of a photoreceptor. However, the crosslinked protection layer has an inner stress due to volume contraction because a number of crosslinked bonds are instantly formed when hardened. Since the inner stress increases as the crosslinked protection layer has higher thickness, the crosslinked protection layer tends to crack and peel-off when hardened. Even though crack and peel-off do not initially appear, they occasionally appear as time passes while charging, developing, transferring and cleaning processes are repeated in the electrophotographic image forming process.

In order to solve this problem, (1) a polymer material is included in the crosslinked protection layer, (2) a number of monofunctional and bifunctional radical polymerizing monomers are used, and (3) a multifunctional monomer having a flexible group is used, to soften the hardening resin layer, but any of which reduces the crosslink density, resulting in less abrasion resistance of the resultant photoreceptor. However, the crosslinked protection layer of the present invention, having three-dimensional network structure with high crosslink density and a thickness of from 1 to 10 μm, is free from crack and peel-off and has high abrasion resistance. The crosslinked protection layer more preferably has a thickness of from 2 to 8 μm.

The reason why the photoreceptor of the present invention is free from crack and peel-off is partly because the inner stress does not become large since the crosslinked protection layer is thin, and partly because the inner stress can be reduced since a CTL is formed thereunder. Therefore, a number of polymer materials need not be included in the crosslinked protection layer, and an incompatible hardened product from a reaction between the polymer material and the radical polymerizing constituents such as a radical polymerizing monomer and a radical polymerizing compound having a charge transport structure do not often cause scratches and toner films.

Further, when a CTL is hardened with light, the light transmittance is prevented because the charge transport structure absorbs light, resulting in occasional insufficient progress of the hardening reaction. In the crosslinked protection layer of the present invention, having a thickness not greater than 10 μm, the hardening reaction uniformly progresses therein. Therefore, even the interior thereof has high abrasion resistance as well as the surface thereof. In addition, the crosslinked protection layer of the present invention further includes a monofunctional radical polymerizing compound having a charge transport structure in addition to the radical polymerizing monomer having tri- or more functional groups, and which is taken in the crosslinked bond when the radical polymerizing monomer having tri- or more functional groups is hardened.

When a low-molecular-weight CTM is included in a crosslinked protection layer, the low-molecular-weight CTM separates out or becomes clouded due to its low compatibility, and the mechanical strength thereof deteriorates as well. When a charge transport compound having bi- or more functional groups is used as a main component, plural bondings are fixed in the crosslinked structure and the crosslink density becomes higher, the charge transport structure is so bulky that the hardening resin structure has a large distortion, resulting in higher inner stress in the crosslinked protection layer.

Further, the photoreceptor of the present invention has good electrical properties. This is because the crosslinked protection layer having a charge transport structure includes a monofunctional radical polymerizing compound having a charge transport structure, which is fixed between the crosslinked bond in the shape of a pendant. As mentioned above, the CTM having no functional group separates out and becomes clouded, and noticeably deteriorates electrical properties in repeated use, such as deterioration of the sensitivity and increase of the residual potential. When a charge transport compound having two or more functional groups is used as a main component, plural bondings are fixed in the crosslinked structure and an intermediate structure (a cation radical) when transporting a charge cannot stably be maintained, resulting in deterioration of the sensitivity due to a trapped charge and increase of the residual potential. The deterioration of these electrical properties causes deterioration of the resultant image density and thinning of letter images. Further, the underlying CTL of the photoreceptor of the present invention is designable to have less charge trap and can minimize electrical adverse effects of the crosslinked protection layer.

Further, the crosslinked protection layer of the present invention is preferably insoluble in an organic solvent. The crosslinked protection layer is formed by hardening a radical polymerizing monomer having no charge transport structure and tri- or more functional groups and a monofunctional radical polymerizing compound having a charge transport structure, and has three-dimensional network structure with high crosslink density. However, other contents besides these, i.e., additives such as a monofunctional or bifunctional monomer, a polymer binder, an antioxidant, a leveling agent and a plasticizer, and contaminants from the underlying CTL; and hardening conditions, locally thin the crosslink density or form a microscopic aggregate of hardened materials densely crosslinked. Such hardened materials are not tightly bonded with each other and soluble in an organic solvent, and the crosslinked protection layer is locally abraded and the microscopic hardened materials are easily removable. However, the crosslinked protection layer of the present invention, insoluble in an organic solvent, wherein in addition to the three-dimensional network structure with high crosslink density, a chain reaction is progressed to polymerize the hardened materials, has significantly high abrasion resistance.

The constituents of the coating liquid for forming the crosslinked protective layer having a charge transport structure are explained below.

The tri- or more functional monomers having no charge transport structure mean monomers which have three or more radical polymerizable groups and which do not have a charge transport structure (such as a positive hole transport structure (e.g., triarylamine, hydrazone, pyrazoline and carbazole structures); and an electron transport structure (e.g., condensed polycyclic quinine structure, diphenoquinone structure, a cyano group and a nitro group)). As the radical polymerizable groups, any radical polymerizable groups having a carbon-carbon double bond can be used. Suitable radical polymerizable groups include 1-substituted ethylene groups having the below-mentioned formula (A) and 1,1-substituted ethylene groups having the below-mentioned formula (B).

1-Substituted Ethylene Groups $$CH2=CH—X^1— \quad (A)$$

wherein $X^1$ represents an arylene group (such as a phenylene group and a naphthylene group), which optionally has a substituent, a substituted or unsubstituted alkenylene group, a —CO— group, a —COO— group, a —CON($R^{10}$) group (wherein $R^{10}$ represents a hydrogen atom, an alkyl group (e.g., a methyl group, and an ethyl group), an aralkyl group (e.g., a benzyl group, a naphthylmethyl group and a phenetyl group) or an aryl group (e.g., a phenyl group and a naphthyl group)), or a —S— group.

Specific examples of the groups having formula (X) include, but are not limited to, a vinyl group, a styryl group, 2-methyl-1,3-butadienyl group, a vinylcarbonyl group, acryloyloxy group, acryloylamide, vinyl thioether, etc.

1,1-Substituted Ethylene Groups $$CH_2{=}C(Y){-}(X^2)n- \quad (B)$$

wherein Y represents a substituted or unsubstituted alkyl group, a substituted or unsubstituted aralkyl group, a substituted or unsubstituted aryl group (such as phenyl and naphthyl groups), a halogen atom, a cyano group, a nitro group, an alkoxyl group (such as methoxy and ethoxy groups), or a —$COOR^{11}$ group (wherein $R^{11}$ represents a hydrogen atom, a substituted or unsubstituted alkyl group (such as methyl and ethyl groups), a substituted or unsubstituted aralkyl group (such as benzyl and phenethyl groups), a substituted or unsubstituted aryl group (such as phenyl and naphthyl groups) or a —$CONR^{12}R^{13}$ group (wherein each of $R^{12}$ and $R^{13}$ represents a hydrogen atom, a substituted or unsubstituted alkyl group (such as methyl and ethyl groups), a substituted or unsubstituted aralkyl group (such as benzyl, naphthylmethyl and phenethyl groups), a substituted or unsubstituted aryl group (such as phenyl and naphthyl groups))); $X^2$ represents a group selected from the groups mentioned above for use in $X^1$ and an alkylene group, wherein at least one of Y and $X^2$ is an oxycarbonyl group, a cyano group, an alkenylene group or an aromatic group; and n is 0 or 1.

Specific examples of the groups having formula (11) include, but are not limited to, an α-chloroacryloyloxy group, a methacryloyloxy group, an α-cyanoethylene group, an α-cyanoacryloyloxy group, an α-cyanophenylene group, a methacryloylamino group, etc.

Specific examples of the substituents for use in the groups $X^1$, $X^2$ and Y include, but are not limited to, halogen atoms, a nitro group, a cyano group, alkyl groups (such as methyl and ethyl groups), alkoxy groups (such as methoxy and ethoxy groups) aryloxy groups (such as a phenoxy group), aryl groups (such as phenyl and naphthyl groups), aralkyl groups (such as benzyl and phenethyl groups), etc.

Among these radical polymerizable tri- or more functional groups, acryloyloxy groups and tri- or more functional methacryloyloxy groups are preferably used. Compounds having three or more acryloyloxy groups can be prepared by subjecting (meth)acrylic acid (salts), (meth)acrylhalides and (meth) acrylates, which have three or more hydroxyl groups, to an ester reaction or an ester exchange reaction. The three or more radical polymerizable groups included in a radical polymerizable tri- or more functional monomer are the same as or different from the others therein.

Specific examples of the radical polymerizable tri- or more functional monomers include trimethylolpropane triacrylate (TMPTA), trimethylolpropane trimethacrylate, trimethylolpropane alkylene-modified triacrylate, trimethylolpropane ethyleneoxy-modified triacrylate, trimethylolpropane propyleneoxy-modified triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified triacrylate, glycerol ethyleneoxy-modified triacrylate, glycerol propyleneoxy-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkylated dipentaerythritol tetraacrylate, alkylated dipentaerythritol triacrylate, dimethylolpropane tetraacrylate (DTMPTA), pentaerythritol ethoxytriacrylate, ethyleneoxy-modified triacryl phosphate, 2,2,5,5-tetrahydroxymethylcyclopentanone tetraacrylate, etc. These monomers are used alone or in combination.

In order to form a dense crosslinked network in the crosslinked protective layer, the ratio (Mw/F) of the molecular weight (Mw) of the tri- or more functional monomer to the number of functional groups (F) included in a molecule of the monomer is preferably not greater than 250. When the number is too large, the resultant protective layer becomes soft and thereby the abrasion resistance of the layer slightly deteriorates. In this case, it is not preferable to use only one monomer having a functional group having a long chain group such as ethylene oxide, propylene oxide and caprolactone. The content of the unit obtained from the tri- or more functional monomers in the crosslinked protective layer is preferably from 20 to 80% by weight, and more preferably from 30 to 70% by weight based on the total weight of the protective layer. When the content is too low, the three dimensional crosslinking density is low, and thereby good abrasion resistance cannot be imparted to the protective layer. In contrast, when the content is too high, the content of the charge transport compound decreases, good charge transport property cannot be imparted to the protective layer. In order to balance the abrasion resistance and charge transport property of the crosslinked protective layer, the content of the unit obtained from the tri- or more functional monomers in the protective layer is preferably from 30 to 70% by weight.

The monofunctional radical polymerizing compound having a charge transport structure for use in the crosslinked protection layer of the present invention is a compound which has a positive hole transport structure such as triarylamine, hydrazone, pyrazoline and carbazole or an electron transport structure such as condensed polycyclic quinone, diphenoquinone, a cyano group and an electron attractive aromatic ring having a nitro group, and has a radical polymerizing functional group. Specific examples of the radical polymerizing functional group include the above-mentioned radical polymerizing monomers, and particularly the acryloyloxy groups and methacryloyloxy groups are effectively used. In addition, a triarylamine structure is particularly preferred as the charge transport structure. Further, when a compound having the following formula (1) or (2), electrical properties such as sensitivity and residual potential are preferably maintained.

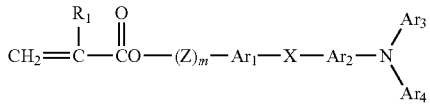

(1)

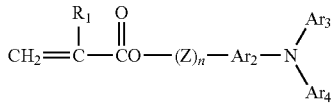

(2)

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$ wherein $R_8$ and $R_9$ each, independently, represent a hydrogen atom, a halogen atom, a substituted or an unsubstituted alkyl group, a substituted or an unsubstituted aralkyl group and a substituted or an unsubstituted aryl group; $Ar_1$ and $Ar_2$ each, independently, represent a substituted or an unsubstituted arylene group; $Ar_3$ and $Ar_4$ each, independently, represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom and vinylene group; Z represents a substituted or an unsubstituted alkylene group, a substituted or an unsubstituted alkyleneether group and alkyleneoxycarbonyl group; and m and n represent 0 and an integer of from 1 to 3.

In the formulae (1) and (2), among substituted groups of $R_1$, the alkyl groups include, but are not limited to, methyl groups, ethyl groups, propyl groups, butyl groups, etc.; the aryl groups include, but are not limited to, phenyl groups, naphtyl groups, etc.; aralkyl groups include, but are not limited to, benzyl groups, phenethyl groups, naphthylmethyl groups, etc.; and alkoxy groups include, but are not limited to, methoxy groups, ethoxy groups, propoxy groups, etc.

These may be substituted by alkyl groups such as halogen atoms, nitro groups, cyano groups, methyl groups and ethyl groups; alkoxy groups such as methoxy groups and ethoxy groups; aryloxy groups such as phenoxy groups; aryl groups such as phenyl groups and naphthyl groups; aralkyl groups such as benzyl groups and phenethyl groups.

The substituted group of $R_1$ is preferably a hydrogen atom or a methyl group.

$Ar_3$ and $Ar_4$ each, independently, represent a substituted or an unsubstituted aryl group, and specific examples thereof include condensed polycyclic hydrocarbon groups, non-condensed cyclic hydrocarbon groups and heterocyclic groups.

The condensed polycyclic hydrocarbon group is preferably a group having 18 or less carbon atoms forming a ring such as a fentanyl group, a indenyl group, a naphthyl group, an azulenyl group, a heptalenyl group, a biphenylenyl group, an As-indacenyl group, a fluorenyl group, an acenaphthylenyl group, a praadenyl group, an acenaphthenyl group, a phenalenyl group, a phenantolyl group, an anthryl group, a fluoranthenyl group, an acephenantolylenyl group, an aceanthrylenyl group, a triphenylel group, a pyrenyl group, a chrysenyl group and a naphthacenyl group.

Specific examples of the non-condensed cyclic hydrocarbon groups and heterocyclic groups include, but are not limited to, monovalent groups of monocyclic hydrocarbon compounds such as benzene, diphenylether, polyethylenediphenylether, diphenylthioether, and diphenylsulfone; monovalent groups of non-condensed hydrocarbon compounds such as biphenyl, polyphenyl, diphenylalkane, diphenylalkene, diphenylalkine, triphenylmethane, distyrylbenzene, 1,1-diphenylcycloalkane, polyphenylalkane and polyphenylalkene; and monovalent groups of ring gathering hydrocarbon compounds such as 9,9-diphenylfluorene.

Specific examples of the heterocyclic groups include, but are not limited to, monovalent groups such as carbazole, dibenzofuran, dibenzothiophene and oxadiazole.

Specific examples of the substituted or unsubstituted aryl group represented by $Ar_3$ and $Ar_4$ include, but are not limited to, the following groups:

(1) a halogen atom, a cyano group and a nitro group;

(2) a straight or a branched-chain alkyl group having 1 to 12, preferably from 1 to 8, and more preferably from 1 to 4 carbon atoms, and these alkyl groups may further include a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkyl groups include, but are not limited to, methyl groups, ethyl groups, n-butyl groups, i-propyl groups, t-butyl groups, s-butyl groups, n-propyl groups, trifluoromethyl groups, 2-hydroxyethyl groups, 2-ethoxyethyl groups, 2-cyanoethyl groups, 2-methocyethyl groups, benzyl groups, 4-chlorobenzyl groups, 4-methylbenzyl groups, 4-phenylbenzyl groups, etc.

(3) alkoxy groups (—$OR_2$) wherein $R_2$ represents an alkyl group specified in (2). Specific examples thereof include, but are not limited to, methoxy groups, ethoxy groups, n-propoxy groups, I-propoxy groups, t-butoxy groups, s-butoxy groups, I-butoxy groups, 2-hydroxyethoxy groups, benzyloxy groups, trifluoromethoxy groups, etc.

(4) aryloxy groups, and specific examples of the aryl groups include, but are not limited to, phenyl groups and naphthyl groups. These aryl group may include an alkoxy group having 1 to 4 carbon atoms, an alkyl group having 1 to 4 carbon atoms or a halogen atom as a substituent. Specific examples of the aryloxy groups include, but are not limited to, phenoxy groups, 1-naphthyloxy groups, 2-naphthyloxy groups, 4-methoxyphenoxy groups, 4-methylphenoxy groups, etc.

(5) alkyl mercapto groups or aryl mercapto groups such as methylthio groups, ethylthio groups, phenylthio groups and p-methylphenylthio groups.

(6)

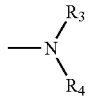

wherein $R_3$ and $R_4$ each, independently, represent a hydrogen atom, an alkyl groups specified in (2) and an aryl group, and specific examples of the aryl groups include, but are not limited to, phenyl groups, biphenyl groups and naphthyl groups, and these may include an alkoxy group having 1 to 4 carbon atoms, an alkyl group having 1 to 4 carbon atoms or a halogen atom as a substituent, and $R_3$ and $R_4$ may form a ring together. Specific examples of the groups having this formula include, but are not limited to, amino groups, diethylamino groups, N-methyl-N-phenylamino groups, N,N-diphenylamino groups, N—N-di(tolyl)amino groups, dibenzylamino groups, piperidino groups, morpholino groups, pyrrolidino groups, etc.

(7) a methylenedioxy group, an alkylenedioxy group such as a methylenedithio group or an alkylenedithio group.

(8) a substituted or an unsubstituted styryl group, a substituted or an unsubstituted β-phenylstyryl group, a diphenylaminophenyl group, a ditolylaminophenyl group, etc.

The arylene groups represented by $Ar_1$ and $Ar_2$ are derivative divalent groups from the aryl groups represented by $Ar_3$ and $Ar_4$.

The above-mentioned X represents a single bond, a substituted or an unsubstituted alkylene group, a substituted or an unsubstituted cycloalkylene group, a substituted or an unsubstituted alkyleneether group, an oxygen atom, a sulfur atom and vinylene group.

The substituted or unsubstituted alkylene group is a straight or a branched-chain alkylene group having 1 to 12, preferably from 1 to 8, and more preferably from 1 to 4 carbon atoms, and these alkylene groups may further includes a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkylene groups include, but are not limited to, methylene groups, ethylene groups, n-butylene groups, i-propylene groups, t-butylene groups, s-butylene groups, n-propylene groups, trifluoromethylene groups, 2-hydroxyethylene groups, 2-ethoxyethylene groups, 2-cyanoethylene groups, 2-methocyethylene groups, benzylidene groups, phenylethylene groups, 4-chlorophenylethylene groups, 4-methylphenylethylene groups, 4-biphenylethylene groups, etc.

The substituted or unsubstituted cycloalkylene group is a cyclic alkylene group having 5 to 7 carbon atoms, and these alkylene groups may include a fluorine atom, a hydroxyl group, a cyano group, an alkoxy group having 1 to 4 carbon atoms. Specific examples thereof include, but are not limited to, cyclohexylidine groups, cyclohexylene groups and 3,3-dimethylcyclohexylidine groups, etc.

Specific examples of the substituted or unsubstituted alkylene ether groups include, but are not limited to ethyleneoxy, propyleneoxy, ethylene glycol, propylene glycol, diethylene glycol, tetraethylene glycol and tripropylene glycol, and the alkylene group of the alkyleneether group may include a substituent such as a hydroxyl group, a methyl group and an ethyl group.

The vinylene group has the following formula:

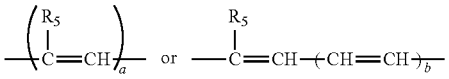

wherein $R_5$ represents a hydrogen atom, an alkyl group (same as those specified in (2)), an aryl group (same as those represented by $Ar_3$ and $Ar_4$); a represents 1 or 2; and b represents 1, 2 or 3.

Z represents a substituted or an unsubstituted alkylene group, a divalent substituted or an unsubstituted alkyleneether group and alkyleneoxycarbonyl group.

Specific examples of the substituted or unsubstituted alkylene group include, but are not limited to, those of X.

Specific examples of the divalent substituted or unsubstituted alkyleneether group include, but are not limited to, those of X.

Specific examples of the divalent alkyleneoxycarbonyl group include, but are not limited to, a divalent caprolactone-modified group.

In addition, the monofunctional radical polymerizing compound having a charge transport structure of the present invention is more preferably a compound having the following formula (3):

wherein o, p and q each, independently, represent 0 or 1; Ra represents a hydrogen atom or a methyl group; Rb and Rc each, independently, represents a substituent besides a hydrogen atom and an alkyl group having 1 to 6 carbon atoms, and may be different from each other when having plural carbon atoms; s and t each, independently, represent 0 or an integer of from 1 to 3; Za represents a single bond, a methylene group, ethylene group,

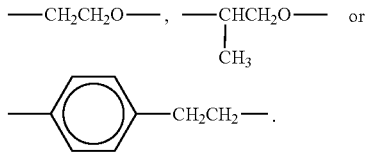

The compound having formula (3) is preferably a compound having a methyl group or an ethyl group as a substituent of Rb and Rc.

The monofunctional radical polymerizing compound having a charge transport structure of the formulae (1), (2) and particularly (3) for use in the present invention does not become an end structure because a double bonding between the carbons is polymerized while opened to the both sides, and is built in a chain polymer. In a crosslinked polymer polymerized with a tri- or more radical polymerizing monomer, the compound is present in a main chain and in a crosslinked chain between the main chains (the crosslinked chain includes an intermolecular crosslinked chain between a polymer and another polymer and an intramolecular crosslinked chain wherein a portion having a folded main chain and another portion originally from the monomer, which is polymerized with a position apart therefrom in the main chain are polymerized). Even when the compound is present in a main chain or a crosslinked chain, a triarylamine structure suspending from the chain has at least three aryl groups radially located from a nitrogen atom, is not directly bonded with the chain and suspends through a carbonyl group or the like, and is sterically and flexibly fixed although bulky. The triarylamine structures can spatially be located so as to be moderately adjacent to one another in a polymer, and has less structural distortion in a molecule. Therefore, it is supposed that the monofunctional radical polymerizing compound having a charge transport structure in a surface layer of an electrophotographic photoreceptor can have an intramolecular structure wherein blocking of a charge transport route is comparatively prevented.

Specific examples of the monofunctional radical polymerizing compound having a charge transport structure include compounds having the following formulae, but the compounds are not limited thereto.

(3)

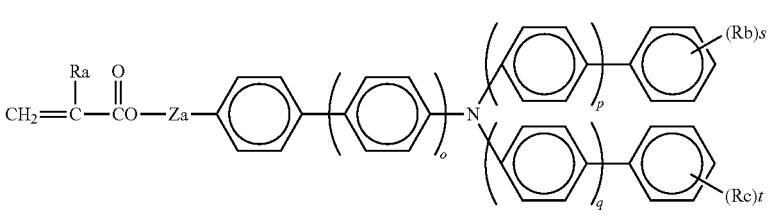

No. 1
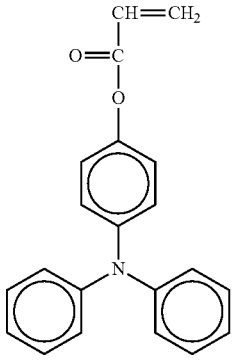
No. 2
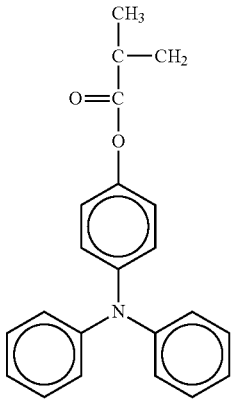
No. 3
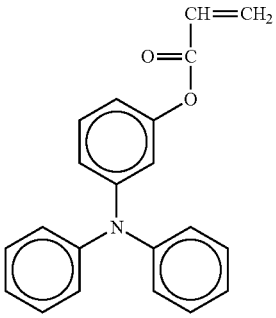
No. 4
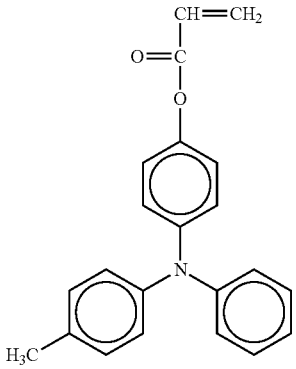
-continued
No. 5
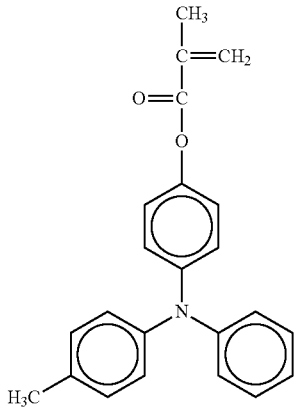
No. 6
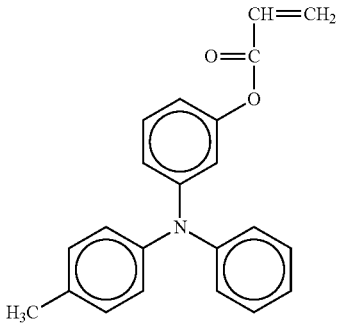
No. 7
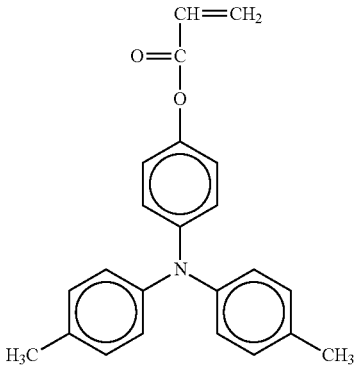
No. 8
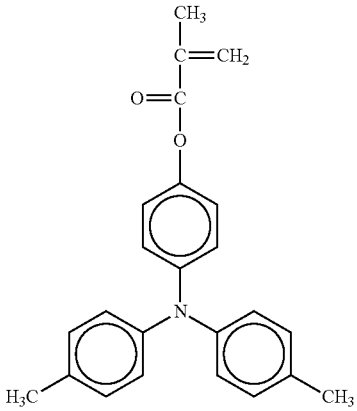

-continued
No. 9
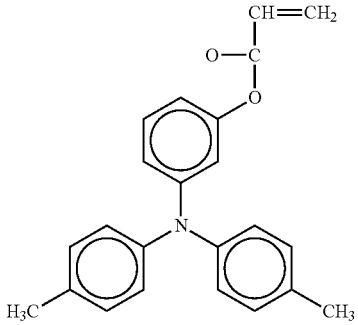
No. 10
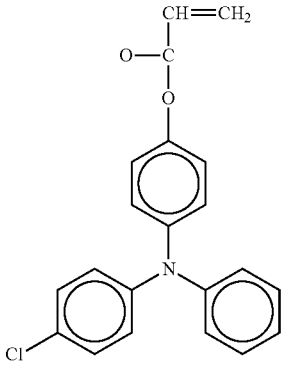
No. 11
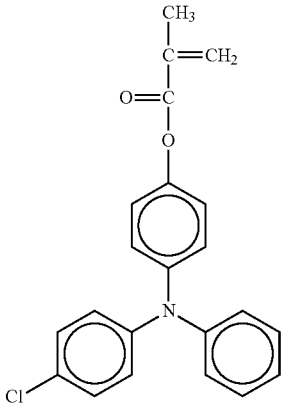
No. 12
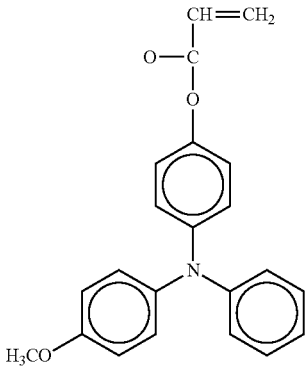
-continued
No. 13
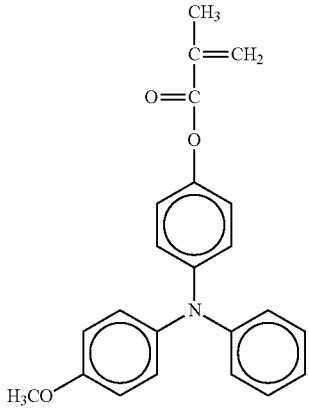
No. 14
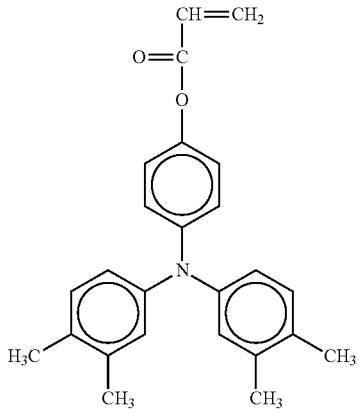
No. 15
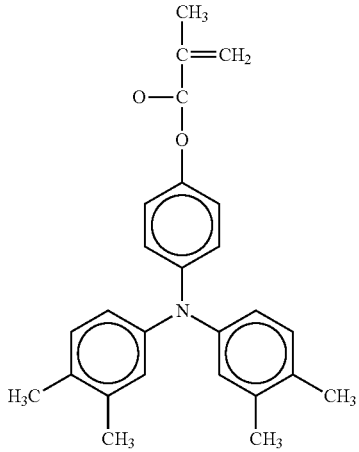

No. 16
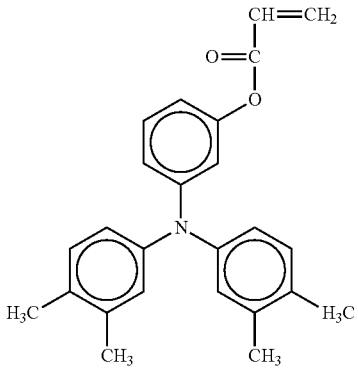
No. 17
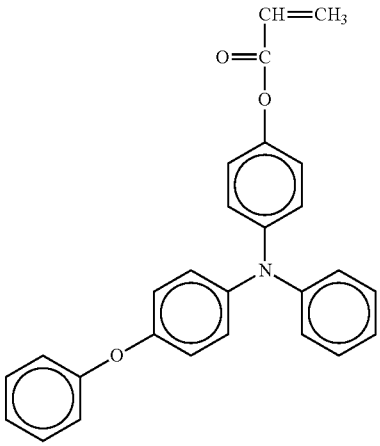
No. 18
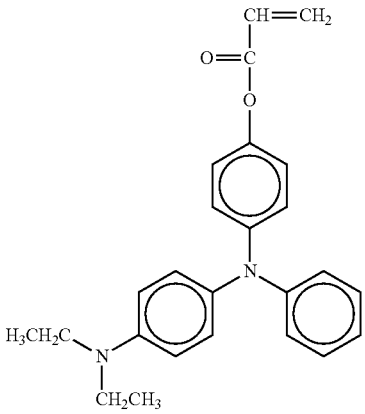
No. 19
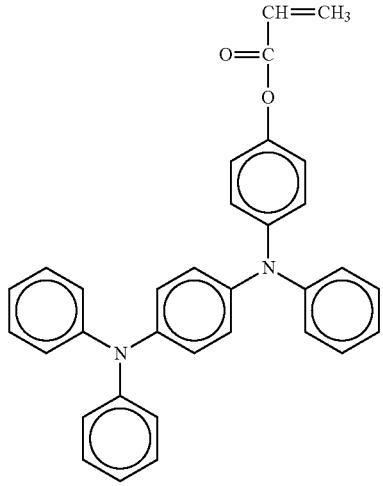
No. 20
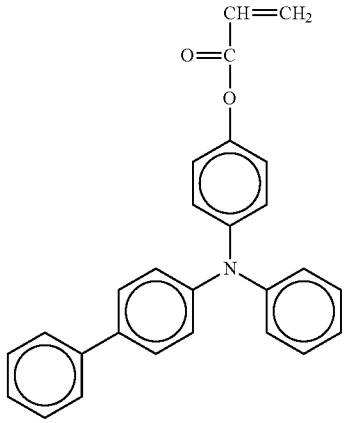
No. 21
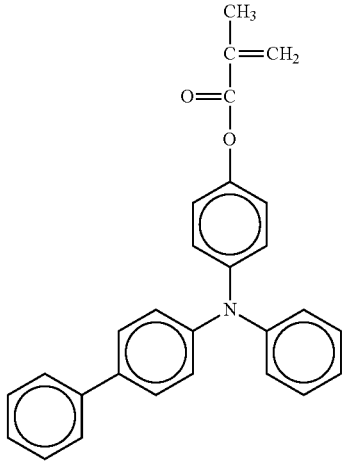

No. 22
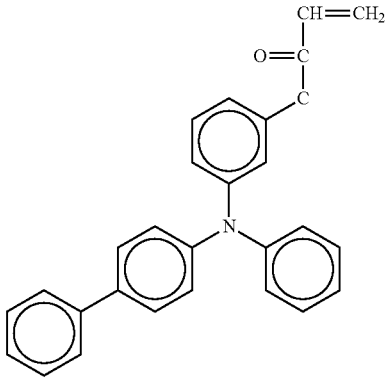
No. 23
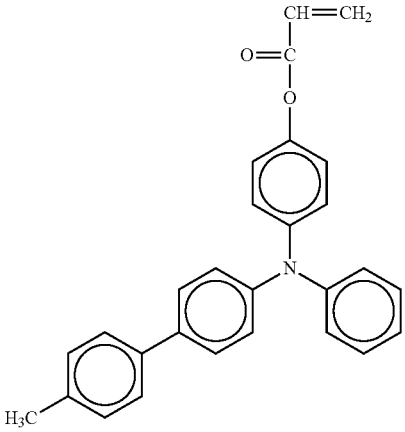
No. 24
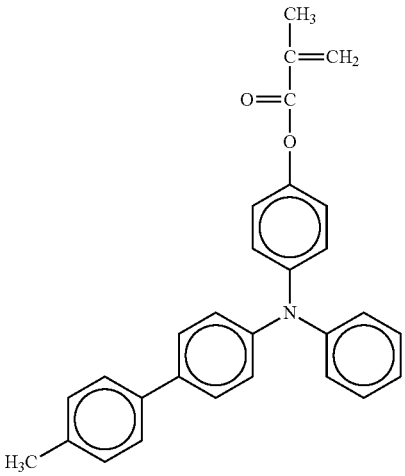
No. 25
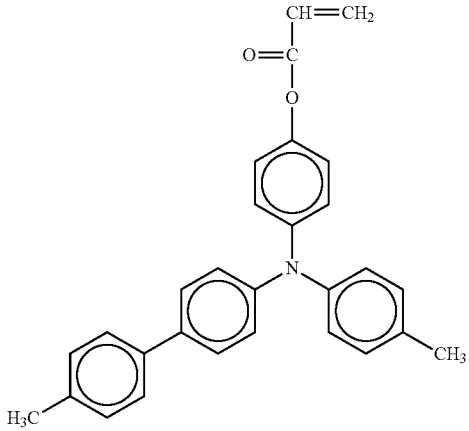
No. 26
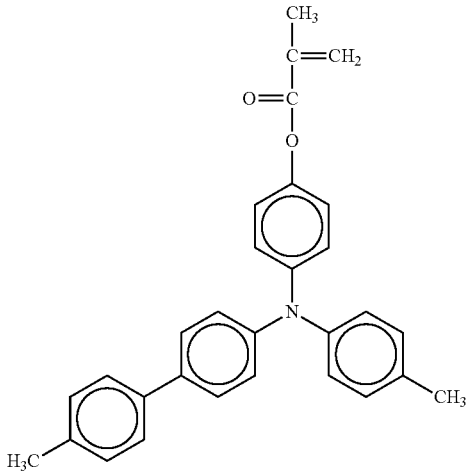
No. 27
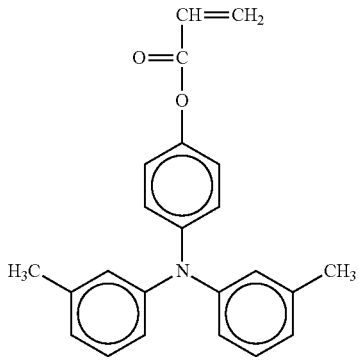

No. 28
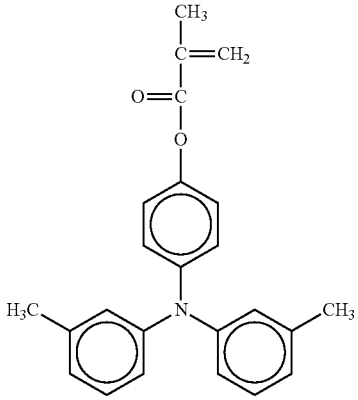
No. 29
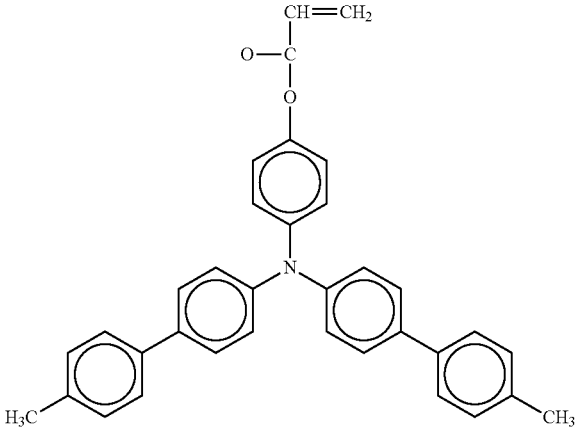
No. 30
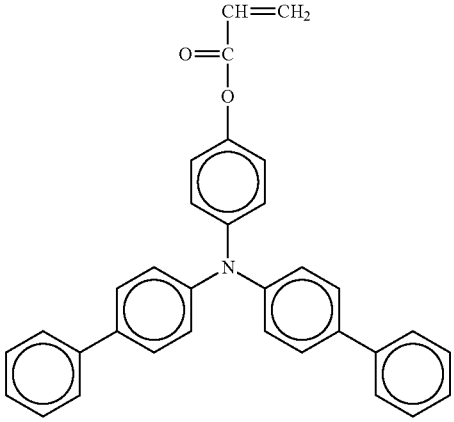
No. 31
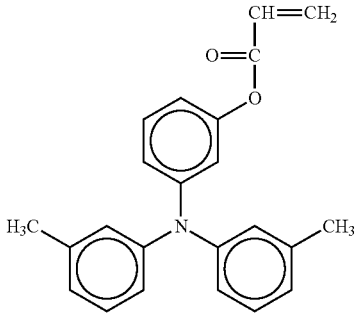
No. 32
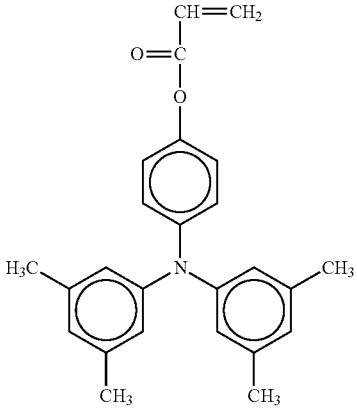
No. 33
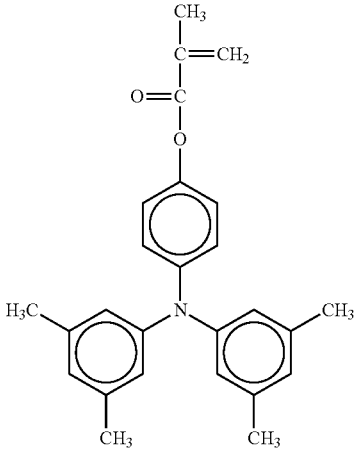
No. 34
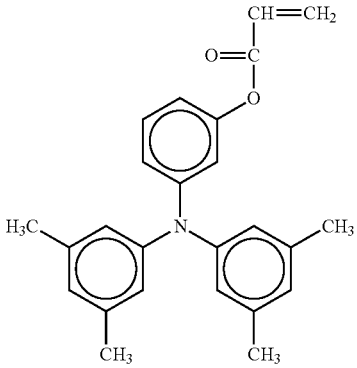

No. 35
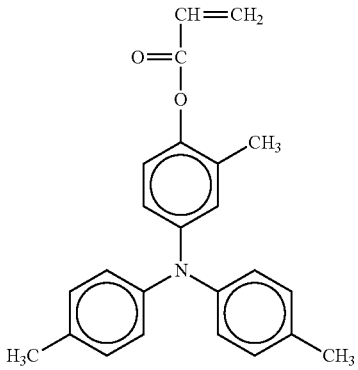
No. 36
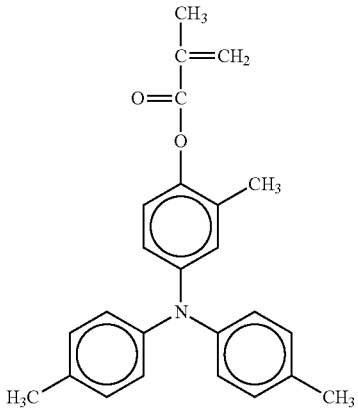
No. 37
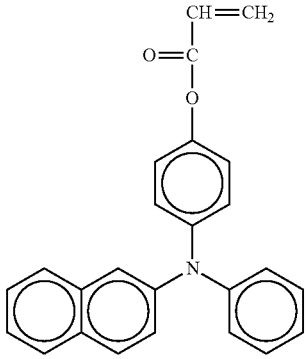
No. 38
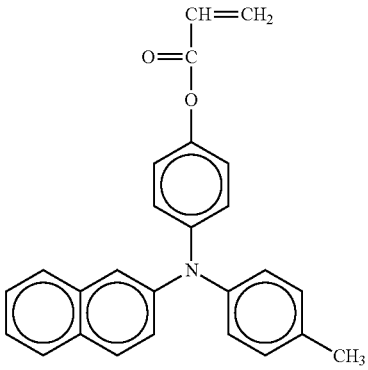
No. 39
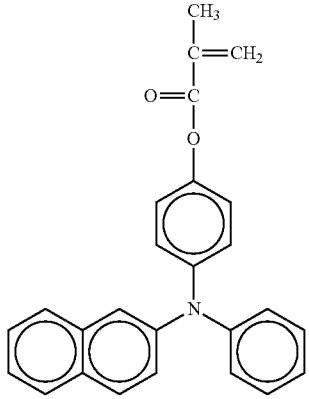
No. 40
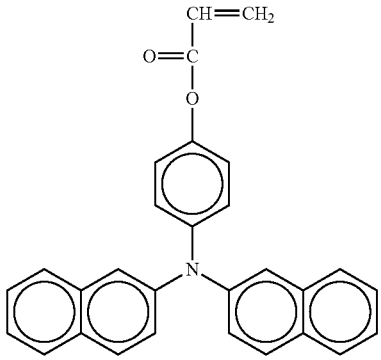
No. 41
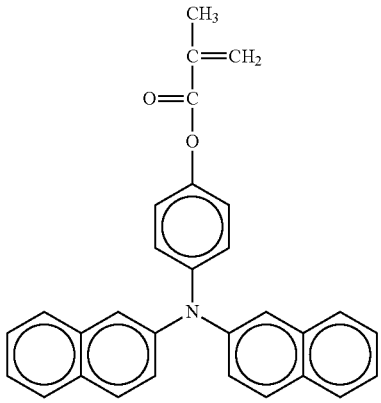

No. 42
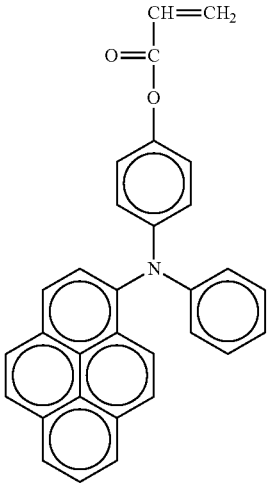
No. 43
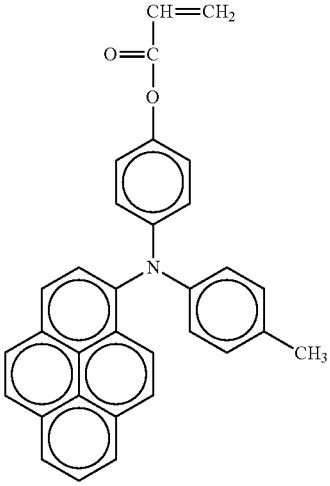
No. 44
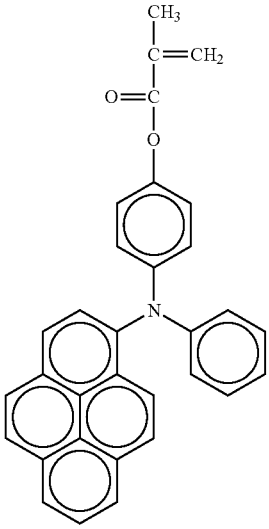
No. 45
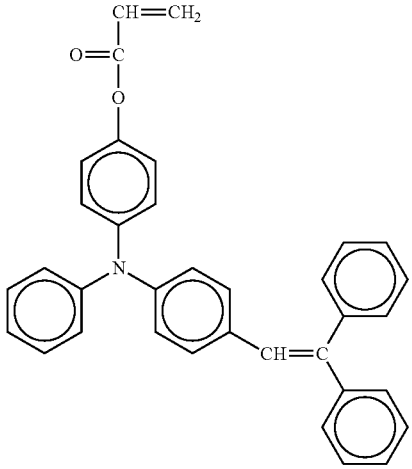
No. 46
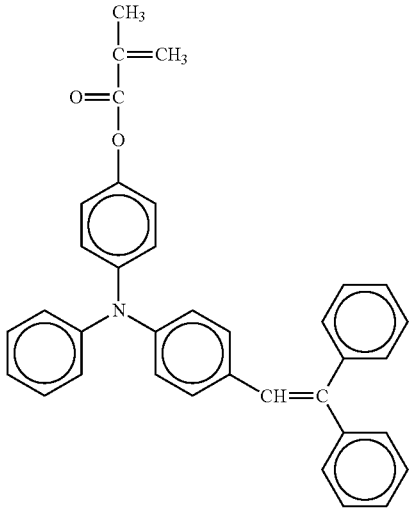
No. 47
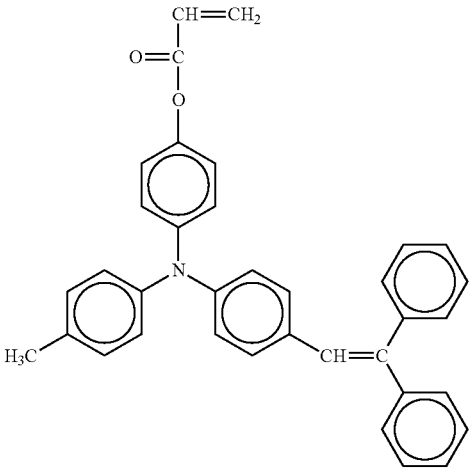

-continued
No. 48
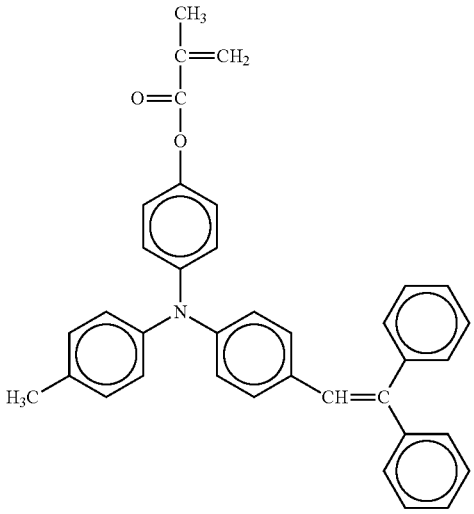
No. 49
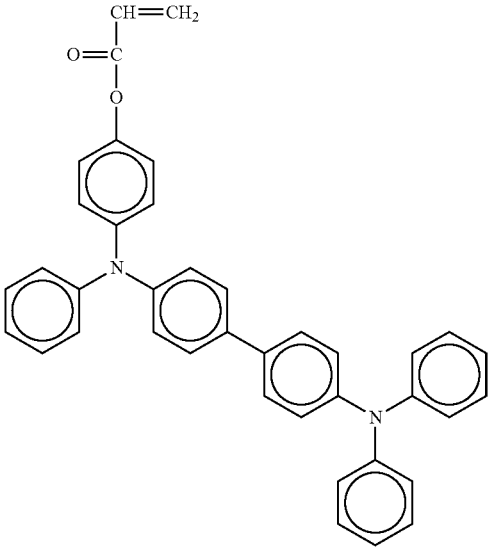
No. 50
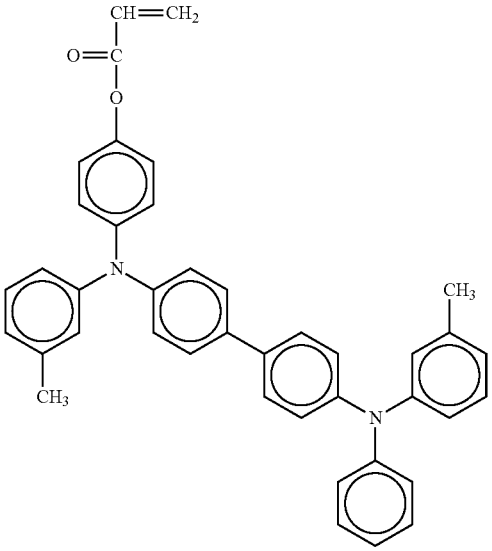
-continued
No. 51
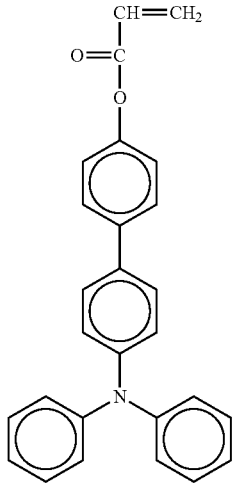
No. 52
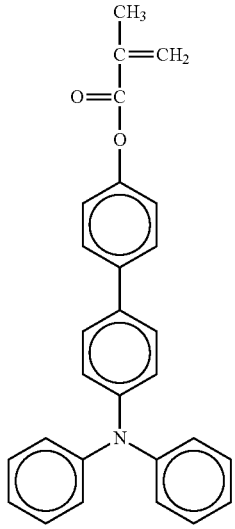
No. 53
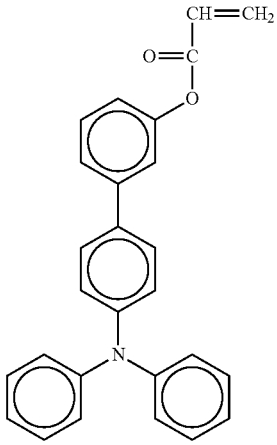

No. 54
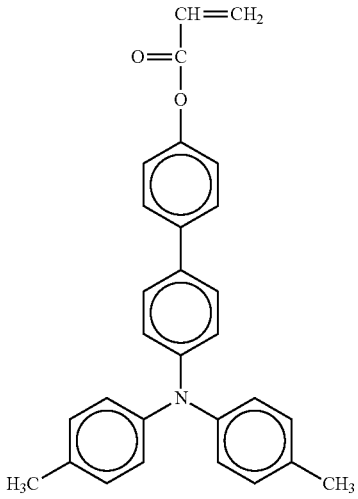
No. 55
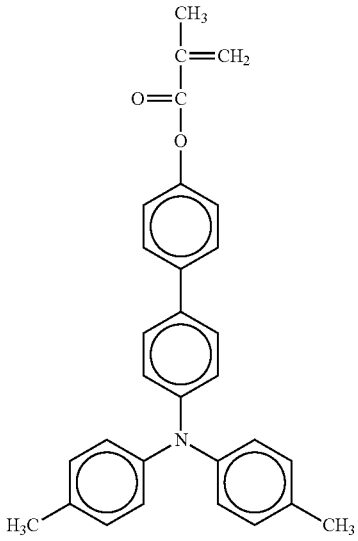
No. 56
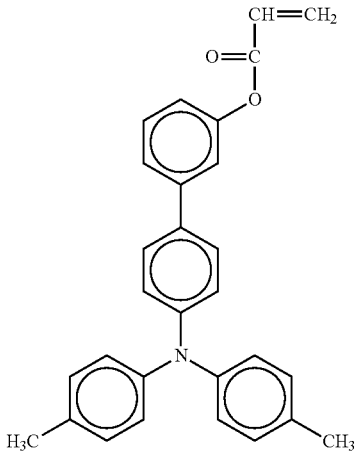
No. 57
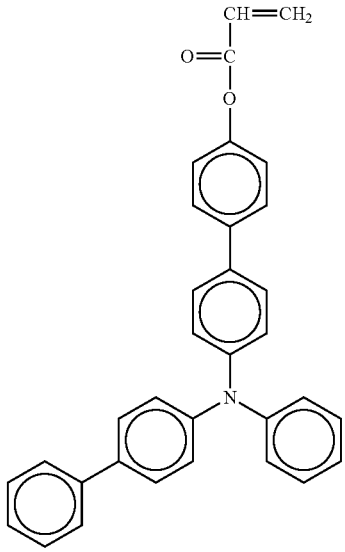
No. 58
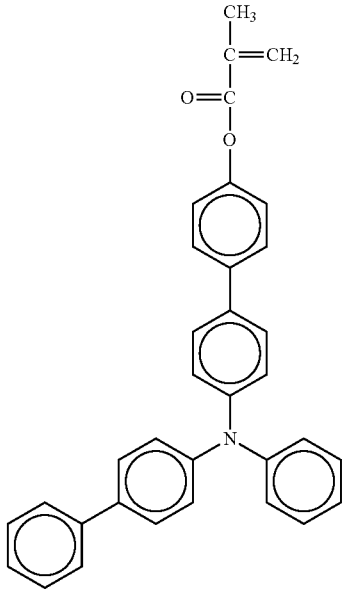

-continued
No. 59
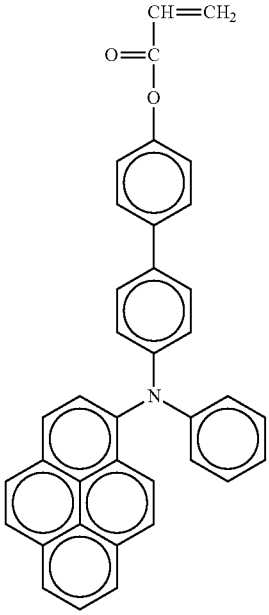
No. 60
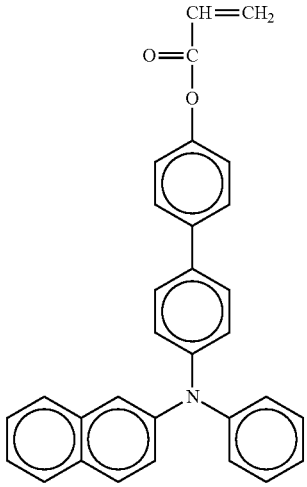
No. 61
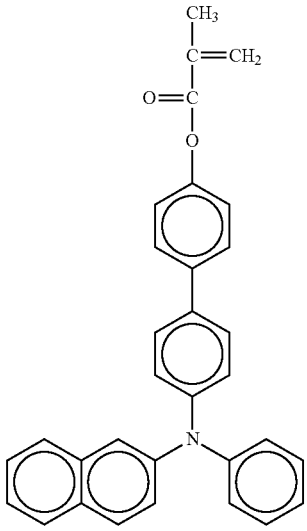
-continued
No. 62
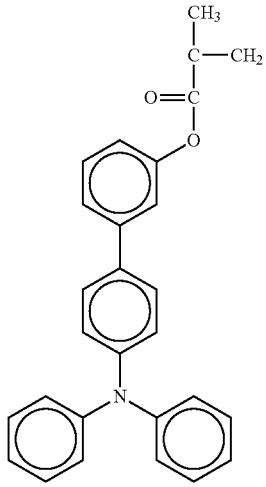
No. 63
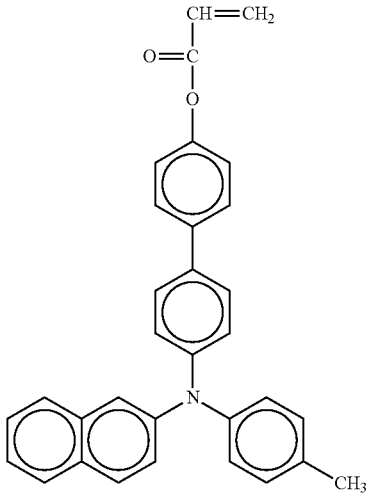
No. 64
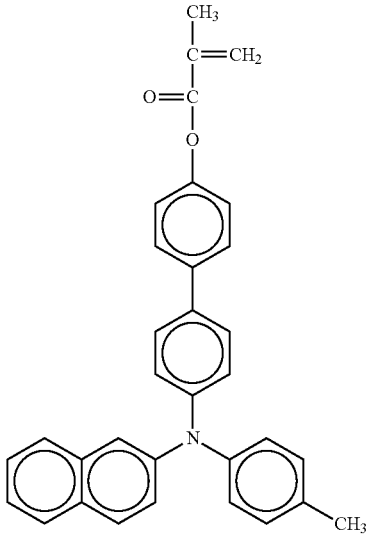

-continued
No. 65
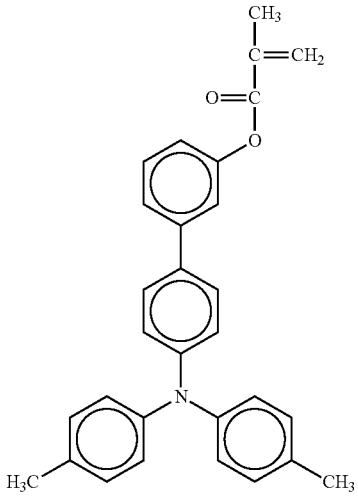
No. 66
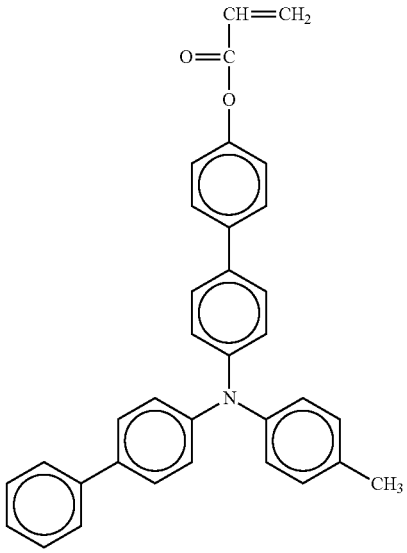
No. 67
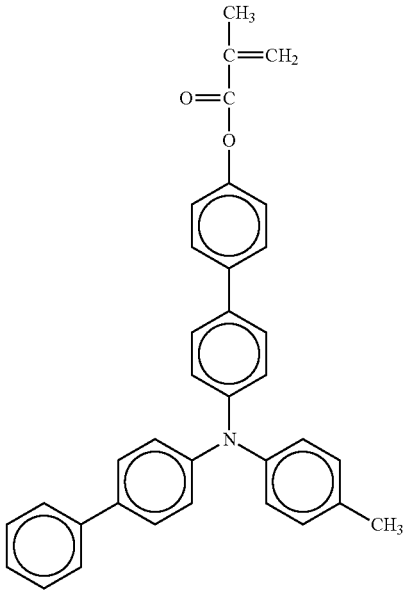
-continued
No. 68
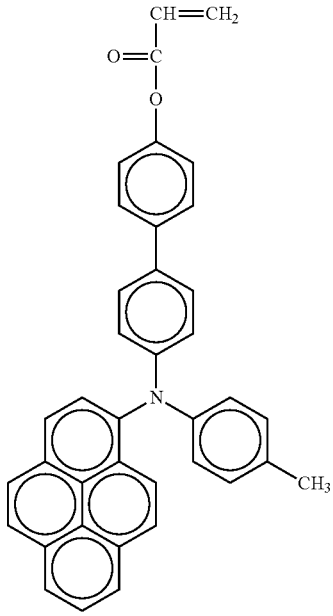
No. 69
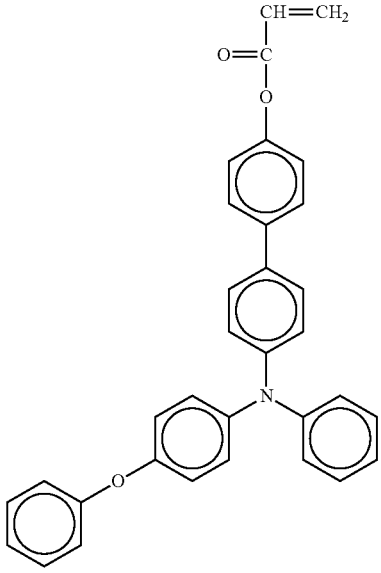

-continued
No. 70
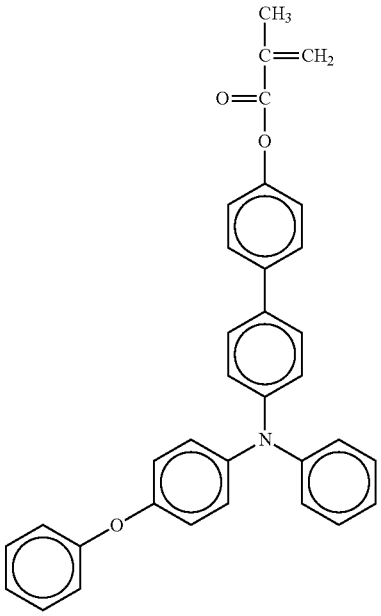
No. 71
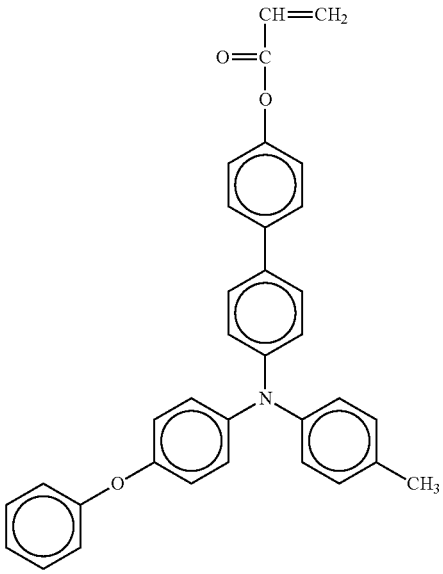
-continued
No. 72
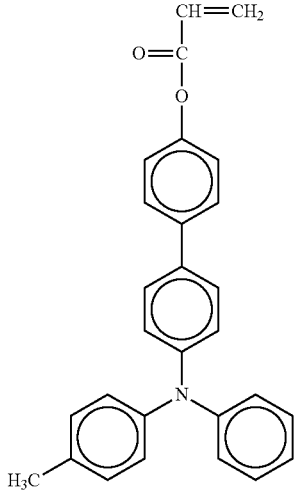
No. 73
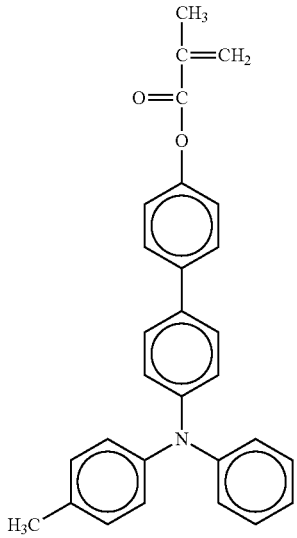
No. 74
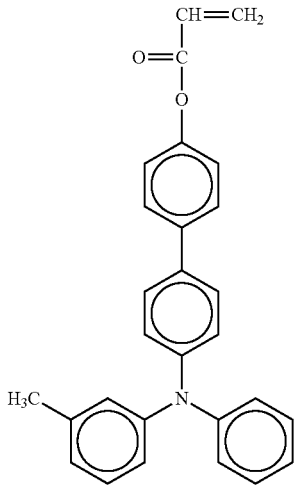

No. 75
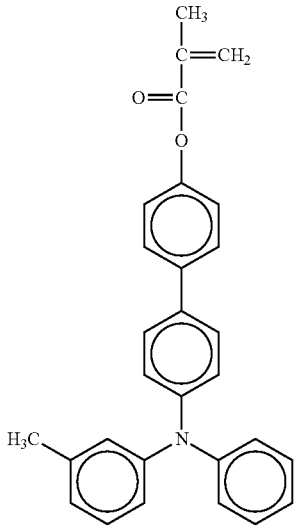
No. 76
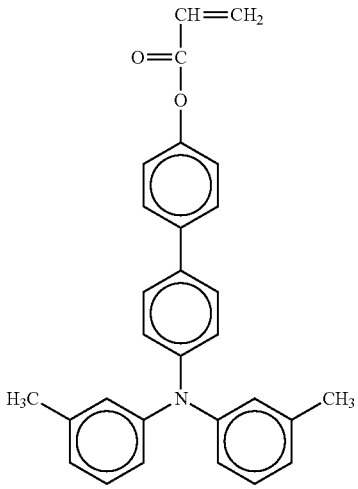
No. 77
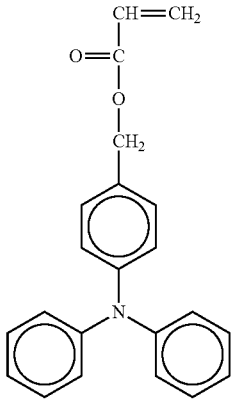
No. 78
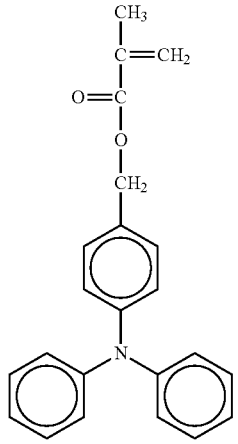
No. 79
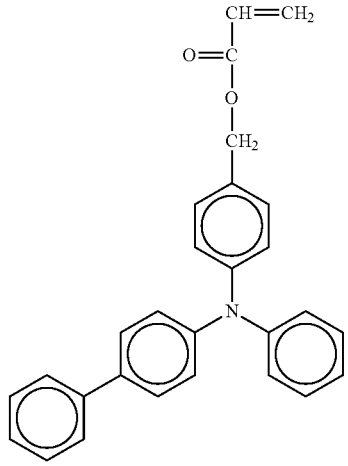
No. 80
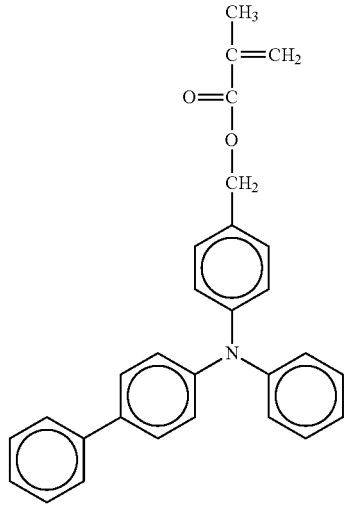

No. 81
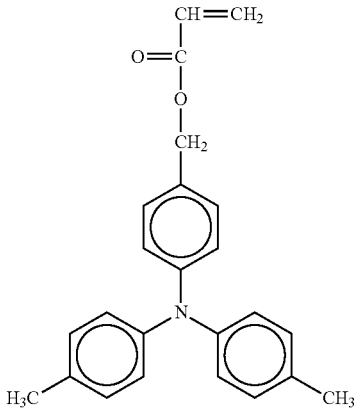
No. 82
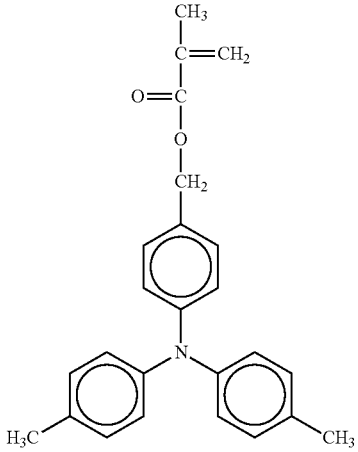
No. 83
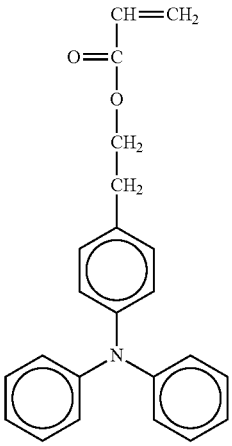
No. 84
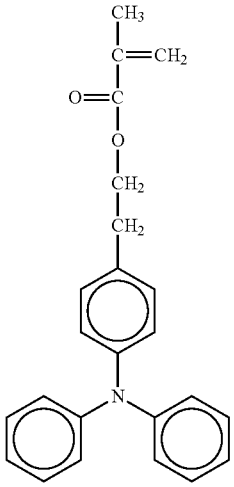
No. 85
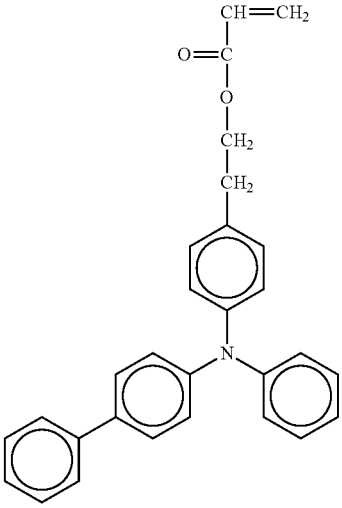
No. 86
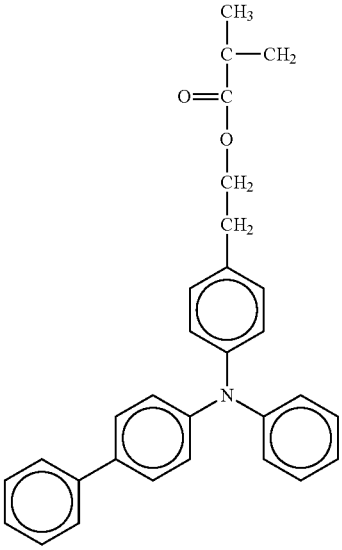

No. 87
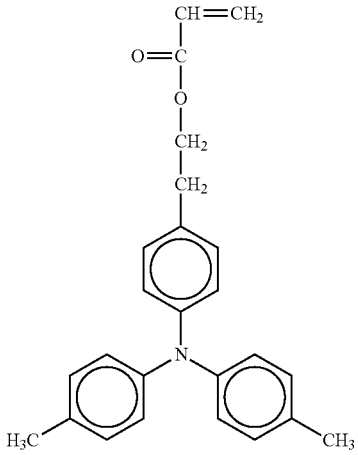
No. 88
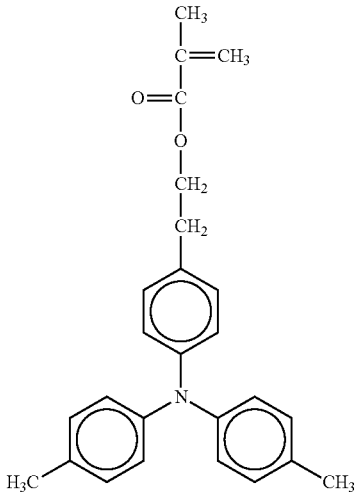
No. 89
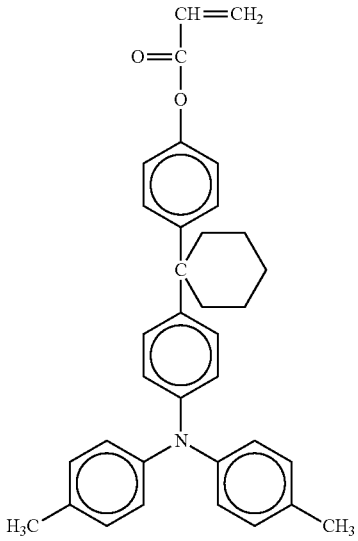
No. 90
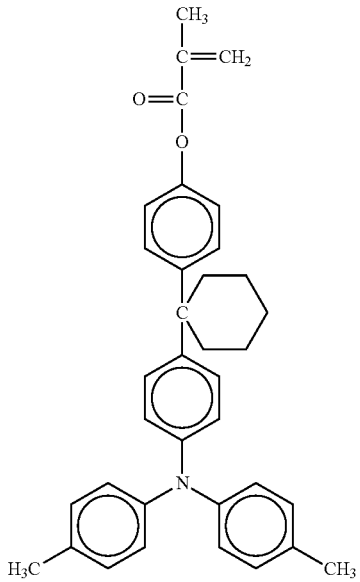
No. 91
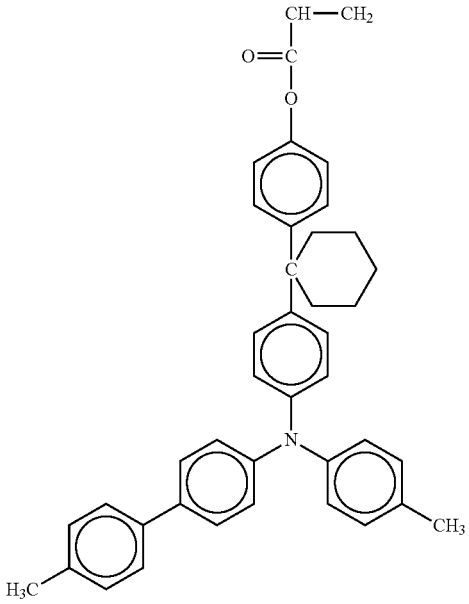

No. 92
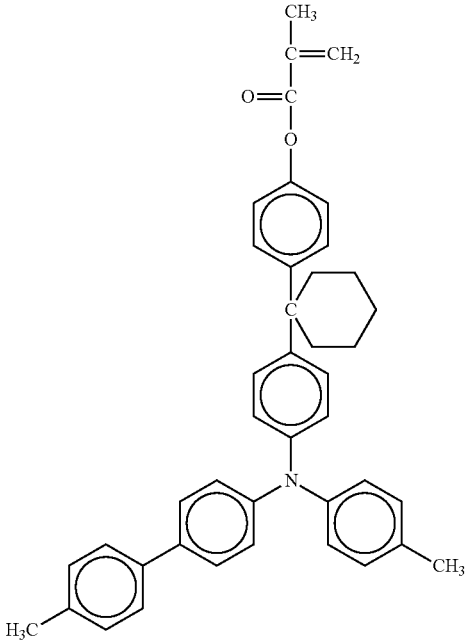
No. 93
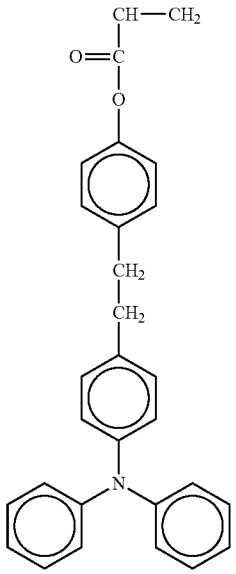
No. 94
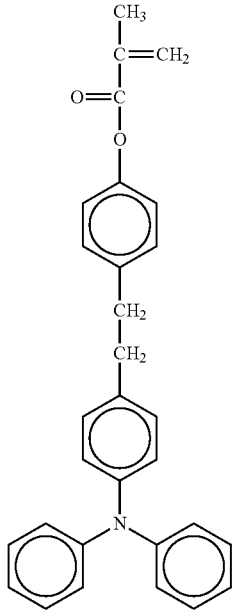
No. 95
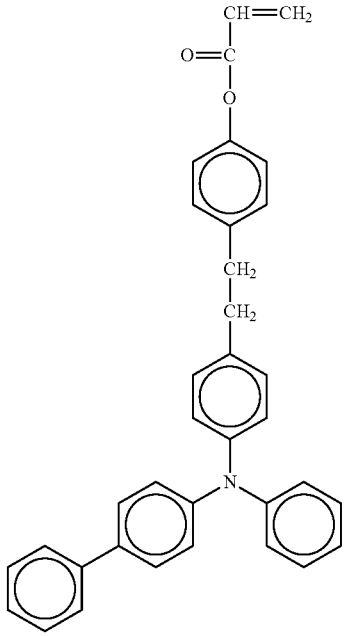

No. 96
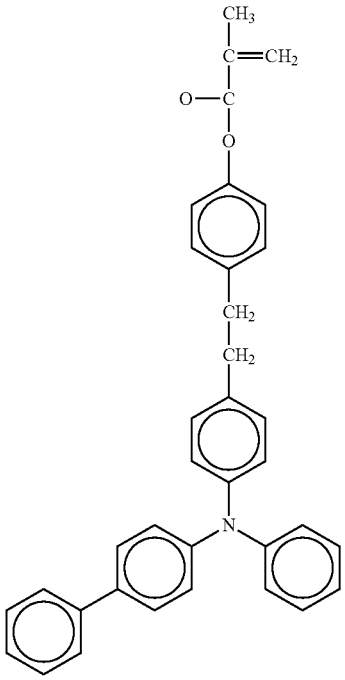
No. 97
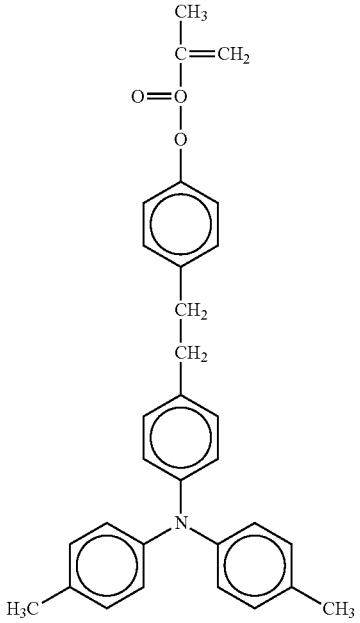
No. 98
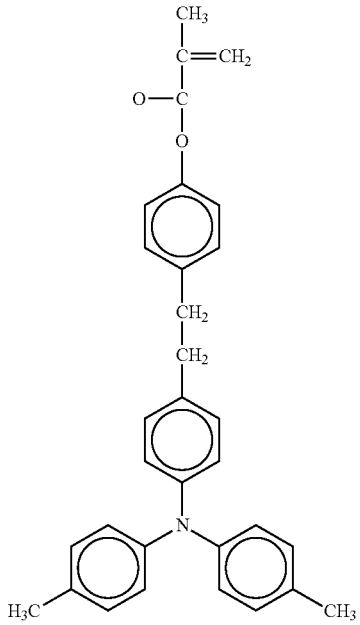
No. 99
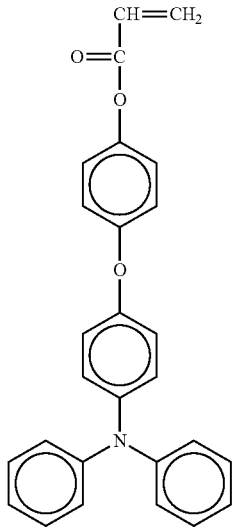

No. 100
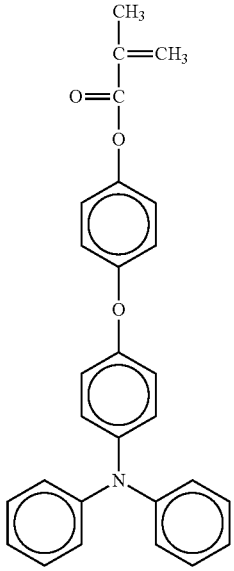
No. 101
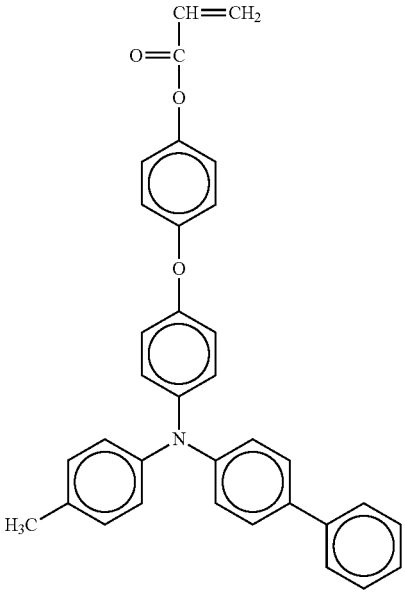
No. 102
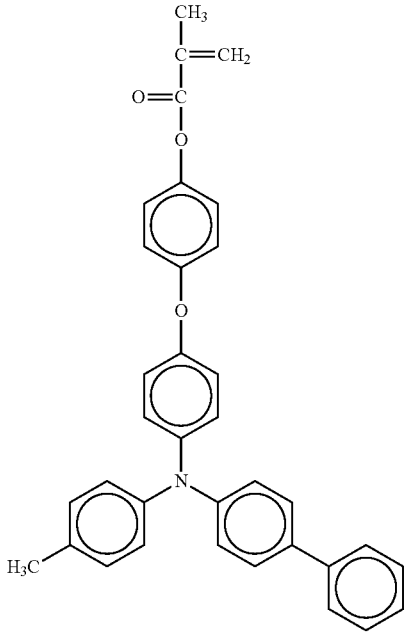
No. 103
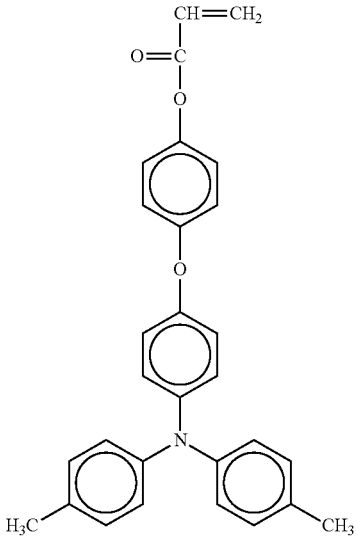

No. 104
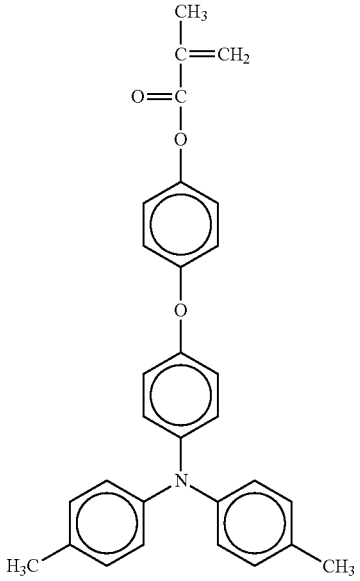
No. 105
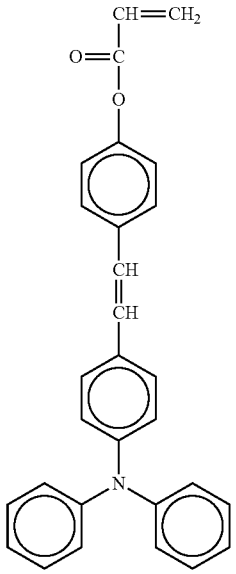
No. 106
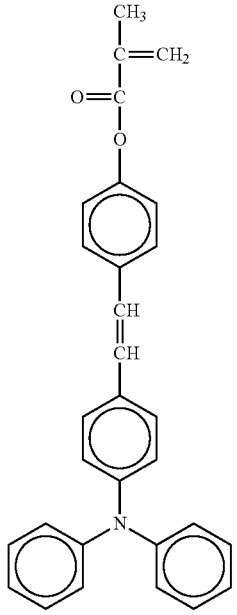
No. 107
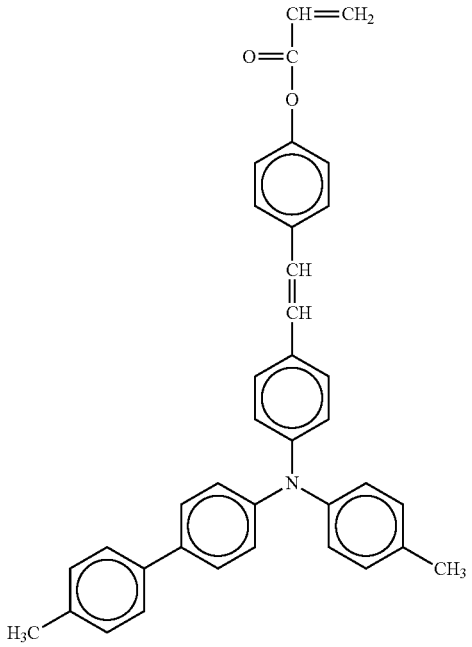

-continued
No. 108
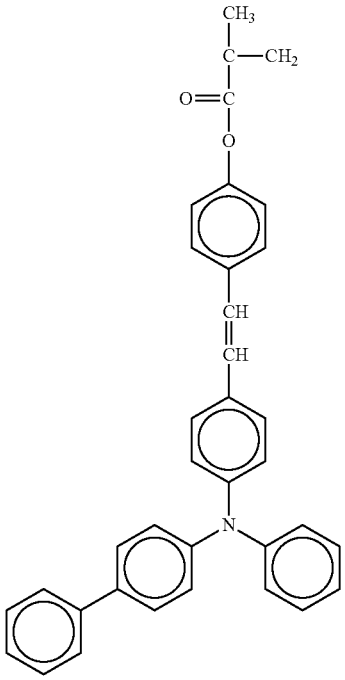
No. 109
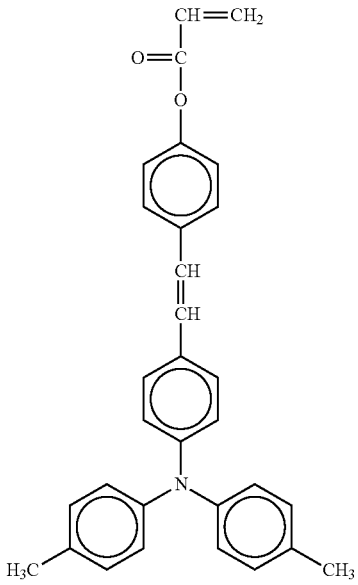
-continued
No. 110
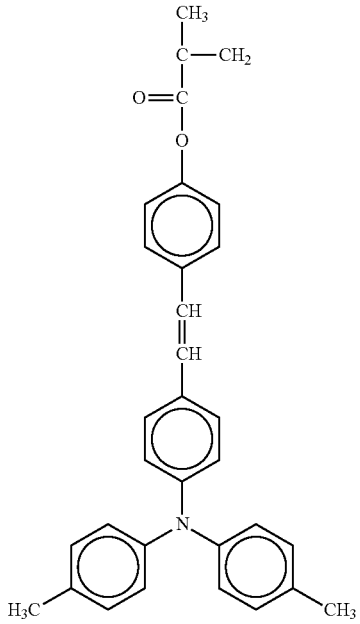
No. 111
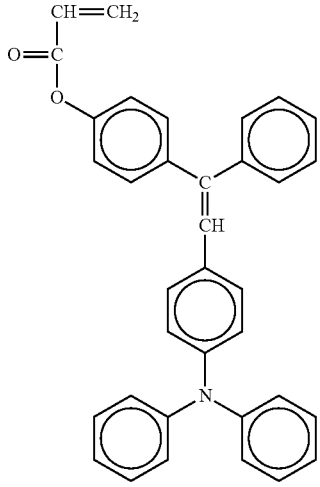
No. 112
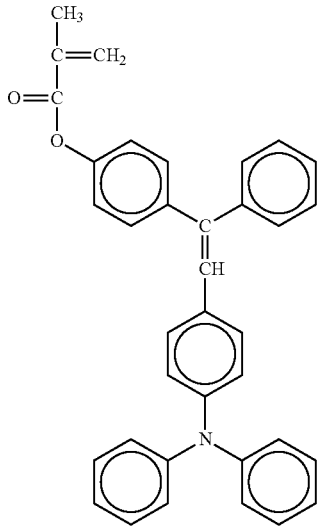

No. 113
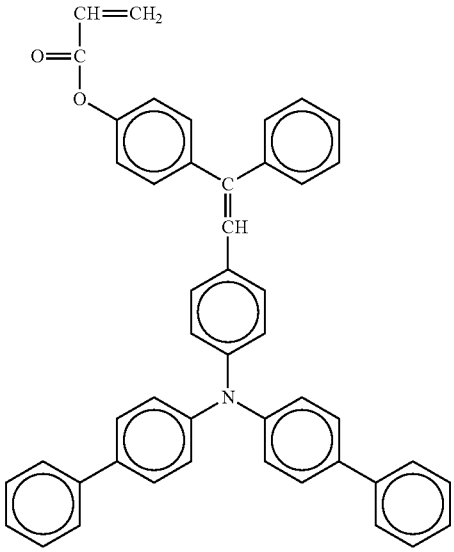
No. 114
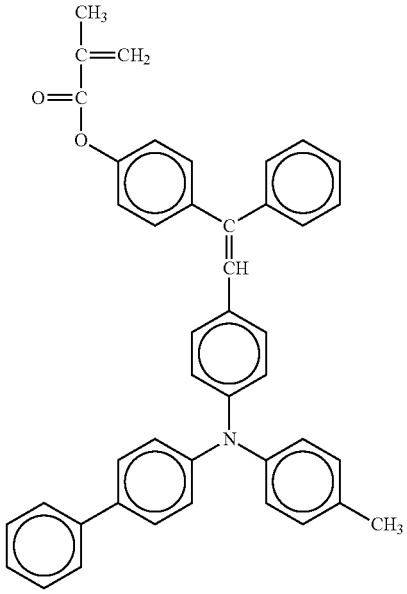
No. 115
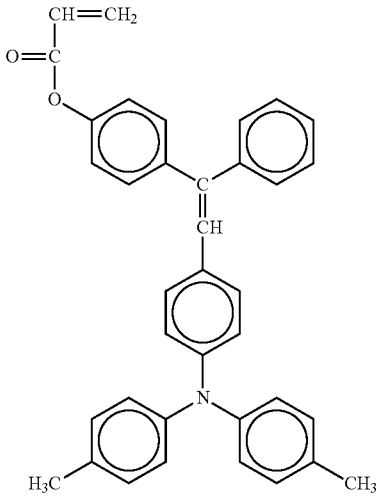
No. 116
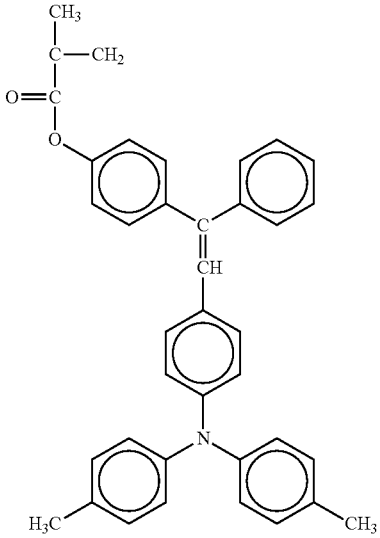
No. 117
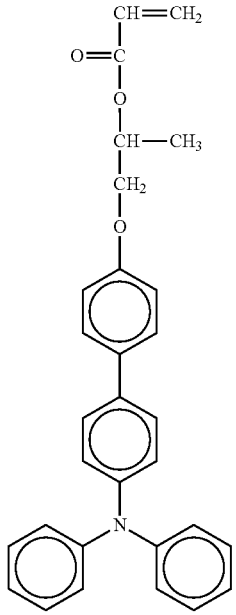

No. 118
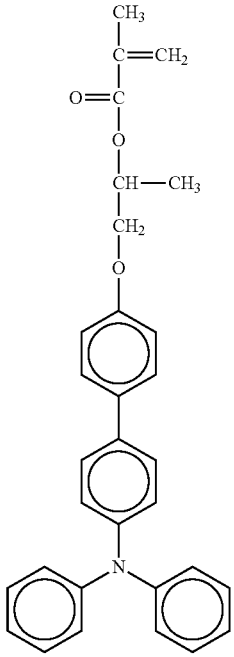
No. 119
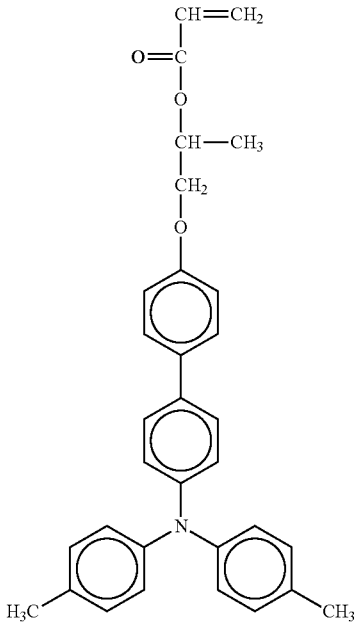
No. 120
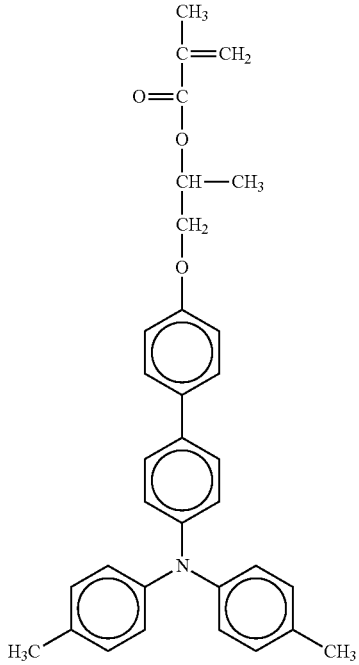
No. 121
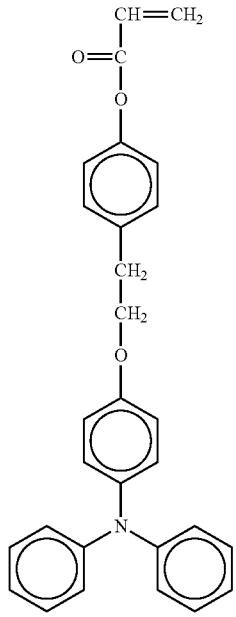

No. 122
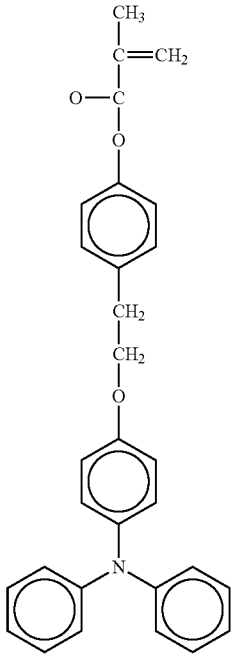
No. 123
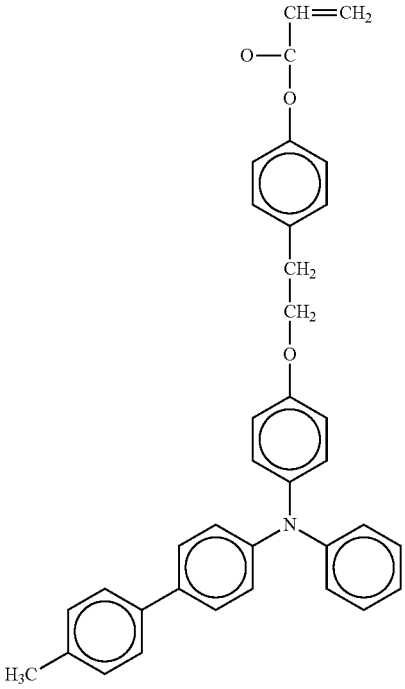
No. 124
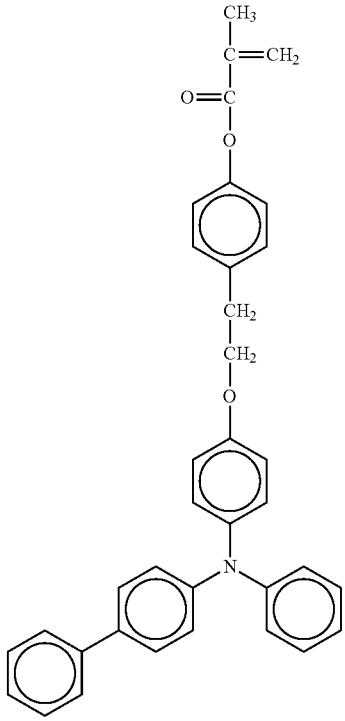
No. 125
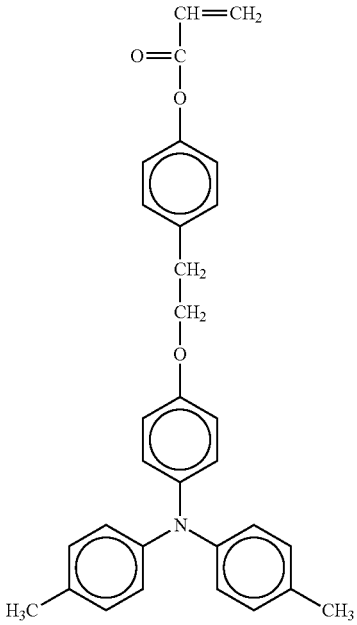

No. 126
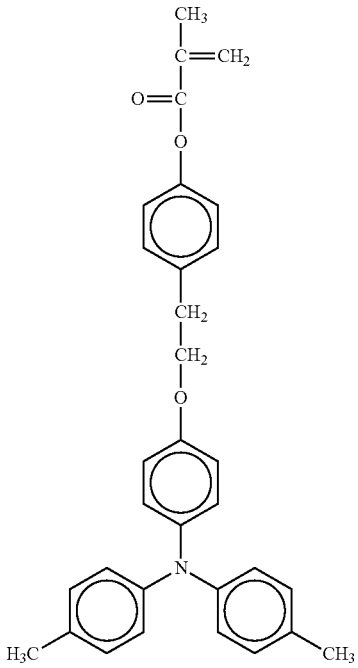
No. 127
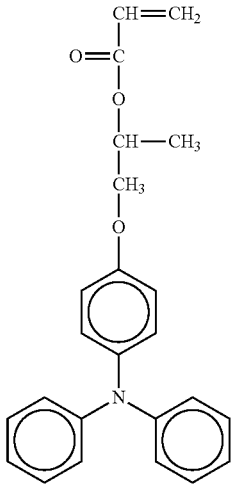
No. 128
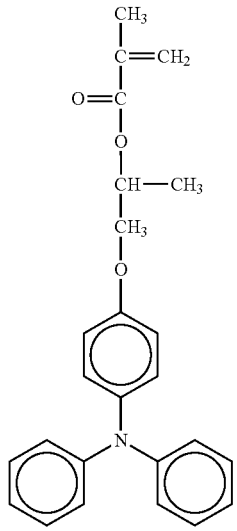
No. 129
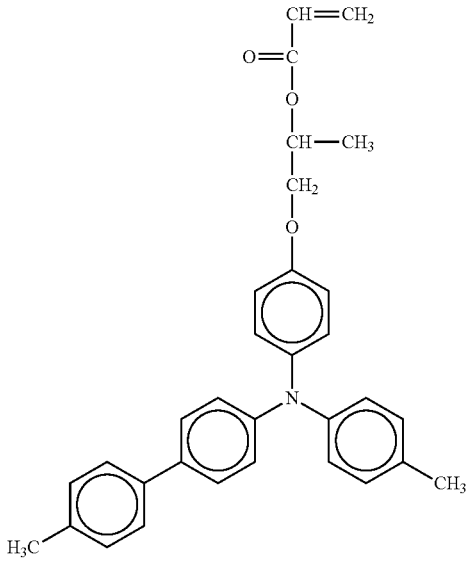

No. 130
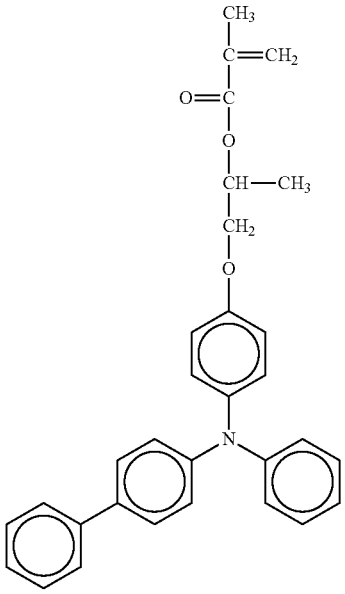
No. 131
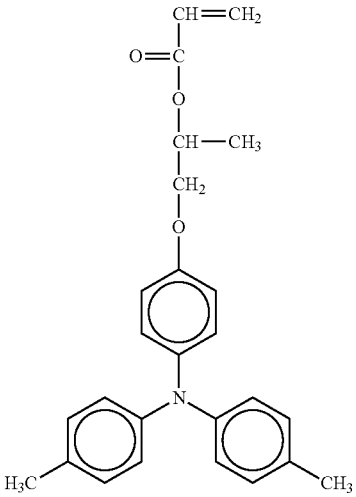
No. 132
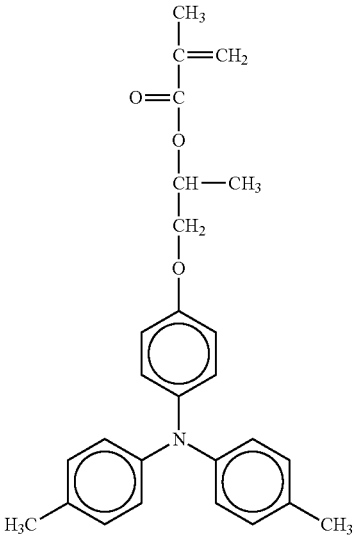
No. 133
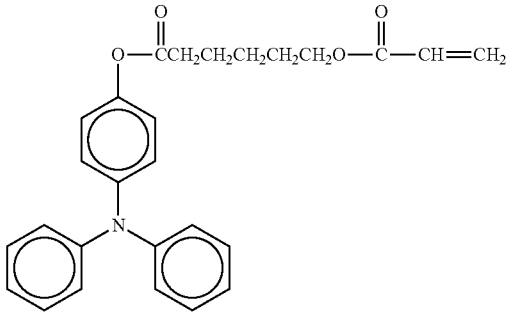
No. 134
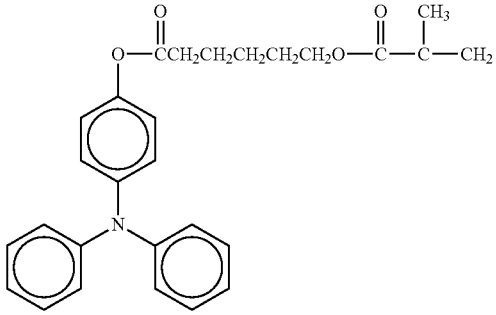
No. 135
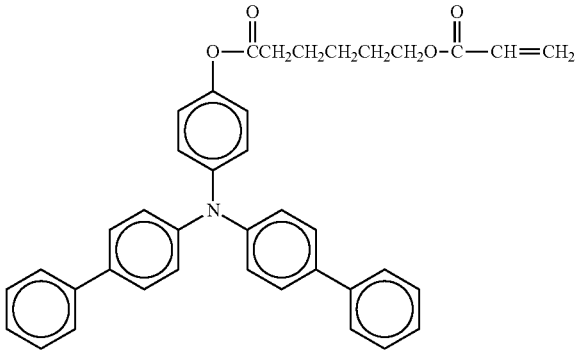
No. 136
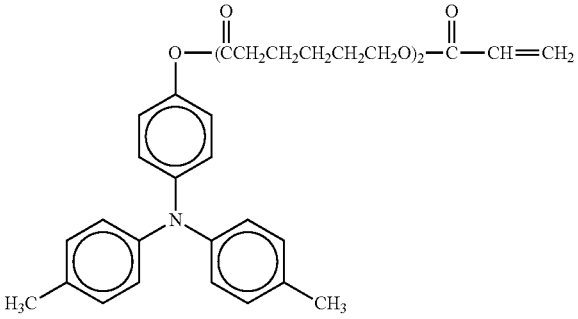

No. 137
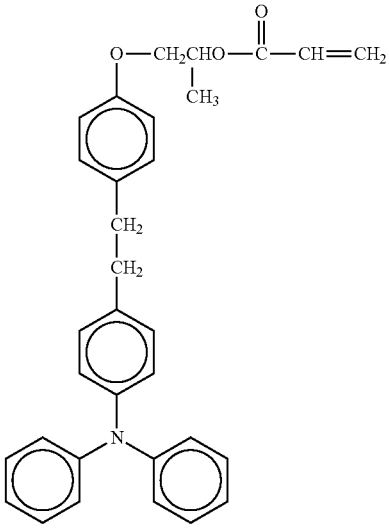
No. 138
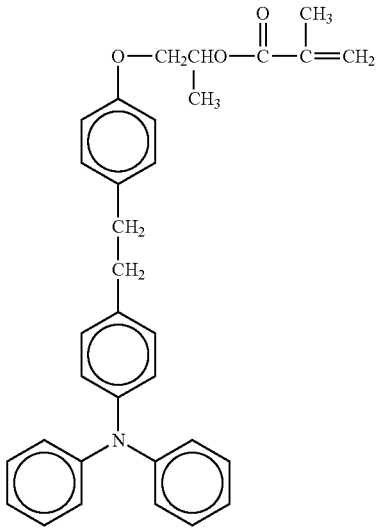
No. 139
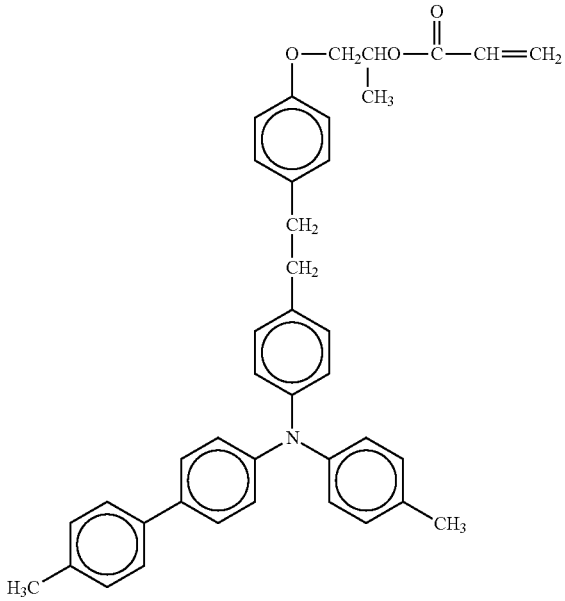
No. 140
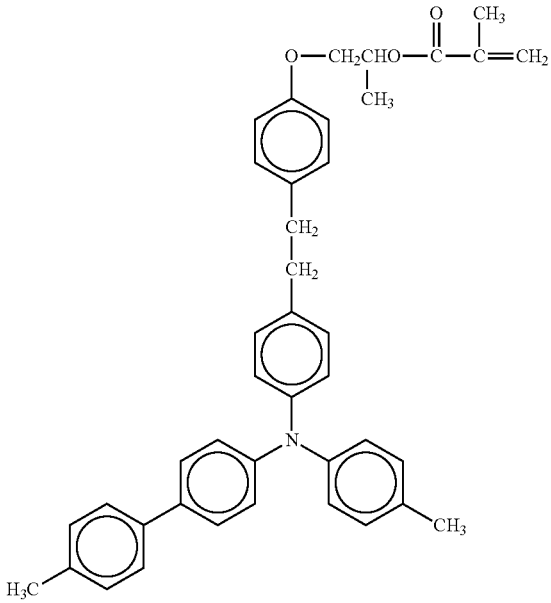

No. 141
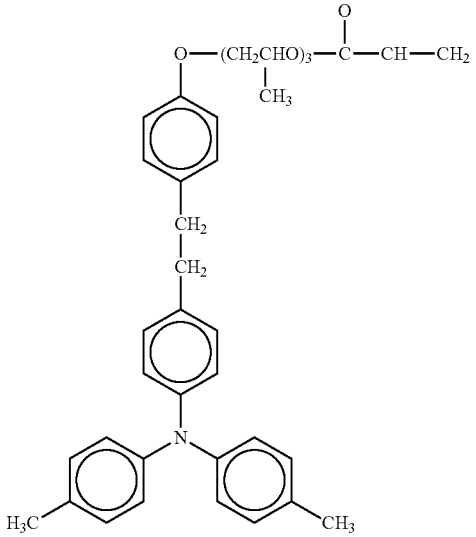
No. 142
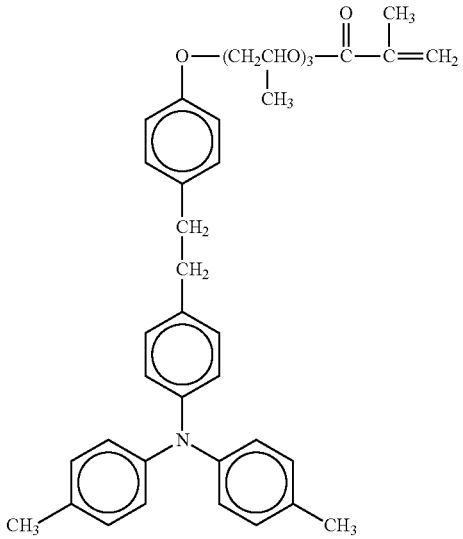
No. 143
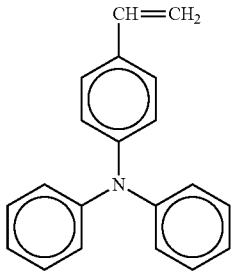
No. 144
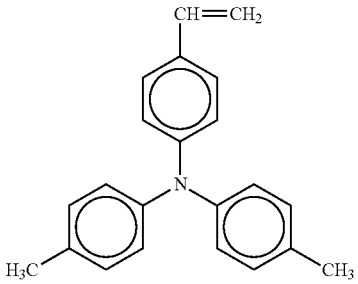
No. 145
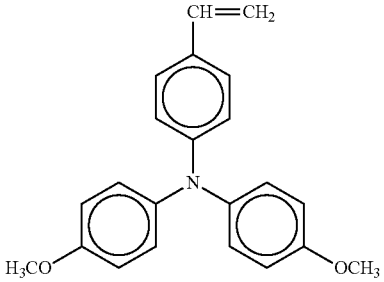
No. 146
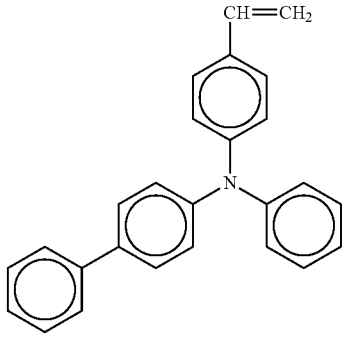
No. 147
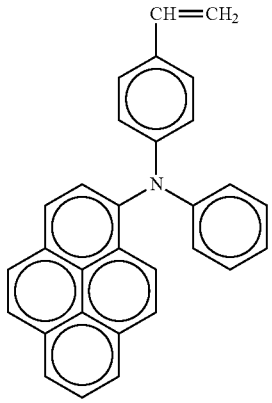

No. 148
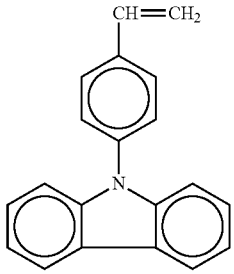
No. 149
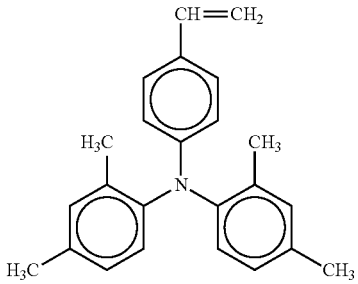
No. 150
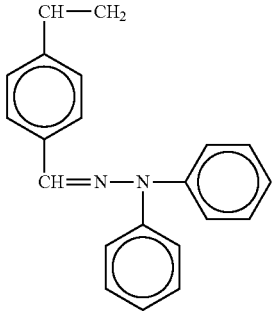
No. 151
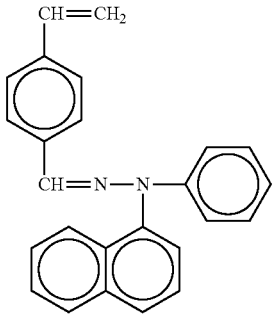
No. 152
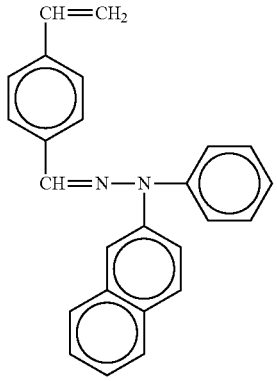
No. 153
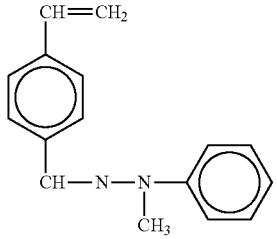
No. 154
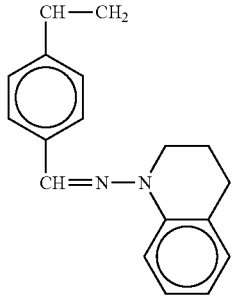
No. 155
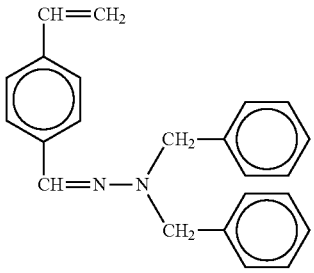
No. 156
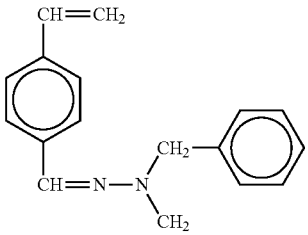

-continued

No. 157

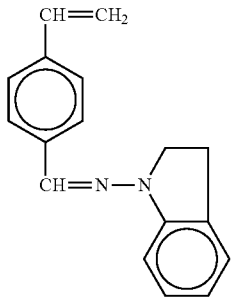

No. 158

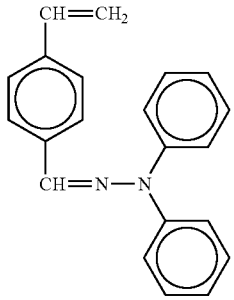

No. 159

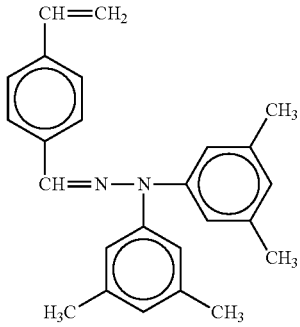

No. 160

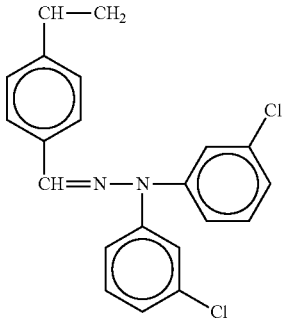

The monofunctional radical polymerizing compound having a charge transport structure for use in the present invention is essential for imparting a charge transportability to the crosslinked protection layer, and is preferably included therein in an amount of 20 to 80% by weight, and more preferably from 30 to 70% by weight based on total weight thereof. When less than 20% by weight, the crosslinked protection layer cannot maintain the charge transportability, a sensitivity of the resultant photoreceptor deteriorates and a residual potential thereof increases in repeated use. When greater than 80% by weight, the content of the tri- or more functional monomer having no charge transport structure decreases and the crosslinked density deteriorates, and therefore the resultant photoreceptor does not have a high abrasion resistance. Although it depends on a required abrasion resistance and electrical properties, in consideration of a balance therebetween, the content of the monofunctional radical polymerizing compound having a charge transport structure is most preferably from 30 to 70% by weight.

The crosslinked protection layer of the present invention is formed by hardening at least the tri- or more functional radical polymerizing monomer having no charge transport structure and the monofunctional radical polymerizing compound having a charge transport structure, and can include a monofunctional or bifunctional radical polymerizing monomer and a radical polymerizing oligomer as well to control a viscosity of the layer when coated, reduce a stress of thereof, impart a low surface free energy thereto and reduce friction coefficient thereof. Known radical polymerizing monomers and oligomers can be used.

Specific examples of the monofunctional radical monomer include, but are not limited to, 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, styrene monomer, etc.

Specific examples of the bifunctional radical monomer include, but are not limited to, 1,3-butanediolacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, EO-modified bisphenol F diacrylate, etc.

Specific examples of the functional monomers include, but are not limited to, octafluoropentylacrylate, 2-perfluorooctylethylacrylate, 2-perfluorooctylethylmethacrylate, 2-perfluoroisononylethylacrylate, etc., wherein a fluorine atom is substituted; vinyl monomers having a polysiloxane group with a repeat unit of from 20 to 70 disclosed in Japanese Patent Publications Nos. 5-60503 and 6-45770, such as acryloylpolydimethylsiloxaneethyl, methacryloylpolydimethylsiloxaneethyl, acryloylpolydimethylsiloxanepropyl, acryloylpolydimethylsiloxanebutyl, diacryloylpolydimethylsiloxanediethyl; acrylate; and methacrylate.

Specific examples of the radical polymerizing oligomer include, but are not limited to, epoxyacrylate oligomers, urethaneacrylate oligomers and polyetseracrylate oligomers. However, when the crosslinked protection layer includes a large amount of the monofunctional or bifunctional radical polymerizing monomer and radical polymerizing oligomer, the three-dimensional crosslinked bonding density substantially deteriorates, resulting in deterioration of the abrasion resistance thereof. Therefore, the surface layer of the present invention preferably includes the monomers and oligomers in an amount not greater than 50 parts by weight, and more preferably not greater than 30 parts by weight per 100 parts by weight of the tri- or more functional radical polymerizing monomer.

The crosslinked protection layer, wherein at least the tri- or more functional radical polymerizing monomer having no charge transport structure and the monofunctional radical polymerizing compound having a charge transport structure are hardened, can optionally include a polymerization initiator to effectively proceed the hardening reaction.

Specific examples of heat polymerization initiators include, but are not limited to, peroxide initiators such as 2,5-dimethylhexane-2,5-dihydrooxide, dicumylperoxide, benzoylperoxide, t-butylcumylperoxide, 2,5-dimethyl-2,5-di(peroxybenzoyl)hexyne-3, di-t-butylbeloxide, t-butylhydrobeloxide, cumenehydobeloxide and lauroylperoxide; and azo initiators such as azobisisobutylnitrile, azobiscyclohexanecarbonitrile, azobisisomethylbutyrate, azobisisobutylamidinehydorchloride and 4,4'-azobis-4-cyanovaleric acid.

Specific examples of photo polymerization initiators include, but are not limited to, acetone or ketal photo polymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-molpholinophenyl)butanone-1,2-hydroxy-2-methyl-1-phenylpropane-1-one and 1-phenyl-1,2-propanedion-2-(o-ethoxycarbonyl)oxime; benzoinether photo polymerization initiators such as benzoin, benzoinmethylether, benzoinethylether, benzoinisobutylether and benzoinisopropylether; benzophenone photo polymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; and other photo polymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds and imidazole compounds. Further, a material having a photo polymerizing effect can be used alone or in combination with the above-mentioned photo polymerization initiators. Specific examples of the materials include, but are not limited to, triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone.

These polymerization initiators can be used alone or in combination. The surface layer of the present invention preferably includes the polymerization initiators in an amount of 0.5 to 40 parts by weight, and more preferably from 1 to 20 parts by weight per 100 parts by weight of the radical polymerizing compounds.

Further, a coating liquid for the crosslinked protection layer of the present invention may optionally include various additives such as plasticizers (to soften a stress and improve adhesiveness thereof), leveling agents and low-molecular-weight charge transport materials without a radical reactivity. Known additives can be used, and specific examples of the plasticizers include, but are not limited to, plasticizers such as dibutylphthalate and dioctylphthalate used in typical resins. The content thereof is preferably not greater than 20% by weight, and more preferably not greater than 10% based on total weight of solid contents of the coating liquid. Specific examples of the leveling agents include, but are not limited to, silicone oil such as dimethylsilicone oil and methylphenylsilicone oil; and polymers and oligomers having a perfluoroalkyl group in the side chain. The content thereof is preferably not greater than 3% by weight.

The crosslinked protection layer of the present invention is formed by coating and hardening a coating liquid including at least the tri- or more functional radical polymerizing monomer having no charge transport structure and the monofunctional radical polymerizing compound having a charge transport structure. The coating liquid can include other components when the radical polymerizing monomer is a liquid, and is optionally diluted with a solvent and coated. Specific examples of the solvent include, but are not limited to, alcohols such as methanol, ethanol, propanol and butanol; ketones such as acetone, methyl ethyl ketone, methyl isobutyl ketone and cyclohexanone; esters such as ethyl acetate and butyl acetate; ethers such as tetrahydrofuran, dioxane and propylether; halogens such as dichloromethane, dichloroethane, trichloroethane and chlorobenzene; aromatics such as benzene, toluene and xylene; and Cellosolves such as methyl Cellosolve, ethyl Cellosolve and Cellosolve acetate. These solvents can be used alone or in combination. A dilution ratio with the solvent can optionally be decided upon solubility of the compositions, a coating method and a purposed layer thickness. The crosslinked protection layer can be coated by a dip coating method, a spray coating method, a bead coating method, a ring coating method, etc.

In the present invention, after the coating liquid is coated to form a protection layer, external energy is applied thereto for hardening the layer to form a crosslinked protection layer. The external energy includes heat, light and/or radiation. Heat energy is applied to the layer from the coated side or from the substrate using air, a gaseous body such as nitrogen, a steam, a variety of heating media, infrared or an electromagnetic wave. The heating temperature is preferably from 100 to 170° C. When less than 100° C., the reaction is slow in speed and is not completely finished. When greater than 170° C., the reaction nonuniformly proceeds and a large distortion appears in the crosslinked protection layer. To uniformly proceed the hardening reaction, after heated at comparatively a low temperature less than 100° C., the reaction is completed at not less than 100° C. Specific examples of light energy include, but are not limited to, UV irradiators such as high pressure mercury lamps and metal halide lamps having an emission wavelength of UV light; and a visible light source adaptable to absorption wavelength of the radical polymerizing compounds and photo polymerization initiators. An irradiation light amount is preferably from 50 to 1,000 mW/cm$^2$. When less than 50 mW/cm$^2$, the hardening reaction takes too long. When greater than 1,000 mW/cm$^2$, the reaction proceeds nonuniformly and the crosslinked protection layer has a large surface roughness. The radiation energy includes, but is not limited to, radiation energy using an electron beam. Among these energies, heat and light energies are preferably used because of their simple reaction speed controls and simple apparatuses.

The crosslinked protection layer of the present invention preferably has a thickness of from 1 to 10 μm, and more preferably from 2 to 8 μm. When thicker than 10 μm, the layer tends to crack and peel. When not thicker than 8 μm, the crosslink density can be higher, and further, materials and hardening conditions can be selected to increase the abrasion resistance. The radical polymerization reaction tends to be disturbed with oxygen, i.e., the surface of the crosslinked protection layer contacting the atmospheric air is not well crosslinked or is nonuniformly crosslinked because of a radical trap of the oxygen. This is most noticeable when less than 1 μm, and the crosslinked protection layer having a thickness less than 1 μm tends to have deterioration in its abrasion resistance and nonuniform abrasion. In addition, the underlying CTL components mix in the crosslinked protection layer when coated thereon. When the crosslinked protection layer is thin, the crosslinked protection layer is wholly contaminated with impurities, resulting in inhibition of the hardening reaction and deterioration of the crosslink density. The crosslinked protection layer of the present invention, having a thickness not less than 1 μm, has good abrasion resistance and scratch resistance, however, when locally abraded until the underlying CTL due to repeated use, the locally abraded part of the crosslinked protection layer expands and the chargeability and sensitivity of the resultant photoreceptor vary, which tends to produce halftone images having irregular image density. Therefore, the crosslinked protection layer preferably has a thickness not less than 2 μm such that the resultant photoreceptor has a longer life and produces higher quality images, including an aspect of maintaining the abrasion resistance thereof.

Further, when a CGL, a CTL and a crosslinked protection layer are layered in this order, the outermost layer, i.e., the crosslinked protection layer is preferably insoluble in an organic solvent in terms of abrasion and scratch resistance. A method of testing the solubility in an organic solvent includes putting a drop of an organic solvent having high solubility for polymer materials such as tetrahydrofuran and dichloromethane on the surface of a photoreceptor; and observing a deformation thereof with a stereoscopic microscope after naturally dried. When soluble, the center of the drop is concave and the circumference thereof is mounded, a CTM separates out and is crystallized to overcloud the surface of a photoreceptor, and wrinkles are formed thereon because of swelling and contracting afterwards. When insoluble, the surface of a photoreceptor is free from these phenomena, and has no deformation as it has before putting the drop thereon.

In order to make the crosslinked protection layer insoluble in an organic solvent, (1) controlling the constituents and contents thereof in the crosslinked protection layer coating liquid, (2) controlling a diluent solvent and a concentration of solid contents therein, (3) selecting methods of coating the crosslinked protection layer coating liquid, (4) controlling the hardening conditions of the crosslinked protection layer coating liquid, (5) making the underlying CTL insoluble, etc. are essential. However, the method is not limited to only one of these.

When an additive such as a binder resin not having a radical polymerizing functional group, an antioxidant and a plasticizer besides the tri- or more functional radical polymerizing monomer having no charge transport structure and the monofunctional radical polymerizing compound having a charge transport structure is included in the crosslinked protection layer coating liquid in a large amount, a phase separation between the hardened material and the additive is formed, resulting in deterioration of the crosslink density and soluble in an organic solvent. Specifically, it is essential that the additive is included in the coating liquid in an amount of not greater than 20% by weight based on total weight of solid contents therein. In addition, in order not to make the crosslink density thin, a radical polymerizing monomer having one or two functional groups, a reactive oligomer or a reactive polymer is preferably included therein in an amount not greater than 20% by weight based on total weight of the tri- or more functional radical polymerizing monomer. When a radical polymerizing compound having two or more functional groups with a charge transport structure is included therein in a large amount, bulky structures plurally bonded and fixed in the crosslinked structure, and therefore the resultant crosslinked protection layer tends to become distorted and an aggregation of microscopic hardened materials. This is why the layer is occasionally soluble in an organic solvent. Although depending on the structure of the compound, the radical polymerizing compound having two or more functional groups with a charge transport structure is preferably included therein in an amount not greater than 10% by weight based on total weight of the monofunctional radical polymerizing compound having a charge transport structure.

When a solvent having a low evaporation rate is used as the diluent solvent for the crosslinked protection layer coating liquid, a residual solvent prevents the hardening reaction and increases the mixed amount of the underlayer components, resulting in nonuniform crosslink and deterioration of crosslink density. This is why the layer is liable to be soluble in an organic solvent. Specifically, tetrahydrofuran, a mixed solvent of tetrahydrofuran and methanol, ethyl acetate, methyl ethyl ketone, ethyl cellosolve, etc. are effectively used, and selected according to the coating method. When a concentration of solid contents is too low, the resultant layer is liable to be soluble in an organic solvent. A maximum concentration thereof is limited by limitations of the thickness of the layer and the viscosity of the coating liquid. Specifically, the solid contents are preferably included in the coating liquid in an amount of from 10 to 50% by weight. The coating liquid preferably includes a solvent as little as possible, and the underlayer preferably contacts the solvent for as short as possible. Specifically, a spray coating method and a ring coating method regulating an amount of the coating liquid are preferably used. In order to prevent the underlayer components from mixing in the crosslinked protection layer, the CTL (underlayer) effectively includes a charge transport polymer material or an intermediate layer insoluble in the solvent used in the crosslinked protection layer coating liquid is effectively formed therebetween.

The crosslinked protection layer is not completely hardened when the heat or light irradiation energy is low, and is more soluble in an organic solvent. When hardened with a very high energy, the crosslinked protection layer is nonuniformly hardened, wherein an uncrosslinked part and a radical discontinuation part increase, and is liable to have an aggregation of microscopic hardened materials. Therefore, the crosslinked protection layer is occasionally soluble in an organic solvent. The crosslinked protection layer is preferably hardened with a heat at from 100 to 170° C. for 10 min to 3 hrs, or with UV light irradiation at from 50 to 1,000 $mW/cm^2$ for 5 sec to 5 min, and at not higher than 50° C.

In order to form a crosslinked protection layer insoluble in an organic solvent, an acrylate monomer having three acryloyloxy groups and a triarylamine compound having one acryloyloxy group are mixed at a ratio (acrylate monomer having three acryloyloxy groups/a triarylamine compound having one acryloyloxy group) of from 7/3 to 3/7 to prepare a mixture; a polymerization initiator is added thereto in an amount of from 3 to 20% by weight based on total weight thereof to prepare another mixture; and a solvent is added thereto to prepare a coating liquid. For example, when an underlayer of the crosslinked protection layer, i.e., the CTL includes a triarylamine donor as a charge transport material and a polycarbonate resin as a binder resin, and the coating liquid is sprayed thereon, the solvent is preferably tetrahydrofuran, 2-butanone, ethylacetate, etc., in an amount of 3 to 10 times as much as the total weight of the mixture of the acrylate monomer having three acryloyloxy groups and the triarylamine compound having one acryloyloxy group.

On a substrate such as an aluminum cylinder, an undercoat layer, a CGL and a CTL are layered in this order to prepare a photoreceptor, and the coating liquid is sprayed thereon. Then, the photoreceptor is dried naturally or at comparatively a low temperature for a short time, i.e., at 25 to 80° C. for 1 to 10 min, and is irradiated with UV light or heated to harden the coated layer thereof.

A metal halide lamp, or the like, is preferably used to irradiate the UV light at an illuminance of from 50 to 1,000 mW/cm$^2$. For example, when the UV light having an illuminance of 500 mW/cm$^2$ is irradiated onto the photoreceptor (drum), plural lamps may circumferentially irradiate the drum for about 30 sec, seeing that the drum does not have a temperature higher than 50° C.

When heated, the heating temperature is preferably from 100 to 170° C., and an oven blower, or the like, is used as a heater. When the heating temperature is 150° C., the heating time is from 20 min to 3 hrs.

After hardening, it is further heated at from 100 to 150° C. for 10 to 30 min to reduce the residual solvent.

Thus, the electrophotographic photoreceptor of the present invention is prepared.

Figure 12:
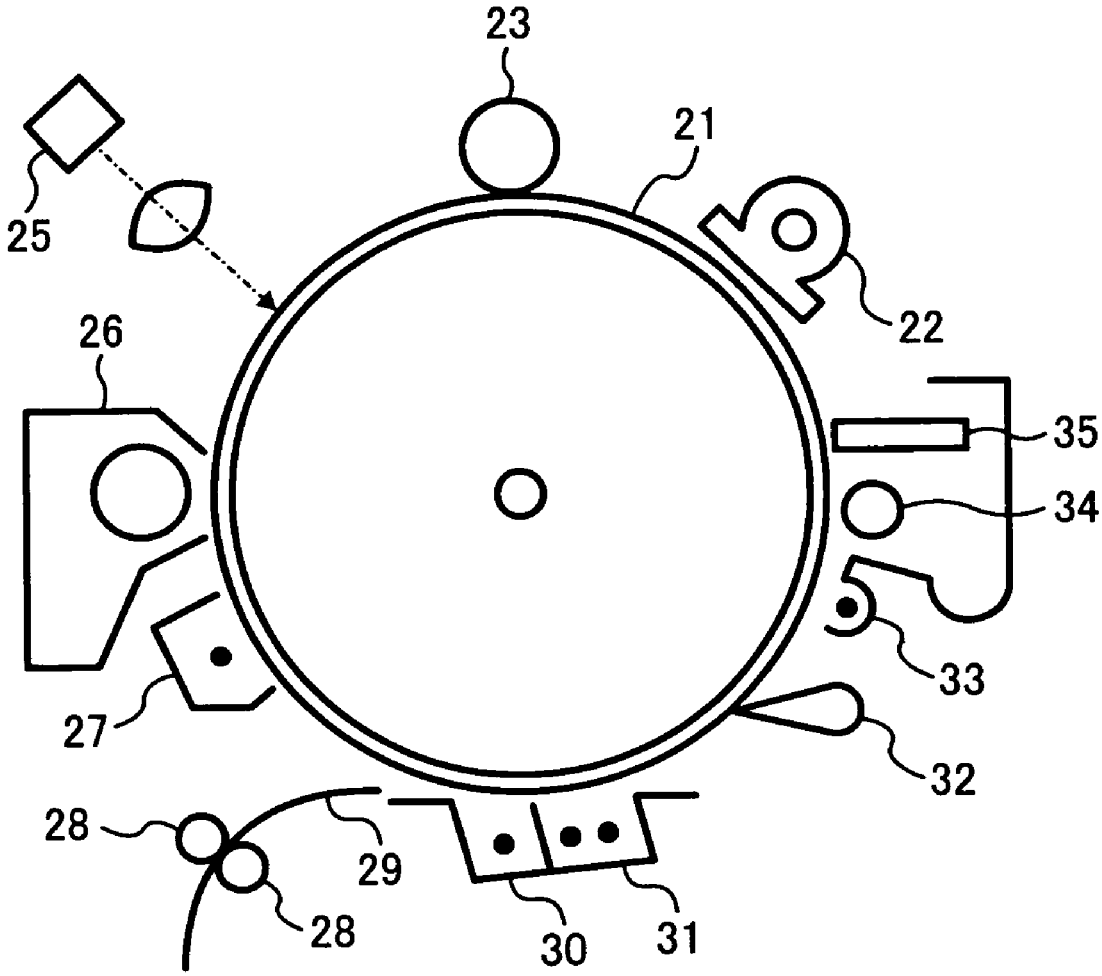
FIG. 12 is a schematic view illustrating an embodiment of the image forming apparatus for explaining the electrophotographic image forming process of the present invention.

FIG. 12 is a schematic view illustrating an embodiment of the image forming apparatus for explaining the electrophotographic image forming process of the present invention, and the following modified example is in scope of the present invention.

Figure 13:
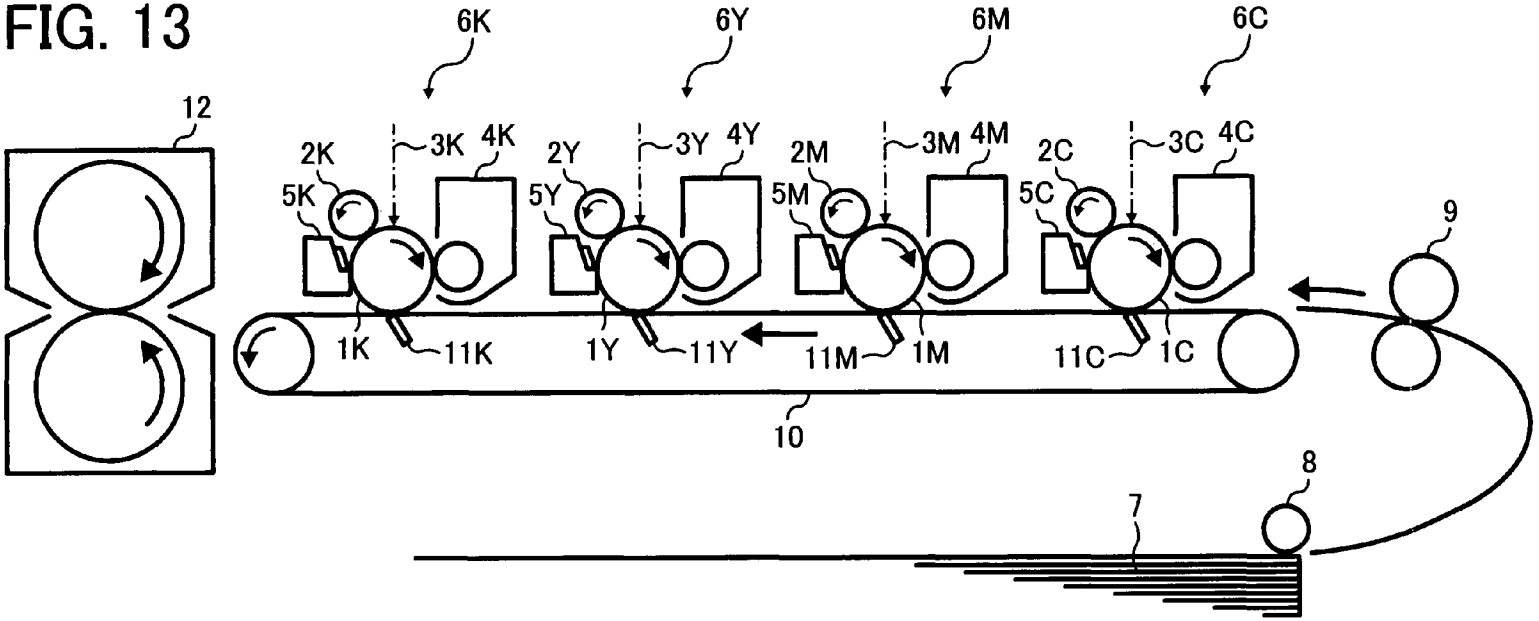
FIG. 13 is a schematic view illustrating another embodiment (a tandem-type full color image forming apparatus) of the image forming apparatus of the present invention.

In FIG. 13, a photoreceptor (21) includes at least an electroconductive substrate, an intermediate layer and a photosensitive layer in this order, wherein the intermediate layer comprises an N-alkoxymethylated nylon comprising a component having a molecular weight not greater than 5,000 in an amount of from 3 to 10% by weight. The photoreceptor (21) has the shape of a drum, and may have the shape of a sheet or an endless belt. Known chargers such as corotrons, scorotrons, solid state chargers, charging rollers and transfer rollers can be used for a charging roller (23), a pre-transfer charger (27), a transfer charger (30), a separation charger (31) and a pre-cleaning charger (33).

These chargers are preferably contact chargers or adjacent non-contact chargers because of high charging efficiency, production of less ozone, and capability of downsizing the apparatus.

Suitable light sources for use in an irradiator (25) and a discharging lamp (22) include general light-emitting materials such as fluorescent lamps, tungsten lamps, halogen lamps, mercury lamps, sodium lamps, LEDs, LDs, light sources using electroluminescence (EL), etc.

In addition, in order to obtain light having a desired wave length range, filters such as sharp-cut filters, band pass filters, near-infrared cutting filters, dichroic filters, interference filters, color temperature converting filters, etc. can be used.

Particularly, the laser emitting diode (LED) and laser diode (LD) having a high irradiating energy and a long wavelength of from 600 to 800 nm are preferably used for the phthalocyanine pigment having a specific crystal form and high sensitivity for use in the present invention.

The above-mentioned light sources can be used for not only the process illustrated in FIG. 12, but also other processes such as a transfer process, a discharging process, a cleaning process, a pre-exposure process including light irradiation to the photoreceptor.

When a toner image formed on the photoreceptor (21) by a developing unit (26) is transferred onto a transfer sheet (29), all of the toner image is not transferred thereto, and a residual toner remains on the surface of the photoreceptor (21). The residual toner is removed therefrom by a fur brush (34) and a cleaning blade (35). The residual toner remaining on the photoreceptor 1 can be removed by only a cleaning brush. Suitable cleaning brushes include known cleaning brushes such as fur brushes and mag-fur brushes.

When the positively (or negatively) charge photoreceptor is exposed to imagewise light, an electrostatic latent image having a positive (or negative) charge is formed on the photoreceptor. When the latent image having a positive (or negative) charge is developed with a toner having a negative (or positive) charge, a positive image can be obtained. In contrast, when the latent image having a positive (negative) charge is developed with a toner having a positive (negative) charge, a negative image can be obtained. As the developing method, known developing methods can be used.

Next, the image forming elements including the electrophotographic photoreceptor of the present invention will be explained.

The image forming elements include an electrophotographic photoreceptor including a charge blocking layer comprising a N-alkoxymethylated nylon comprising a component having a molecular weight not greater than 5,000 in an amount of from 3 to 10% by weight, an antimoire layer and a photosensitive layer; and a unit including at least a charger, an image developer and a cleaner. The image forming elements having the same number of colors are installed in a color electrophotographic image forming apparatus using plural color toners. Each of the image forming elements can be fixed in an image forming apparatus or detachable therefrom.

FIG. 13 is a schematic view illustrating another embodiment (a tandem-type full color image forming apparatus) of the image forming apparatus of the present invention, which includes plural image forming units and the following modified example is in scope of the present invention.

In FIG. 13, numerals 1C, 1M, 1Y and 1K represent drum-shaped photoreceptors, and they are the photoreceptors of the present invention. The photoreceptors 1C, 1M, 1Y and 1K rotate in the direction indicated by an arrow, and around them, chargers 2C, 2M, 2Y and 2K; image developers 4C, 4M, 4Y and 4*k*; and cleaners 5C, 5M, 5Y and 5K are arranged in a rotation order thereof. The chargers 2C, 2M, 2Y and 2K uniformly charge surfaces of the photoreceptors.

Laser beams 3C, 3M, 3Y and 3K from irradiators (not shown) irradiate the surfaces of the photoreceptors between the chargers 2C, 2M, 2Y and 2K and image developers 4C, 4M, 4Y and 4*k* to form electrostatic latent images on the surfaces of the photoreceptors 1C, 1M, 1Y and 1K. Four image forming units 6C, 6M, 6Y and 6K including the photoreceptors 1C, 1M, 1Y and 1K are arranged along a transfer feeding belt 10 feeding a transfer material. The transfer feeding belt 10 contacts the photoreceptors 1C, 1M, 1Y and 1K between the image developers 4C, 4M, 4Y and 4*k* and cleaners 5C, 5M, 5Y and 5K of the image forming units 6C, 6M, 6Y and 6K. Transfer brushes 11*c*, 11M, 11Y and 11K are arranged on a backside of the transfer feeding belt 10, which is an opposite side to the photoreceptors, to apply a transfer bias to the transfer feeding belt 10. The image forming units 6C, 6M, 6Y and 6K just handle different color toners respectively, and have the same constitutions.

In the full-color electrophotographic apparatus in FIG. 13, images are formed as follows. First, in the image forming units 6C, 6M, 6Y and 6K, the photoreceptors 1C, 1M, 1Y and 1K are charged by the chargers 2C, 2M, 2Y and 2K rotating in the same direction of the photoreceptors. Next, the laser beams 3C, 3M, 3Y and 3K from irradiators (not shown) irradiate the surfaces of the photoreceptors to form electrostatic latent images having different colors respectively thereon. Then, the image developers 4C, 4M, 4Y and 4*k* develop the electrostatic latent images to form toner images.

Next, the image developers 4C, 4M, 4Y and 4*k* develop the electrostatic latent images with toners having a cyan color C, a magenta color M, a yellow color Y and a black color K respectively. The color toner images respectively formed on the photoreceptors 1C, 1M, 1Y and 1K are overlaid on a transfer sheet 7. The transfer sheet 7 is fed by a paper feeding roller 8 from a tray and stopped once by a pair of resist rollers 9, and fed onto the transfer feeding belt 10 in timing with formation of the toner images on the photoreceptors. The transfer sheet 7 borne by the transfer feeding belt 10 is transferred to the contact (transfer) position of each photoreceptor 1C, 1M, 1Y and 1K, where each color toner image is transferred onto the transfer sheet 7.

The toner images on the photoreceptors are transferred to the transfer sheet 7 by an electric field formed with a potential difference between the transfer bias applied by the transfer brushes 11C, 11M, 11Y and 11K and the photoreceptors 1C, 1M, 1Y and 1K. The transfer sheet 7 having passed the four transfer positions and bearing the four color toner images overlaid thereon is fed to a fixer 12 fixing the toner images on the transfer sheet. The transfer sheet 7 on which the toner images are fixed is fed onto a sheet receiver (not shown). Residual toners remaining on the photoreceptors 1C, 1M, 1Y and 1K, which were not transferred on the transfer sheet at the transfer position are collected by the cleaners 5C, 5M, 5Y and 5K. In an embodiment in FIG. 13, the image forming units are lined in order of C, M, Y and K from an upstream to a downstream of feeding direction of the transfer sheet. However, the order is not limited thereto and the color orders are optional.

When only a black image is produced, the image forming units 6C, 6M and 6Y except for 6K can be stopped in the apparatus of the present invention. In FIG. 13, the charger contacts the photoreceptor, however, a gap therebetween of from 10 to 200 μm can decrease an abrasion amount thereof and toner film over the charger.

Figure 14:
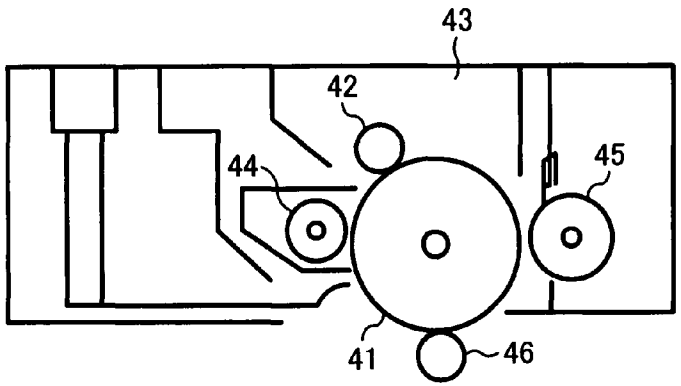
FIG. 14 is a schematic view illustrating a process cartridge for use in the image forming apparatus of the present invention.

The above-mentioned image forming units may be fixedly set in a copier, a facsimile or a printer. However, the image forming units may be set therein as a process cartridge. The process cartridge means an image forming unit (or device) including at least a photoreceptor; and one of a charger, an imagewise light irradiator, an image developer, an image transferer and a cleaner. Various process cartridges can be used in the present invention. FIG. 14 illustrates an embodiment of the process cartridge for use in the image forming apparatus of the present invention, wherein a photoreceptor drum 41 rotates in the direction indicated by an arrow, and a charger 42, an irradiator 43, an image developer 45, a transferer 46 and a cleaner 44 are located around the photoreceptor drum 41, and a transfer sheet is fed thereto. The photoreceptor drum 41 includes at least an electroconductive substrate, an intermediate layer and a photosensitive layer in this order, wherein the intermediate layer comprises a N-alkoxymethylated nylon comprises a component having a molecular weight not greater than 5,000 in an amount of from 3 to 10% by weight.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, synthesis examples of the N-alkoxymethylated nylon for use in the present invention will be explained.

Synthesis Example 1

100 parts of 6-nylon are dissolved in 150 parts of methanol to prepare a solution, 70 parts of formaldehyde and 2 parts of phosphoric acid are mixed and stirred therein to prepare a mixture, and the mixture is heated for 1 hr to have a temperature of 150° C. After the temperature is maintained at 150° C. for 30 min, the mixture is cooled to room temperature for 50 min. The mixture is a translucent gel.

The gel is dissolved in 95% ethanol including excess ammonia to deacidify the phosphoric acid to prepare a solution, and the solution is poured in water to separate polyamide out.

The polyamide is filtered and washed with 1 liter of running water, and dried to prepare a N-alkoxymethylated nylon. This is Resin 1.

Synthesis Example 2

The procedure for preparation of the N-alkoxymethylated nylon in Synthesis Example 1 is repeated to prepare a N-alkoxymethylated nylon except for washing the filtered polyamide with 1 liter of running water twice. This is Resin 2.

Synthesis Example 3

The procedure for preparation of the N-alkoxymethylated nylon in Synthesis Example 2 is repeated to prepare a N-alkoxymethylated nylon except for heating the mixture to have a temperature of 145° C. This is Resin 3.

Synthesis Example 4

The procedure for preparation of the N-alkoxymethylated nylon in Synthesis Example 1 is repeated to prepare a N-alkoxymethylated nylon except for heating the mixture to have a temperature of 140° C. and washing the filtered polyamide with 1 liter of running water once. This is Resin 4.

Synthesis Example 5

The procedure for preparation of the N-alkoxymethylated nylon in Synthesis Example 1 is repeated to prepare a N-alkoxymethylated nylon except for heating the mixture to have a temperature of 140° C. This is Resin 5.

Synthesis Example 6

The procedure for preparation of the N-alkoxymethylated nylon in Synthesis Example 5 is repeated to prepare a N-alkoxymethylated nylon except for washing the filtered polyamide with 1 liter of ion-exchanged water twice. This is Resin 6.

Synthesis Example 7

The procedure for preparation of the N-alkoxymethylated nylon in Synthesis Example 5 is repeated to prepare a N-alkoxymethylated nylon except for washing the filtered polyamide with 1 liter of ultrapure water having a conductivity not greater than 0.1 μS/cm once. This is Resin 7.

Synthesis Example 8

The procedure for preparation of the N-alkoxymethylated nylon in Synthesis Example 5 is repeated to prepare a N-alkoxymethylated nylon except for washing the filtered polyamide with 1 liter of ultrapure water having a conductivity not greater than 0.1 μS/cm twice. This is Resin 8.

Synthesis Example 9

The procedure for preparation of the N-alkoxymethylated nylon in Synthesis Example 5 is repeated to prepare a N-alkoxymethylated nylon except for washing the filtered polyamide with 1 liter of ultrapure water having a conductivity not greater than 0.1 μS/cm three times. This is Resin 9.

Synthesis Example 10

The procedure for preparation of the N-alkoxymethylated nylon in Synthesis Example 1 is repeated to prepare a N-alkoxymethylated nylon except for heating the mixture to have a temperature of 135° C. This is Resin 10.

Synthesis Example 11

The procedure for preparation of the N-alkoxymethylated nylon in Synthesis Example 10 is repeated to prepare a N-alkoxymethylated nylon except for washing the filtered polyamide with 1 liter of ion-exchanged water twice. This is Resin 11.

Synthesis Example 12

The procedure for preparation of the N-alkoxymethylated nylon in Synthesis Example 1 is repeated to prepare a N-alkoxymethylated nylon except for heating the mixture to have a temperature of 125° C. This is Resin 12.

Synthesis Example 13

The procedure for preparation of the N-alkoxymethylated nylon in Synthesis Example 1 is repeated to prepare a N-alkoxymethylated nylon except for heating the mixture to have a temperature of 160° C. This is Resin 13.

Synthesis Example 14

The procedure for preparation of the N-alkoxymethylated nylon in Synthesis Example 1 is repeated to prepare a N-alkoxymethylated nylon except for heating the mixture to have a temperature of 120° C. and washing the filtered polyamide with 1 liter of ultrapure water having a conductivity not greater than 0.1 μS/cm three times. This is Resin 14.

Synthesis Example 15

The procedure for preparation of the N-alkoxymethylated nylon in Synthesis Example 14 is repeated to prepare a N-alkoxymethylated nylon except washing the filtered polyamide with 1 liter of running water once. This is Resin 15.

The molecular weight distributions and conductivities of the Resins 1 to 15 are measured. The results are shown in Table 1.

TABLE 1

| | Component having a molecular weight not greater than 5,000 (%) | Component having a molecular weight not greater than 1,000 (%) | Conductivity (μS/cm) |
|---|---|---|---|
| Resin 1 | 9.8 | 5.5 | 5.3 |
| Resin 2 | 9.6 | 1.8 | 3.9 |
| Resin 3 | 6.8 | 1.7 | 2.5 |
| Resin 4 | 5.5 | 1.9 | 16 |
| Resin 5 | 5.3 | 1.8 | 9.8 |
| Resin 6 | 5.1 | 1.5 | 5.5 |
| Resin 7 | 5 | 1.5 | 2.2 |
| Resin 8 | 5 | 1.7 | 1.6 |
| Resin 9 | 4.9 | 1.6 | 1.3 |
| Resin 10 | 3.3 | 0.4 | 8.5 |
| Resin 11 | 3.3 | 0.2 | 4.3 |
| Resin 12 | 3.0 | 0.5 | 6.8 |

TABLE 1-continued

| | Component having a molecular weight not greater than 5,000 (%) | Component having a molecular weight not greater than 1,000 (%) | Conductivity (μS/cm) |
|---|---|---|---|
| Resin 13 | 11.3 | 2.1 | 4.7 |
| Resin 14 | 2.7 | 0.3 | 1.1 |
| Resin 15 | 1.1 | 0.2 | 16.5 |

Intermediate Layer Coating Liquid Preparation Example 1

The following materials are mixed to prepare an intermediate layer coating liquid 1.

| | |
|---|---|
| N-alkoxymethylated (Resin 1) | 6.4 |
| Methanol | 70 |
| n-butanol | 30 |

Intermediate Layer Coating Liquid Preparation Examples 2 to 15

The procedure for preparation of the intermediate layer coating liquid 1 is repeated to prepare intermediate layer coating liquids 2 to 15 except for replacing the Resin 1 with the Resins 2 to 15.

Pigment Synthesis Example 1

A titanylphthalocyanine crystal is prepared by the method disclosed in Synthesis Example 1 of Japanese Laid-Open Patent Publications Nos. 2001-19871. Specifically, at first 29.2 g of 1,3-diiminoisoindoline and 200 ml of sulfolane are mixed. Then 20.4 g of titanium tetrabutoxide is dropped into the mixture under a nitrogen gas flow. The mixture is then heated to 180° C. and a reaction is performed for 5 hours at a temperature of from 170 to 180° C. while agitating. After the reaction, the reaction product is cooled, followed by filtering. The thus prepared wet cake is washed with chloroform until the cake colored blue. Then the cake is washed several times with methanol, followed by washing several times with hot water heated to 80° C. and drying. Thus, a crude titanylphthalocyanine is prepared. One part of the thus prepared crude titanylphthalocyanine is dropped into 20 parts of concentrated sulfuric acid to be dissolved therein. The solution is dropped into 100 parts of ice water while stirring, to precipitate a titanylphthalocyanine pigment. The pigment is obtained by filtering. The pigment is washed with ion-exchanged water having a pH of 7.0 and a specific conductivity of 1.0 μS/cm until the filtrate becomes neutral. In this case, the pH and specific conductivity of the filtrate is 6.8 and 2.6 μS/cm. Thus, an aqueous paste of a titanylphthalocyanine pigment is obtained. Forty (40) grams of the thus prepared aqueous paste of the titanylphthalocyanine pigment, which has a solid content of 15% by weight, is added to 200 g of tetrahydrofuran (THF) and the mixture is stirred for about 4 hours. The weight ratio of the titanylphthalocyanine pigment to the crystal changing solvent (i.e., THF) is 1/33. Then the mixture is filtered and the wet cake is dried to prepare a titanylphthalocyanine powder (Pigment 1). The materials used therefor do not include a halogenated compound.

Figure 15:
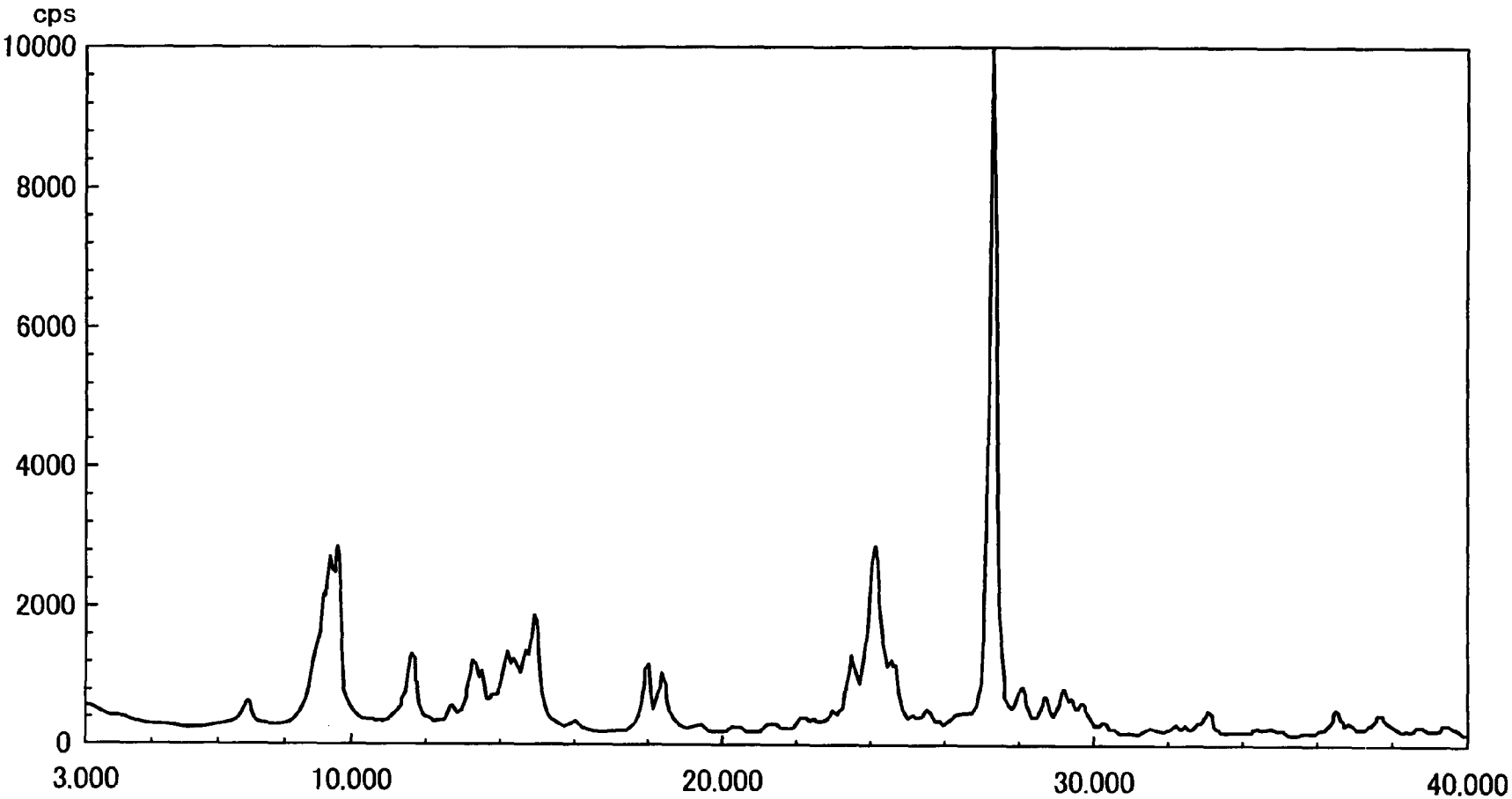
FIG. 15 is an X-ray diffraction spectrum of the titanylphthalocyanine crystal prepared in Synthesis Example 1.

When the thus prepared titanylphthalocyanine powder is subjected to the X-ray diffraction analysis under the following conditions, it is confirmed that the titanylphthalocyanine powder has an X-ray diffraction spectrum such that a maximum peak is observed at a Bragg (2θ) angle of 27.2±0.2°, a lowest angle peak at an angle of 7.3±0.2°, and a main peak at each of angles of 9.4±0.2°, 9.6±0.2°, and 24.0±0.2°, wherein no peak is observed between the peaks of 7.3° and 9.4° and at an angle of 26.3. The X-ray diffraction spectrum thereof is illustrated in FIG. 15.

Figure 16:
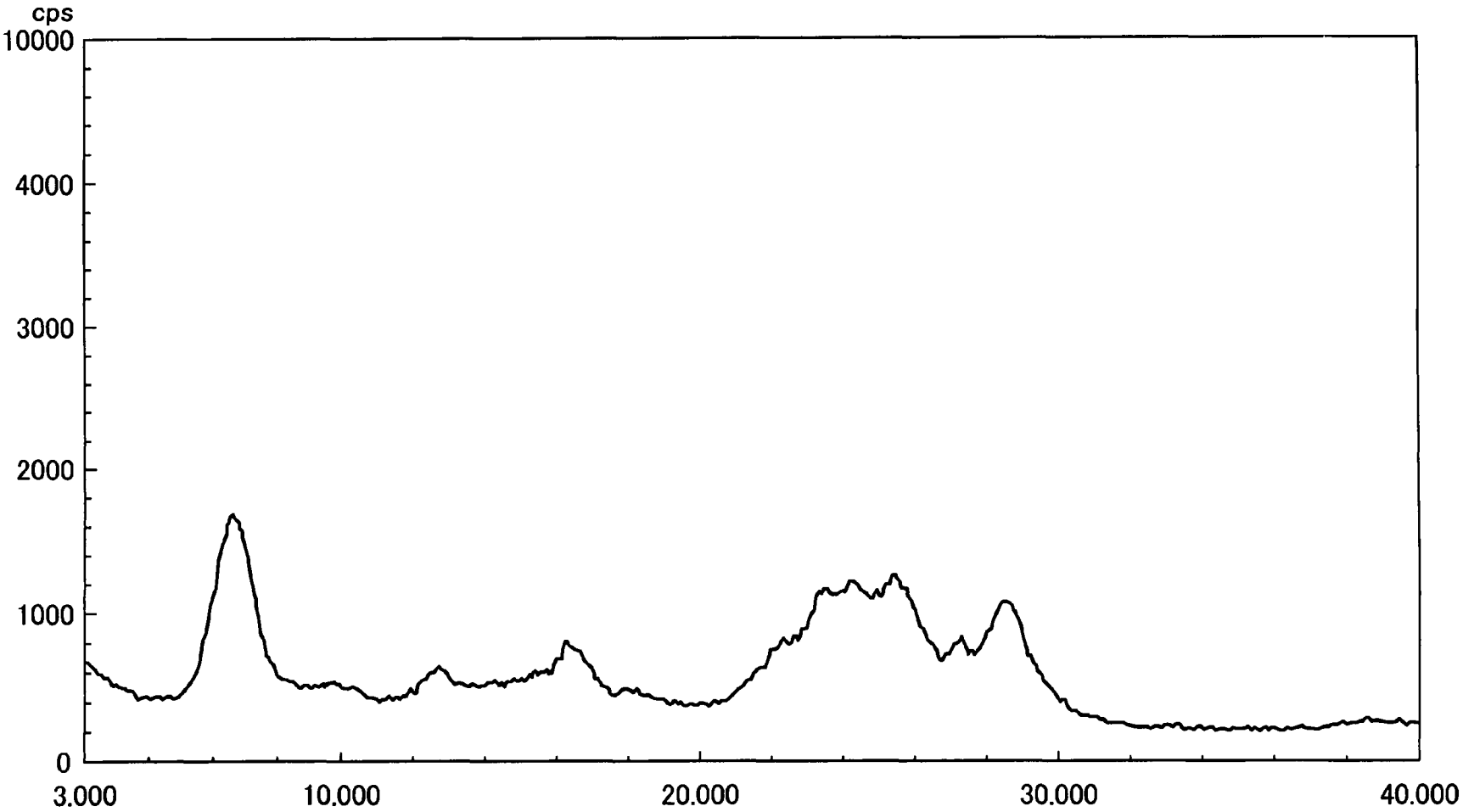
FIG. 16 is an X-ray diffraction spectrum of the titanylphthalocyanine pigment obtained by drying the wet paste prepared in Synthesis Example 1.

In addition, a part of the aqueous paste prepared above is dried at 80° C. for 2 days under a reduced pressure of 5 mmHg, to prepare a titanylphthalocyanine pigment, which has a low crystallinity. The X-ray diffraction spectrum of the titanylphthalocyanine pigment is illustrated in FIG. 16.

X-Ray Diffraction Spectrum Measuring Conditions

X-ray tube: Cu
X-ray used: Cu—$K_\alpha$ having a wavelength of 1.542 Å
Voltage: 50 kV
Current: 30 mA
Scanning speed: 2°/min
Scanning range: 3° to 40°
Time constant: 2 seconds Pigment Synthesis Example 2

Specifically, 60 parts of the thus prepared aqueous paste of the titanylphthalocyanine pigment prepared in Pigment Synthesis Example 1 is added to 400 g of tetrahydrofuran (THF) and the mixture is strongly agitated with a HOMOMIXER (MARK IIf from Kenis Ltd.) at a revolution of 2,000 rpm until the color of the paste is changed from navy blue to light blue. The color is changed after the agitation is performed for about 20 minutes. In this regard, the ratio of the titanylphthalocyanine pigment to the crystal change solvent (THF) is 44. The dispersion is then filtered under a reduced pressure. The thus obtained cake on the filter is washed with tetrahydrofuran to prepare a wet cake of a titanylphthalocyanine crystal. The crystal is dried for 2 days at 70° C. under a reduced pressure of 5 mmHg. Thus, 8.5 parts of a titanylphthalocyanine crystal (Pigment 2) is prepared. No halogen-containing raw material is used for synthesizing the phthalocyanine crystal. The solid content of the wet cake is 15% by weight, and the weight ratio (S/C) of the solvent (S) used for crystal change to the wet cake (C) is 44.

A part of the aqueous paste of the titanylphthalocyanine pigment prepared above in Synthesis Example 1, which has not been subjected to a crystal change treatment, is diluted with ion-exchange water such that the resultant dispersion has a solid content of 1% by weight. The dispersion is placed on a copper net subjected to conductive treatment. The titanylphthalocyanine pigment is observed with a transmission electron microscope (H-9000NAR from Hitachi Ltd., hereinafter referred to as a TEM) of 75,000 power magnification to measure the average particle size of the titanylphthalocyanine pigment. The average particle diameter thereof is determined as follows.

The image of particles of the titanylphthalocyanine pigment in the TEM is photographed. Among the particles (needle form particles) of the titanylphthalocyanine pigment in the photograph, 30 particles are randomly selected to measure the lengths of the particles in the long axis direction of the particles. The lengths are arithmetically averaged to determine the average particle diameter of the titanylphthalocyanine pigment. As a result, it is confirmed that the titanylphthalocyanine pigment in the aqueous paste prepared in Pigment Synthesis Example 1 has an average primary particle diameter of 0.06 μm.

Similarly, each of the phthalocyanine crystals prepared in Pigment Synthesis Examples 1 and 2, which has been subjected to the crystal change treatment but is not filtered, is diluted with tetrahydrofuran such that the resultant dispersion has a solid content of 1% by weight. The average particle diameters of Pigments 1 and 2 are determined by the method mentioned above. The results are shown in Table 2. In this regard, the form of the crystals is not uniform and includes triangle forms, quadrangular forms, etc. Therefore, the maximum lengths of the diagonal lines of the particles are arithmetically averaged.

TABLE 2

| | Average particle diameter (μm) | Note |
|---|---|---|
| Pigment Synthesis Example 1 (Pigment 1) | 0.31 | Coarse particles having a particle diameter of from 0.3 to 0.4 μm are included. |
| Pigment Synthesis Example 2 (Pigment 2) | 0.12 | The particle diameters of the crystal are almost uniform. |

Table 2 shows that the Pigment 1 prepared in Pigment Preparation Example 1 not only has a large average particle size but also includes coarse particles. In contrast, the Pigment 2 prepared in Pigment Preparation Example 2 not only has a small average particle size but also has primary particles having almost same size.

Pigment Synthesis Example 3

A pigment is prepared in accordance with a method disclosed in Example 1 in Japanese Laid-Open Patent Publication No. 1-299874 (Japanese patent No. 2512081). Namely, the wet cake prepared in Pigment Synthesis Example 1 is dried and 1 g of the dried material is included in 50 g of polyethylene glycol. The mixture is dispersed by a sand mill for 1 hr with 100 g of glass beads. After the crystal conversion, the dispersed material is washed with a diluted sulfuric acid and a aqueous solution of ammonium hydroxide in this order and dried to prepare a pigment 3. The materials used in Pigment Synthesis Example 3 include no halogenated material.

Pigment Synthesis Example 4

A pigment is prepared in accordance with a method disclosed in Production Example 1 in Japanese Laid-Open Patent Publication No. 3-269064 (Japanese Patent No. 2584682). Namely, the wet cake prepared in Pigment Synthesis Example 1 is dried, and after 1 g of the dried material is stirred in a mixed solvent of 10 g of ion exchange water and 1 g of monochlorobenzene for 1 hr at 50° C., the mixture is washed with methanol and ion exchange water and dried to prepare a pigment 4. The materials used in Pigment Synthesis Example 4 include no halogenated material.

Pigment Synthesis Example 5

A pigment is prepared in accordance with a method disclosed in the production Example in Japanese Laid-Open Patent Publication No. 2-8256 (Japanese Patent Publication No. 7-91486) Namely, 9.8 g of phthalodinitrile and 75 ml of 1-chloronaphthalene are mixed and stirred, and a 2.2 ml of titanium tetrachloride is dropped in the mixture under a nitrogen gas stream. The mixture is gradually heated to have a temperature of 200° C. and stirred for 3 hrs while the reaction temperature is maintained at 200 to 220° C. Then, the mixture is cooled to have a temperature of 130° C. and filtered to prepare a powder. After the powder is washed to have a blue color with 1-chloronaphthalene, methanol for several times and hot water having a temperature of 80° C. for several times, the powder is dried to prepare a pigment 5. The materials used in Pigment Synthesis Example 5 include halogenated materials.

Pigment Synthesis Example 6

A pigment is prepared in accordance with a method disclosed in Synthesis Example 1 in Japanese Laid-Open Patent Publication No. 64-17066 (Japanese Patent Publication No. 7-97221). Namely, 5 parts of α-type TiOPc are subjected to a crystal conversion treatment by a sand grinder with 10 g of salt and 5 g of acetophenone at 100° C. for 10 hrs. The mixture is washed with ion exchange water and methanol and refined with an aqueous solution of a diluted sulfuric acid. Then, the mixture is washed with ion exchange water again not to have a acid content, and dried to prepare a pigment 6. The materials used in Pigment Synthesis Example 6 include halogenated materials.

Pigment Synthesis Example 7

A pigment is prepared in accordance with a method disclosed in Example 1 in Japanese Laid-Open Patent Publication No. 11-5919 (Japanese Patent No. 3003664). Namely, after 20.4 parts of o-phthalodinitrile and 7.6 parts of titanium tetrachloride are heated in 50 parts of quinoline at 200° C. for 2 hrs, the solvent is removed from the mixture by a steam distillation. The mixture is refined with a chloride aqueous solution having a concentration of 2% and a sodium hydroxide aqueous solution having a concentration of 2%. Then, the mixture is washed with methanol and N,N-dimethylformamide, and dried to prepare 21.3 parts of titanylphthalocyanine. 2 parts of the titanylphthalocyanine is gradually dissolved in 40 parts of sulfuric acid having a concentration of 98% and a temperature of 5° C., and the mixture is stirred for about 1 hr while the temperature of 5° C. is maintained. Then, the mixture is slowly included in 400 parts of iced water in which a sulfuric acid is mixed and stirred at a high speed, and a precipitated crystal is filtered. The crystal is washed with distilled water not to have an acid content to prepare a wet cake. The wet cake including a supposed content of 2 parts of phthalocyanine is stirred in 100 parts of tetrahydrofuran for about 5 hrs. The mixture is filtered, washed and dried to prepare a pigment 7. The materials used in Pigment Synthesis Example 7 include halogenated materials.

Pigment Synthesis Example 8

A pigment is prepared in accordance with a method disclosed in Synthesis Example 2 in Japanese Laid-Open Patent Publication No. 3-255456 (Japanese Patent No. 3005052). Namely, 10 parts of the wet cake prepared in Pigment Synthesis Example 1 are mixed with 15 parts of sodium chloride and 7 parts of diethyleneglycol, and the mixture is milled in an automatic mortar for 60 hrs upon application of heat of 80° C. Next, the mixture is sufficiently washed with water to completely remove the sodium chloride and diethyleneglycol included therein. After the mixture is dried under reduced pressure, 200 parts of cyclohexanone and a glass bead having a diameter of 1 mm are included therein, and the mixture is milled with a sand mill for 30 min to prepare a pigment 8. The materials used in Pigment Synthesis Example 8 include no halogenated material.

Pigment Synthesis Example 9

A pigment is prepared in accordance with a method disclosed in Japanese Laid-Open Patent Publication No. 8-110649. Namely, after 58 g of 1,3-diiminoisoindoline and 51 g of tetrabutoxytitanium are reacted in 300 ml of α-chloronaphthalene at 210° C. for 5 hrs, the reaction product is washed with α-chloronaphthalene and dimethylformamide (DMF) in this order. Then, the reaction product is further washed with hot DMF, hot water and methanol, and dried to prepare 50 g of titanylphthalocyanine. 4 g of titanylphthalocyanine are added to 400 g of sulfuric acid cooled to have a temperature of 0° C., and stirred therein for 1 hr while keeping the temperature of 0° C. The solution is added to a mixed liquid including 800 ml of water and 800 ml of toluene. After stirred for 2 hrs, the phthalocyanine crystal separated out is filtered out from the mixed liquid, and washed with methanol and water in this order. After the washing water is neutralized, the phthalocyanine crystal is filtered out from the washing water and dried to prepare 2.9 g of a titanylphthalocyanine crystal (Pigment 9). The materials used in Pigment Synthesis Example 9 include no halogenated material.

X-ray diffraction spectra of pigments prepared in Pigment Synthesis Examples 3 to 9 are measured in the same method in Pigment Synthesis Example 1 to find that they have the same spectra disclosed in respective publications. The X-ray diffraction spectrum of the pigment prepared in Pigment Synthesis Example 2 is same as that of the pigment prepared in Pigment Synthesis Example 1. Table 3 shows the X-ray diffraction spectra and peak positions of the respective pigments.

TABLE 3

| Pigment | Max. Peak | Min. Peak | 9.4° Peak | 9.6° Peak | Peak from 7.4 to 9.4° | 24.0° Peak | 26.3° Peak |
|---|---|---|---|---|---|---|---|
| Pigment 1 | 27.2° | 7.3° | Yes | Yes | No | Yes | No |
| Pigment 2 | 27.2° | 7.3° | Yes | Yes | No | Yes | No |
| Pigment 3 | 27.2° | 7.3° | No | No | No | Yes | No |
| Pigment 4 | 27.2° | 9.6° | Yes | Yes | No | Yes | No |
| Pigment 5 | 27.2° | 7.4° | No | Yes | No | No | No |
| Pigment 6 | 27.2° | 7.3° | Yes | Yes | Yes (7.5°) | Yes | No |
| Pigment 7 | 27.2° | 7.5° | No | Yes | Yes (7.5°) | Yes | No |
| Pigment 8 | 27.2° | 7.4° | No | No | Yes (9.2°) | Yes | Yes |
| Pigment 9 | 27.2° | 7.3° | Yes | Yes | No | Yes | No |

Dispersion Preparation Example 1

| Formula of dispersion | |
|---|---|
| Titanylphthalocyanine (Pigment 1) | 15 |
| Polyvinyl butyral (BX-1 from Sekisui Chemical Co., Ltd.) | 10 |
| 2-butanone | 280 |

At first, the polyvinyl butyral resin is dissolved in the solvent. The solution is mixed with phthalocyanine crystal and the mixture is subjected to a dispersion treatment for 30 min at 1,200 rpm using a bead mill including PSZ balls having a diameter of 0.5 mm to prepare a dispersion 1 (CGL coating liquid 1).

Dispersion Preparation Examples 2 to 9

The procedure for preparation of dispersion 1 is repeated to prepare dispersion 2 to 9 except for replacing the Pigment 1 with the Pigments 2 to 9 (CGL coating liquids 2 to 9).

Dispersion Preparation Example 10

The procedure for preparation of dispersion 1 is repeated to prepare a dispersion 10 (CGL coating liquid 10) except for being filtered with a cotton wind cartridge filter (TCW-1-CS from Advantech Co., Ltd.) having an effective pore diameter of 1 μm under pressure using a pump.

Dispersion Preparation Example 11

The procedure for preparation of dispersion 10 is repeated to prepare a dispersion 11 (CGL coating liquid 11) except for being filtered with a cotton wind cartridge filter (TCW-3-CS from Advantech Co., Ltd.) having an effective pore diameter of 3 μm under pressure using a pump.

Dispersion Preparation Example 12

The procedure for preparation of dispersion 10 is repeated to prepare a dispersion 12 (CGL coating liquid 12) except for being filtered with a cotton wind cartridge filter (TCW-5-CS from Advantech Co., Ltd.) having an effective pore diameter of 5 μm under pressure using a pump.

Dispersion Preparation Example 13

The procedure for preparation of dispersion 1 is repeated to prepare dispersion 13 (CGL coating liquid 13) except for subjecting the mixture to the dispersion treatment for 20 min at 1,000 rpm.

Dispersion Preparation Example 14

The procedure for preparation of dispersion 13 is repeated to prepare a dispersion 14 (CGL coating liquid 14) except for being filtered with a cotton wind cartridge filter (TCW-1-CS from Advantech Co., Ltd.) having an effective pore diameter of 1 μm under pressure using a pump.

The particle diameter distributions of the thus prepared dispersions 1 to 13 are measured with a particle diameter measuring instrument (CAPA-700 from Horiba Ltd.). The results are shown in Table 4.

TABLE 4

| | Average particle diameter (μm) | Standard deviation of particle diameter (μm) |
|---|---|---|
| CGL coating liquid 1 | 0.29 | 0.18 |
| CGL coating liquid 2 | 0.19 | 0.13 |
| CGL coating liquid 3 | 0.28 | 0.19 |
| CGL coating liquid 4 | 0.31 | 0.20 |
| CGL coating liquid 5 | 0.30 | 0.20 |
| CGL coating liquid 6 | 0.27 | 0.19 |
| CGL coating liquid 7 | 0.29 | 0.20 |
| CGL coating liquid 8 | 0.27 | 0.18 |
| CGL coating liquid 9 | 0.26 | 0.19 |

TABLE 4-continued

| | Average particle diameter (μm) | Standard deviation of particle diameter (μm) |
|---|---|---|
| CGL coating liquid 10 | 0.22 | 0.16 |
| CGL coating liquid 11 | 0.24 | 0.17 |
| CGL coating liquid 12 | 0.28 | 0.18 |
| CGL coating liquid 13 | 0.33 | 0.23 |

The CGL coating liquid 14 can not be measured because the filter is clogged during filtering of the liquid.

Dispersion Preparation Example 15

The following materials are dispersed by a ball mill for 73 hrs to prepare a dispersion 15 (CGL coating liquid 15).

| | |
|---|---|
| Butyral resin<br>S-lec BMS from Sekisui Chemical Co., Ltd. | 5 |
| Trisazo pigment having the following formula: | 15 |

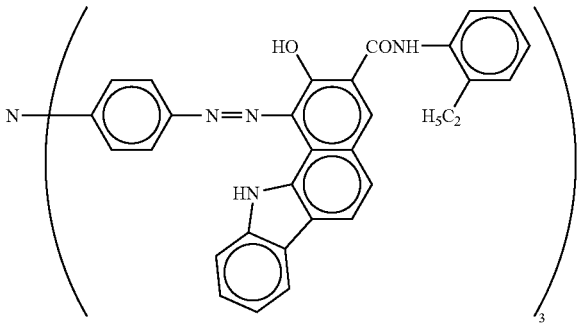

| | |
|---|---|
| cyclohexanone | 700 |
| 2-butanone | 300 |

Next, photoreceptors are prepared using the above-mentioned intermediate layer coating liquid. All the intermediate layer coating liquids are stored for 3 months at 22±1° C.

Photoreceptor Preparation Example 1

The intermediate layer coating liquid 6, the CGL coating liquid 2 and a CTL coating liquid having the following formulation are coated and dried in this order on an aluminium cylinder having a diameter of 60 mm (JIS1050) as a substrate to prepare a photoreceptor 1 having an intermediate layer 0.7 μm thick, a CGL 0.3 μm thick and a CTL 25 μm thick.

CTL Coating Liquid

| | |
|---|---|
| Polycarbonate<br>(TS2050 from Teijin Chemicals Ltd.) | 10 |
| CTM having the following formula | 7 |

-continued

| | |
|---|---|
| 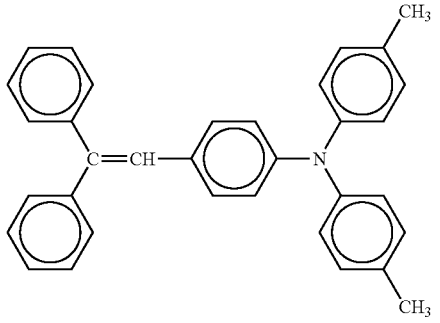 | |
| Tetrahydrofuran | 80 |

Photoreceptor Preparation Example 2

The procedure for preparation of the photoreceptor 1 in Photoreceptor Preparation Example 1 is repeated to prepare a photoreceptor 2 except for replacing the intermediate layer coating liquid 6 with the intermediate layer coating liquid 1.

Photoreceptor Preparation Example 3

The procedure for preparation of the photoreceptor 1 in Photoreceptor Preparation Example 1 is repeated to prepare a photoreceptor 3 except for replacing the intermediate layer coating liquid 6 with the intermediate layer coating liquid 2.

Photoreceptor Preparation Example 4

The procedure for preparation of the photoreceptor 1 in Photoreceptor Preparation Example 1 is repeated to prepare a photoreceptor 4 except for replacing the intermediate layer coating liquid 6 with the intermediate layer coating liquid 3.

Photoreceptor Preparation Example 5

The procedure for preparation of the photoreceptor 1 in Photoreceptor Preparation Example 1 is repeated to prepare a photoreceptor 5 except for replacing the intermediate layer coating liquid 6 with the intermediate layer coating liquid 4.

Photoreceptor Preparation Example 6

The procedure for preparation of the photoreceptor 1 in Photoreceptor Preparation Example 1 is repeated to prepare a photoreceptor 6 except for replacing the intermediate layer coating liquid 6 with the intermediate layer coating liquid 5.

Photoreceptor Preparation Example 7

The procedure for preparation of the photoreceptor 1 in Photoreceptor Preparation Example 1 is repeated to prepare a photoreceptor 7 except for replacing the intermediate layer coating liquid 6 with the intermediate layer coating liquid 7.

Photoreceptor Preparation Example 8

The procedure for preparation of the photoreceptor 1 in Photoreceptor Preparation Example 1 is repeated to prepare a photoreceptor 8 except for replacing the intermediate layer coating liquid 6 with the intermediate layer coating liquid 8.

Photoreceptor Preparation Example 9

The procedure for preparation of the photoreceptor 1 in Photoreceptor Preparation Example 1 is repeated to prepare a photoreceptor 9 except for replacing the intermediate layer coating liquid 6 with the intermediate layer coating liquid 9.

Photoreceptor Preparation Example 10

The procedure for preparation of the photoreceptor 1 in Photoreceptor Preparation Example 1 is repeated to prepare a photoreceptor 10 except for replacing the intermediate layer coating liquid 6 with the intermediate layer coating liquid 10.

Photoreceptor Preparation Example 11

The procedure for preparation of the photoreceptor 1 in Photoreceptor Preparation Example 1 is repeated to prepare a photoreceptor 11 except for replacing the intermediate layer coating liquid 6 with the intermediate layer coating liquid 11.

Photoreceptor Preparation Example 12

The procedure for preparation of the photoreceptor 1 in Photoreceptor Preparation Example 1 is repeated to prepare a photoreceptor 12 except for replacing the intermediate layer coating liquid 6 with the intermediate layer coating liquid 12.

Photoreceptor Preparation Example 13

The procedure for preparation of the photoreceptor 1 in Photoreceptor Preparation Example 1 is repeated to prepare a photoreceptor 13 except for replacing the intermediate layer coating liquid 6 with the intermediate layer coating liquid 13.

Photoreceptor Preparation Example 14

The procedure for preparation of the photoreceptor 1 in Photoreceptor Preparation Example 1 is repeated to prepare a photoreceptor 14 except for replacing the intermediate layer coating liquid 6 with the intermediate layer coating liquid 14.

Photoreceptor Preparation Example 15

The procedure for preparation of the photoreceptor 1 in Photoreceptor Preparation Example 1 is repeated to prepare a photoreceptor 15 except for replacing the intermediate layer coating liquid 6 with the intermediate layer coating liquid 15.

Photoreceptor Preparation Example 16

The procedure for preparation of the photoreceptor 1 in Photoreceptor Preparation Example 1 is repeated to prepare a photoreceptor 16 except for coating the intermediate layer coating liquid 6 as a charge blocking layer 0.7 μm thick and an antimoire layer 3.5 μm thick, having the following formulation in this order on the substrate.

Antimoire Layer Coating Liquid

| | |
|---|---|
| Titanium oxide<br>(CR-EL from Ishihara Sangyo Kaisha, ltd.) | 70 |
| Alkyd resin<br>(Bekkolite M6401-50-S (solid content 50%)<br>from Dainippon Ink And Chemicals, inc.) | 14 |
| Melamine resin<br>(Super Bekkamin G-821-60 (solid content 60%)<br>from Dainippon Ink And Chemicals, inc.) | 10 |
| 2-butanone | 100 |

Photoreceptor Preparation Example 17

The procedure for preparation of the photoreceptor 16 in Photoreceptor Preparation Example 16 is repeated to prepare a photoreceptor 17 except for changing the thickness of the charge blocking layer to 1.3 μm.

Photoreceptor Preparation Example 18

The procedure for preparation of the photoreceptor 16 in Photoreceptor Preparation Example 16 is repeated to prepare a photoreceptor 18 except for changing the thickness of the charge blocking layer to 2.1 μm.

Photoreceptor Preparation Example 19

The procedure for preparation of the photoreceptor 16 in Photoreceptor Preparation Example 16 is repeated to prepare a photoreceptor 19 except for changing the thickness of the charge blocking layer to 0.35 μm.

Photoreceptor Preparation Example 20

The procedure for preparation of the photoreceptor 16 in Photoreceptor Preparation Example 16 is repeated to prepare a photoreceptor 20 except for changing the order of the charge blocking layer and the antimoire layer.

Examples 1 to 17 and Comparative Examples 1 to 3

Each of the thus prepared photoreceptors 1 to 20 are installed in the electrophotographic image forming apparatus in FIG. 12, which uses a LD having a wavelength of 780 nm as an imagewise light irradiator (with a polygon mirror), a scorotron charger as a charger and a transfer belt as a transfer member to continuously produce 100,000 images of a chart having a written part of 6% under the following charging conditions. Then, the irradiated part potential (VL) of the photoreceptor after producing a solid image is measured by a surface potential meter Trek Model 344. Background fouling is evaluated and classified to four grades, i.e., ◎ represents very good, ○ represents good, Δ represents slightly poor and X represents badly poor.

This is performed under environments of 22° C. and 55% RH (Table 5-1), 10° C. and 15% RH (Table 5-2), and 30° C. and 90% RH (Table 5-2). The evaluation results are shown in Tables 5-1 and 5-2.

Charging Conditions

DC bias: −900 V

AC bias: 2.0 kV (peak to peak)

Frequency: 2.0 kHz

In addition, other abnormal images and coating irregularity of the intermediate layer are also evaluated as shown in Table 5-1. Almost no coating irregularity is ○, slight coating irregularity is Δ and serious coating irregularity is X.

TABLE 5-1

| | | Intermediate layer coating liquid | Coating irregularity | Background foiling | Vl (−V) | Remarks |
|---|---|---|---|---|---|---|
| Example 1 | Photoreceptor 1 | Liquid 6 | ○ | ◎ | 165 | |
| Example 2 | Photoreceptor 2 | Liquid 1 | ○ | Δ | 150 | |
| Example 3 | Photoreceptor 3 | Liquid 2 | ○ | Δ | 160 | |
| Example 4 | Photoreceptor 4 | Liquid 3 | ○ | Δ | 170 | |
| Example 5 | Photoreceptor 5 | Liquid 4 | ○ | ○ | 140 | Slight black spots |
| Example 6 | Photoreceptor 6 | Liquid 5 | ○ | ○ | 145 | |
| Example 7 | Photoreceptor 7 | Liquid 7 | ○ | ◎ | 150 | |
| Example 8 | Photoreceptor 8 | Liquid 8 | ○ | ◎ | 170 | |
| Example 9 | Photoreceptor 9 | Liquid 9 | ○ | ○ | 190 | |
| Example 10 | Photoreceptor 10 | Liquid 10 | ○ | ◎ | 160 | |
| Example 11 | Photoreceptor 11 | Liquid 11 | ○ | Δ | 175 | |
| Example 12 | Photoreceptor 12 | Liquid 12 | Δ | ◎ | 185 | |
| Example 13 | Photoreceptor 16 | Liquid 6 | ○ | ◎ | 190 | |
| Example 14 | Photoreceptor 17 | Liquid 6 | ○ | ◎ | 205 | |
| Example 15 | Photoreceptor 18 | Liquid 6 | ○ | ◎ | 220 | |
| Example 16 | Photoreceptor 19 | Liquid 6 | ○ | Δ | 180 | |
| Example 17 | Photoreceptor 20 | Liquid 6 | ○ | ◎ | 210 | |
| Comparative Example 1 | Photoreceptor 13 | Liquid 13 | ○ | X | 155 | |
| Comparative Example 2 | Photoreceptor 14 | Liquid 14 | X | ◎ | 250 | |
| Comparative Example 3 | Photoreceptor 15 | Liquid 15 | X | Δ | 200 | Black spots |

TABLE 5-2

| | | Intermediate layer coating liquid | 10° C. and 15% RH | | 30° C. and 90% RH | |
|---|---|---|---|---|---|---|
| | | | Background foiling | Vl (−V) | Background foiling | Vl (−V) |
| Example 1 | Photoreceptor 1 | Liquid 6 | ◎ | 180 | ○ | 170 |
| Example 2 | Photoreceptor 2 | Liquid 1 | Δ | 175 | Δ | 150 |
| Example 3 | Photoreceptor 3 | Liquid 2 | ○ | 185 | Δ | 165 |

TABLE 5-2-continued

| | | Intermediate layer coating liquid | 10° C. and 15% RH Background foiling | 10° C. and 15% RH Vl (−V) | 30° C. and 90% RH Background foiling | 30° C. and 90% RH Vl (−V) |
|---|---|---|---|---|---|---|
| Example 4 | Photoreceptor 4 | Liquid 3 | ○ | 190 | Δ | 170 |
| Example 5 | Photoreceptor 5 | Liquid 4 | ○ | 165 | ○ | 145 |
| Example 6 | Photoreceptor 6 | Liquid 5 | ○ | 165 | ○ | 145 |
| Example 7 | Photoreceptor 7 | Liquid 7 | ◎ | 170 | ○ | 155 |
| Example 8 | Photoreceptor 8 | Liquid 8 | ◎ | 190 | ○ | 175 |
| Example 9 | Photoreceptor 9 | Liquid 9 | ◎ | 210 | Δ | 190 |
| Example 10 | Photoreceptor 10 | Liquid 10 | ◎ | 190 | ○ | 165 |
| Example 11 | Photoreceptor 11 | Liquid 11 | Δ | 195 | Δ | 175 |
| Example 12 | Photoreceptor 12 | Liquid 12 | ◎ | 200 | ○ | 185 |
| Example 13 | Photoreceptor 16 | Liquid 6 | ◎ | 205 | ○ | 195 |
| Example 14 | Photoreceptor 17 | Liquid 6 | ◎ | 220 | ○ | 205 |
| Example 15 | Photoreceptor 18 | Liquid 6 | ◎ | 235 | ◎ | 220 |
| Example 16 | Photoreceptor 19 | Liquid 6 | Δ | 200 | Δ | 185 |
| Example 17 | Photoreceptor 20 | Liquid 6 | ◎ | 220 | ◎ | 215 |
| Comparative Example 1 | Photoreceptor 13 | Liquid 13 | X | 180 | X | 160 |
| Comparative Example 2 | Photoreceptor 14 | Liquid 14 | ◎ | 290 | ○ | 255 |
| Comparative Example 3 | Photoreceptor 15 | Liquid 15 | Δ | 250 | X | 200 |

Tables 5-1 to 5-2 shows that the photoreceptor of the present invention, having an intermediate layer comprising a N-alkoxymethylated nylon comprising a component having a molecular weight not greater than 5,000 in an amount of from 3 to 10% by weight stably produces quality images with less residual potential and background fouling, regardless of the environment.

Photoreceptor Preparation Example 18

The procedure for preparation of the photoreceptor 1 in Photoreceptor Preparation Example 1 is repeated to prepare a photoreceptor 21 except for replacing the CGL coating liquid 2 with the CGL coating liquid 1.

Photoreceptor Preparation Example 19

The procedure for preparation of the photoreceptor 1 in Photoreceptor Preparation Example 1 is repeated to prepare a photoreceptor 22 except for replacing the CGL coating liquid 2 with the CGL coating liquid 3.

Photoreceptor Preparation Example 20

The procedure for preparation of the photoreceptor 1 in Photoreceptor Preparation Example 1 is repeated to prepare a photoreceptor 23 except for replacing the CGL coating liquid 2 with the CGL coating liquid 4.

Photoreceptor Preparation Example 21

The procedure for preparation of the photoreceptor 1 in Photoreceptor Preparation Example 1 is repeated to prepare a photoreceptor 24 except for replacing the CGL coating liquid 2 with the CGL coating liquid 5.

Photoreceptor Preparation Example 22

The procedure for preparation of the photoreceptor 1 in Photoreceptor Preparation Example 1 is repeated to prepare a photoreceptor 25 except for replacing the CGL coating liquid 2 with the CGL coating liquid 6.

Photoreceptor Preparation Example 23

The procedure for preparation of the photoreceptor 1 in Photoreceptor Preparation Example 1 is repeated to prepare a photoreceptor 26 except for replacing the CGL coating liquid 2 with the CGL coating liquid 7.

Photoreceptor Preparation Example 24

The procedure for preparation of the photoreceptor 1 in Photoreceptor Preparation Example 1 is repeated to prepare a photoreceptor 27 except for replacing the CGL coating liquid 2 with the CGL coating liquid 8.

Photoreceptor Preparation Example 25

The procedure for preparation of the photoreceptor 1 in Photoreceptor Preparation Example 1 is repeated to prepare a photoreceptor 28 except for replacing the CGL coating liquid 2 with the CGL coating liquid 9.

Photoreceptor Preparation Example 26

The procedure for preparation of the photoreceptor 1 in Photoreceptor Preparation Example 1 is repeated to prepare a photoreceptor 29 except for replacing the CGL coating liquid 2 with the CGL coating liquid 10.

Photoreceptor Preparation Example 27

The procedure for preparation of the photoreceptor 1 in Photoreceptor Preparation Example 1 is repeated to prepare a photoreceptor 30 except for replacing the CGL coating liquid 2 with the CGL coating liquid 11.

Photoreceptor Preparation Example 28

The procedure for preparation of the photoreceptor 1 in Photoreceptor Preparation Example 1 is repeated to prepare a photoreceptor 31 except for replacing the CGL coating liquid 2 with the CGL coating liquid 12.

Photoreceptor Preparation Example 29

The procedure for preparation of the photoreceptor 1 in Photoreceptor Preparation Example 1 is repeated to prepare a photoreceptor 32 except for replacing the CGL coating liquid 2 with the CGL coating liquid 13.

Photoreceptor Preparation Example 30

The procedure for preparation of the photoreceptor 1 in Photoreceptor Preparation Example 1 is repeated to prepare a photoreceptor 33 except for replacing the CGL coating liquid 2 with the CGL coating liquid 15.

Examples 18 to 30

Each of the thus prepared photoreceptors 1 and 21 to 33 are installed in the process cartridge in FIG. 14, and the process cartridge is installed in the electrophotographic image forming apparatus in FIG. 12, which uses a LD having a wavelength of 780 nm as an imagewise light irradiator (with a polygon mirror), a scorotron charger as a charger and a transfer belt as a transfer member to continuously produce 100,000 images of a chart having a written part of 6% with a DC bias of −1,300 V. Then, the irradiated part potential (VL) of the photoreceptor after producing a solid image is measured by a surface potential meter Trek Model 344. This is performed under environments of 22° C. and 55% RH. The background fouling is evaluated and classified to four grades, i.e., ◎ represents very good, ○ represents good, Δ represents slightly poor and X represents badly poor. The evaluation results are shown in Table 6.

TABLE 6

| | Photoreceptor | CGL coating liquid | Background fouling | VL (v) |
|---|---|---|---|---|
| Example 1 | Photoreceptor 1 | Liquid 2 | ◎ | 150 |
| Example 18 | Photoreceptor 21 | Liquid 1 | ○ | 160 |
| Example 19 | Photoreceptor 22 | Liquid 3 | Δ | 155 |
| Example 20 | Photoreceptor 23 | Liquid 4 | ○ | 165 |

TABLE 6-continued

| | Photoreceptor | CGL coating liquid | Background fouling | VL (v) |
|---|---|---|---|---|
| Example 21 | Photoreceptor 24 | Liquid 5 | Δ | 155 |
| Example 22 | Photoreceptor 25 | Liquid 6 | Δ | 160 |
| Example 23 | Photoreceptor 26 | Liquid 7 | ○ | 175 |
| Example 24 | Photoreceptor 27 | Liquid 8 | ◎ | 170 |
| Example 25 | Photoreceptor 28 | Liquid 9 | ○ | 165 |
| Example 26 | Photoreceptor 29 | Liquid 10 | Δ | 155 |
| Example 27 | Photoreceptor 30 | Liquid 11 | ○ | 160 |
| Example 28 | Photoreceptor 31 | Liquid 12 | ◎ | 170 |
| Example 29 | Photoreceptor 32 | Liquid 13 | Δ | 175 |
| Example 30 | Photoreceptor 33 | Liquid 14 | Δ | 200 |

As Table 6 shows, regardless of the materials used in the CGL, the photoreceptor having the intermediate layer of the present invention is practically usable even after the intermediate layer is stored for long periods.

However, the photoreceptor 24 having a CGL including an azo pigment produces more residual potential and lower image density after repeatedly used than the other photoreceptors, each of which has a CGL including a titanylphthalocyanine pigment.

In addition, even when the titanylphthalocyanine is used, a specific crystal form thereof, i.e., the titanylphthalocyanine crystal form prepared in Pigment Synthesis Example 1, has good properties.

Further, even when the titanylphthalocyanine crystal form prepared in Pigment Synthesis Example 1, those having a primary particle size not greater than 0.25 μm, i.e., the photoreceptors 1, 20 and 21 reduce background fouling. As a method of controlling the primary particle size so as not to be greater than 0.25 μm, either a method of downsizing the particle size during synthesis or a method of removing coarse particles after dispersion is proved to be effective.

Photoreceptor Preparation Example 31

The procedure for preparation of the photoreceptor 1 in Photoreceptor Preparation Example 1 is repeated to prepare a photoreceptor 34 except for changing the CTL coating liquid to a CTL coating liquid having the following formulation.

CTL Coating Liquid

| | |
|---|---|
| Polymer CTM having the following formula and approximate weight-average molecular weight of 135,000 | 10 |

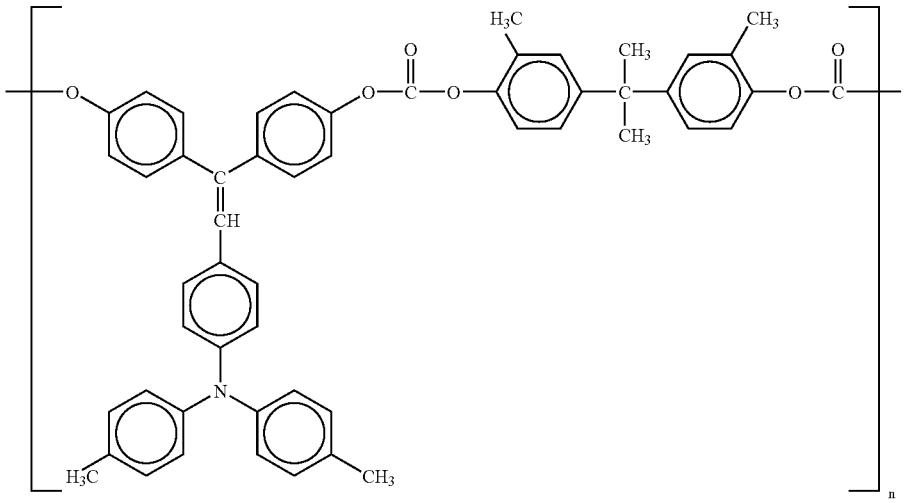

| | |
|---|---|
| Additive having the following formula | 0.5 |

-continued

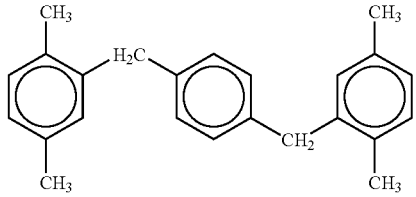

| | |
|---|---|
| Methylene chloride | 100 |

Photoreceptor Preparation Example 32

The procedure for preparation of the photoreceptor 1 in Photoreceptor Preparation Example 1 is repeated to prepare a photoreceptor 35 except for changing the thickness of the CTL to 18 μm, and coating and dying a protection layer coating liquid having the following formulation on the CTL to form a protection layer 5 μm thick thereon.

Protection Layer Coating Liquid

| | |
|---|---|
| Polycarbonate (TS2050 from Teijin Chemicals Ltd.) | 10 |
| CTM having the following formula | 7 |

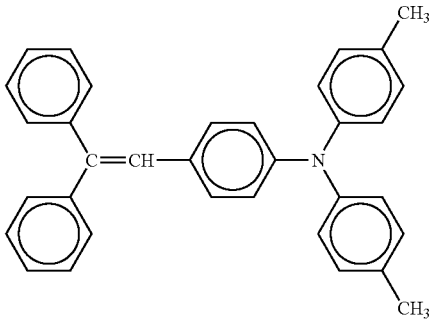

| | |
|---|---|
| Particulate alumina having a resistivity of $2.5 \times 10^{12}$ Ω · cm and an average primary particle diameter of 0.4 μm | 4 |
| Cyclohexanone | 500 |
| Tetrahydrofuran | 150 |

Photoreceptor Production Example 33

The procedure for preparation of the photoreceptor 32 in Photoreceptor Preparation Example 32 is repeated to prepare a photoreceptor 36 except for replacing the particulate alumina to particulate titanium oxide having a resistivity of $1.5\times10^{10}$ Ω·cm and an average primary particle diameter of 0.5 μm.

Photoreceptor Production Example 34

The procedure for preparation of the photoreceptor 33 in Photoreceptor Preparation Example 33 is repeated to prepare a photoreceptor 37 except for replacing the particulate alumina to tin-stibium oxide powder having a resistivity of $10^6$ Ω·cm and an average primary particle diameter of 0.4 μm.

Photoreceptor Preparation Example 35

The procedure for preparation of the photoreceptor 1 in Photoreceptor Preparation Example 1 is repeated to prepare a photoreceptor 38 except for changing the thickness of the CTL to 18 μm, and coating and dying a protection layer coating liquid having the following formulation on the CTL to form a protection layer 5 μm thick thereon.

Protection Layer Coating Liquid

| | |
|---|---|
| Methyltrimethoxysilane | 100 |
| 3% acetic acid | 20 |
| CTM having the following formula | 35 |

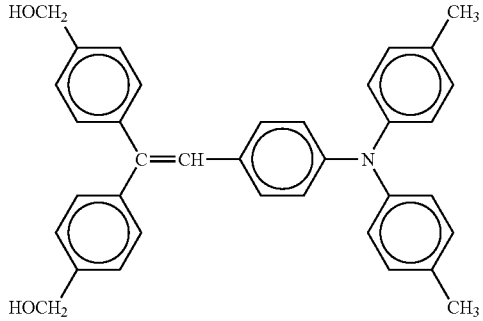

| | |
|---|---|
| Antioxidant (SANOL LS2626 from Sankyo Lifetech Co., Ltd.) | 1 |
| Crosslinking agent (dibutyltin acetate) | 1 |
| 2-Propanol | 200 |

Photoreceptor Preparation Example 36

The procedure for preparation of the photoreceptor 6 in Photoreceptor Preparation Example 1 is repeated to prepare a photoreceptor 39 except for changing the thickness of the CTL to 18 μm, and spray-coating a protection layer coating liquid having the following formulation on the CTL, naturally drying the liquid for 20 min, and irradiating the coated layer under the following conditions so as to be hardened to form a protection layer 5 μm thick thereon.

Protection Layer Coating Liquid

| | |
|---|---|
| Tri- or more-functional radical polymerizable monomer having no charge transport structure (trimethylolpropane triacrylate, KAYARAD TMPTA from Nippon Kayaku Co., Ltd., having a molecular weight (M) of 296, three functional groups (F) and ration (M/F) of 99) | 10 |
| Monofunctional radical polymerizable monomer having charge transport structure and the following formula: | 10 |

-continued

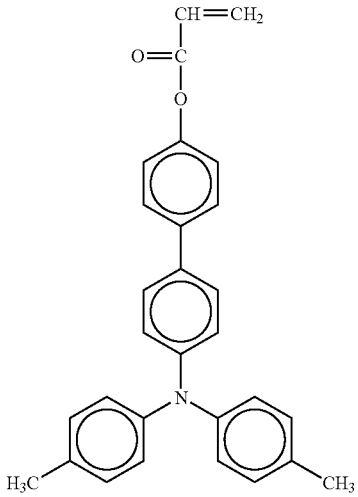

| | |
|---|---|
| Photopolymerization initiator (1-hydroxycycolhexyl-phenyl-ketone, IRGACURE 184 from Ciba Specialty Chemicals) | 1 |
| Tetrahydrofuran | 100 |

Irradiating Conditions
Metal halide lamp: 160 W/cm
Irradiation distance: 120 mm
Light intensity: 500 mW/cm$^2$
Irradiation time: 60 sec Examples 31 to 36

Each of the thus prepared photoreceptors 1 and 34 to 39 is installed in the electrophotographic image forming apparatus in FIG. 12, which uses a LD having a wavelength of 780 nm as an imagewise light irradiator (with a polygon mirror), a scorotron charger as a charger and a transfer belt as a transfer member to continuously produce 200,000 images of a chart having a written part of 6% under the following charging conditions. Then, the irradiated part potential (VL) of the photoreceptor after producing a solid image is measured by a surface potential meter Trek Model 344. This is performed under environments of 22° C. and 55% RH. The background fouling was evaluated and classified to four grades, i.e., ◎ represents very good, ○ represents good, Δ represents slightly poor and X represents badly poor. In addition, the abraded quantity of each of the photosensitive layer (or protection layer) after 200,00 images are produced is measured. The evaluation results are shown in Table 7.

Charging Conditions
DC bias: −900 V
AC bias: 2.0 kV (peak to peak)
Frequency: 2.0 kHz

TABLE 7

| | Photoreceptor | Background fouling | VL (V) | Abraded quantity (μm) |
|---|---|---|---|---|
| Example 1 | Photoreceptor 1 | ○ | 170 | 5.9 |
| Example 31 | Photoreceptor 34 | ◎ | 180 | 3.6 |
| Example 32 | Photoreceptor 35 | ◎ | 185 | 2.8 |
| Example 33 | Photoreceptor 36 | ◎ | 190 | 2.5 |
| Example 34 | Photoreceptor 37 | ◎ | 200 | 2.4 |
| Example 35 | Photoreceptor 38 | ◎ | 185 | 1.8 |
| Example 36 | Photoreceptor 39 | ◎ | 215 | 1.0 |

Photoreceptor Preparation Example 37

The procedure for preparation of the photoreceptor 1 in Photoreceptor Preparation Example 1 is repeated to prepare a photoreceptor 40 except for replacing the substrate with an aluminum cylinder having a diameter of 30 mm (JIS1050).

Photoreceptor Preparation Example 38

The procedure for preparation of the photoreceptor 2 in Photoreceptor Preparation Example 2 is repeated to prepare a photoreceptor 41 except for replacing the substrate with an aluminum cylinder having a diameter of 30 mm (JIS1050).

Photoreceptor Preparation Example 39

The procedure for preparation of the photoreceptor 3 in Photoreceptor Preparation Example 3 is repeated to prepare a photoreceptor 42 except for replacing the substrate with an aluminum cylinder having a diameter of 30 mm (JIS1050).

Photoreceptor Preparation Example 40

The procedure for preparation of the photoreceptor 4 in Photoreceptor Preparation Example 4 is repeated to prepare a photoreceptor 43 except for replacing the substrate with an aluminum cylinder having a diameter of 30 mm (JIS1050).

Photoreceptor Preparation Example 41

The procedure for preparation of the photoreceptor 5 in Photoreceptor Preparation Example 5 is repeated to prepare a photoreceptor 44 except for replacing the substrate with an aluminum cylinder having a diameter of 30 mm (JIS1050).

Photoreceptor Preparation Example 42

The procedure for preparation of the photoreceptor 13 in Photoreceptor Preparation Example 13 is repeated to prepare a photoreceptor 45 except for replacing the substrate with an aluminum cylinder having a diameter of 30 mm (JIS1050).

Photoreceptor Preparation Example 43

The procedure for preparation of the photoreceptor 14 in Photoreceptor Preparation Example 14 is repeated to prepare a photoreceptor 46 except for replacing the substrate with an aluminum cylinder having a diameter of 30 mm (JIS1050).

Photoreceptor Preparation Example 44

The procedure for preparation of the photoreceptor 15 in Photoreceptor Preparation Example 15 is repeated to prepare a photoreceptor 47 except for replacing the substrate with an aluminum cylinder having a diameter of 30 mm (JIS1050).

Examples 37 to 41 and Comparative Examples 4 to 6

Each four of the thus prepared photoreceptors 40 to 47 are installed in the process cartridges in FIG. 14, and the process cartridges are further installed in tandem-type full color image forming apparatus in FIG. 13, which uses a LD having a wavelength of 780 nm as an imagewise light irradiator (with a polygon mirror) and a charger located adjacent to the photoreceptor, which is a charging roller having a wound insulative tape 50 μm thick at both ends thereof. The charging conditions are as follows:
DC bias: −900 V
AC bias: 1.9 kV (peak to peak)
Frequency: 1.0 kHz Developing bias: −650 V.

The process cartridges including each four of the photoreceptors and each four color developers are installed in cyan, magenta, yellow and black stations respectively. Totally 80,000 images are produced under environments of 28° C. and 75% RH to be evaluated.

The background fouling is evaluated and classified to four grades, i.e., ◎ represents very good, ○ represents good, Δ represents slightly poor and X represents badly poor. The evaluation results are shown in Table 8.

TABLE 8

| | Photoreceptor | Background fouling | VL(−V) |
|---|---|---|---|
| Example 37 | Photoreceptor 40 | ◎ | 160 |
| Example 38 | Photoreceptor 41 | ○ | 145 |
| Example 39 | Photoreceptor 42 | ○ | 155 |
| Example 40 | Photoreceptor 43 | ○ | 165 |
| Example 41 | Photoreceptor 44 | Δ | 135 |
| Comparative Example 4 | Photoreceptor 45 | X | 170 |
| Comparative Example 5 | Photoreceptor 46 | ○ | 250 |
| Comparative Example 6 | Photoreceptor 47 | X | 210 |

As Table 8 shows, the photoreceptor having the intermediate layer of the present invention produces less background fouling even when repeatedly used in a full-color image forming apparatus.

Finally, whether the minimum diffraction peak at a lowest Bragg (2θ) angle of 7.3° of the titanylphthalocyanine crystal of the present invention is different from peaks at 7.5° of known materials will be verified.

Pigment Synthesis Example 10

The procedure for preparation of the titanylphthalocyanine crystal in Pigment Synthesis Example 1 are repeated to prepare a titanylphthalocyanine crystal except for changing the crystal conversion solvent from methylene chloride to 2-butanone.

Figure 17:
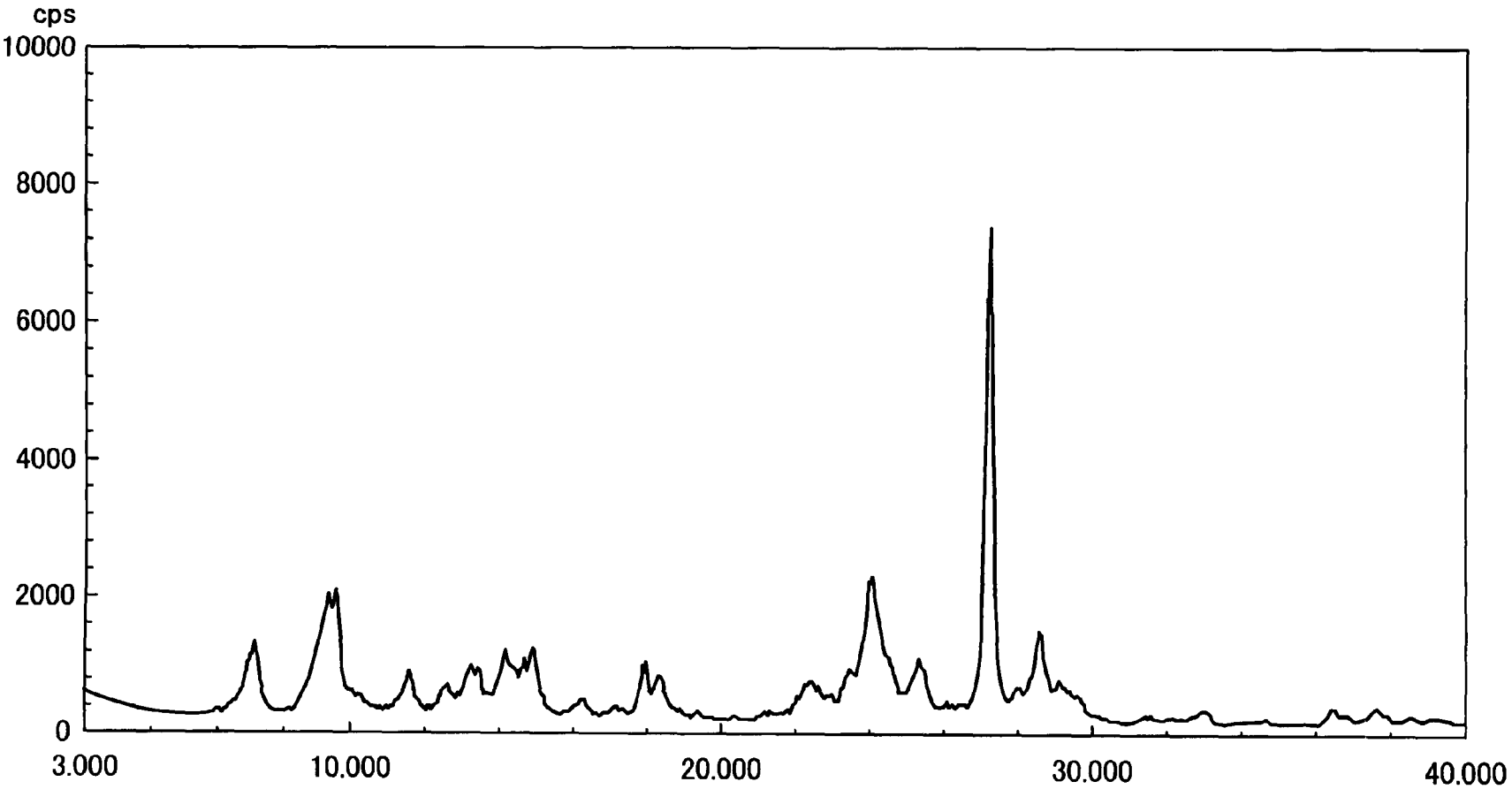
FIG. 17 is an X-ray diffraction spectrum of the titanylphthalocyanine crystal prepared in Synthesis Example 10.

A XD-spectrum of the titanylphthalocyanine crystal is measured as it was in Pigment Synthesis Example 1, which is shown in FIG. 17. FIG. 17 shows that the minimum diffraction peak in the XD-spectrum of the titanylphthalocyanine crystal is present at 7.5°, which is different from that (7.3°) of the titanylphthalocyanine crystal prepared in Pigment Synthesis Example 1.

Measurement Example 1

Three % by weight of a pigment prepared by a method disclosed in Japanese Laid-Open Patent Publication No. 61-239248 (having a maximum diffraction peak at 7.5°) is included in the pigment prepared in Synthesis Example 1 (having a minimum diffraction peak at 7.3°). The mixture is mixed in a mortar and an X-ray spectrum thereof was measured. The results are shown in FIG. 18.

Measurement Example 2

Figure 19:
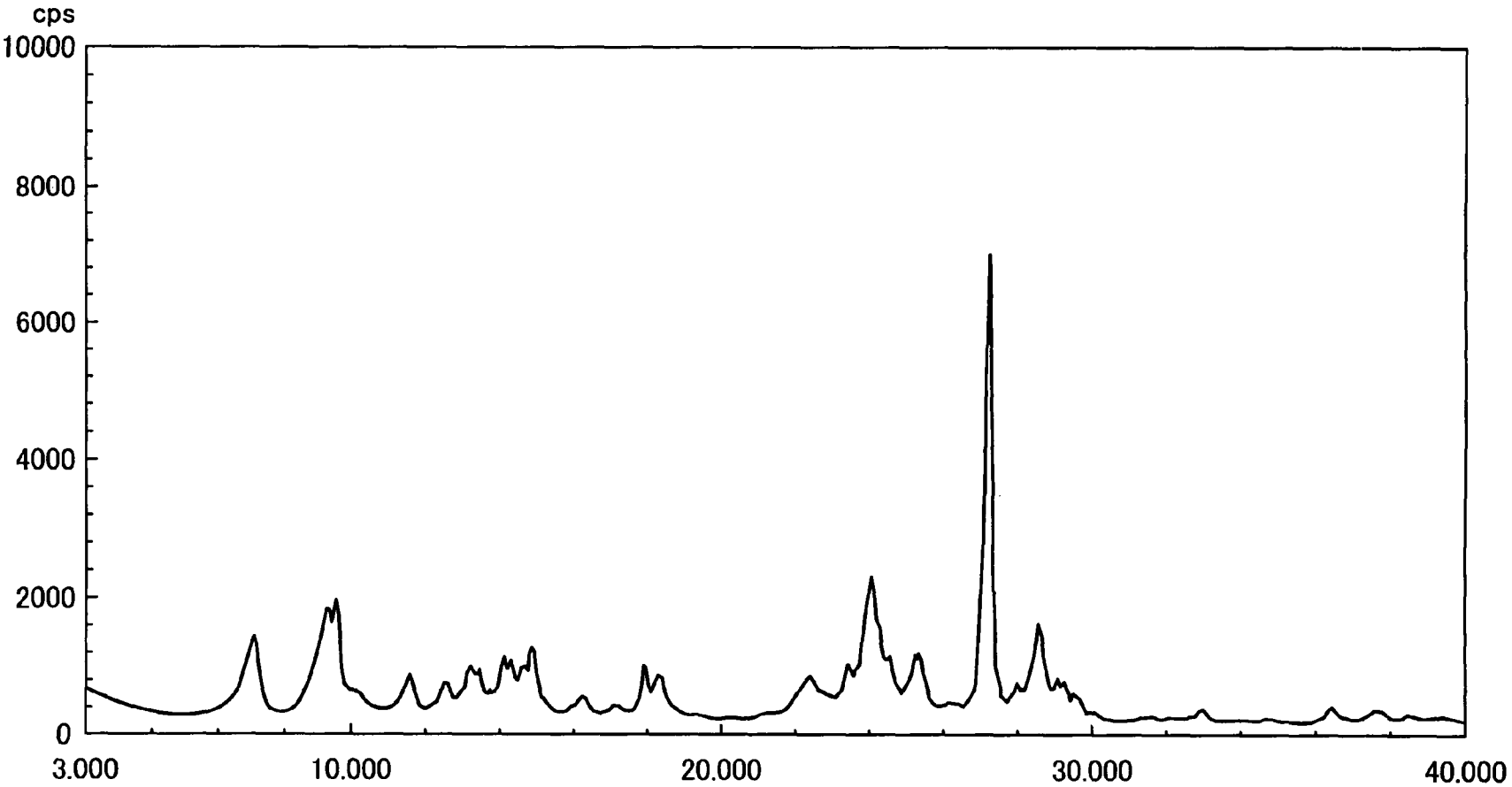
FIG. 19 is an X-ray diffraction spectrum of the Measurement Example 2.

Three % by weight of a pigment prepared by a method disclosed in Japanese Laid-Open Patent Publication No. 61-239248 (having a maximum diffraction peak at 7.5°) is included in the pigment prepared in Synthesis Example 8 (having a minimum diffraction peak at 7.5°). The mixture is mixed in a mortar and an X-ray spectrum thereof was measured. The results are shown in FIG. 19.

Figure 18:
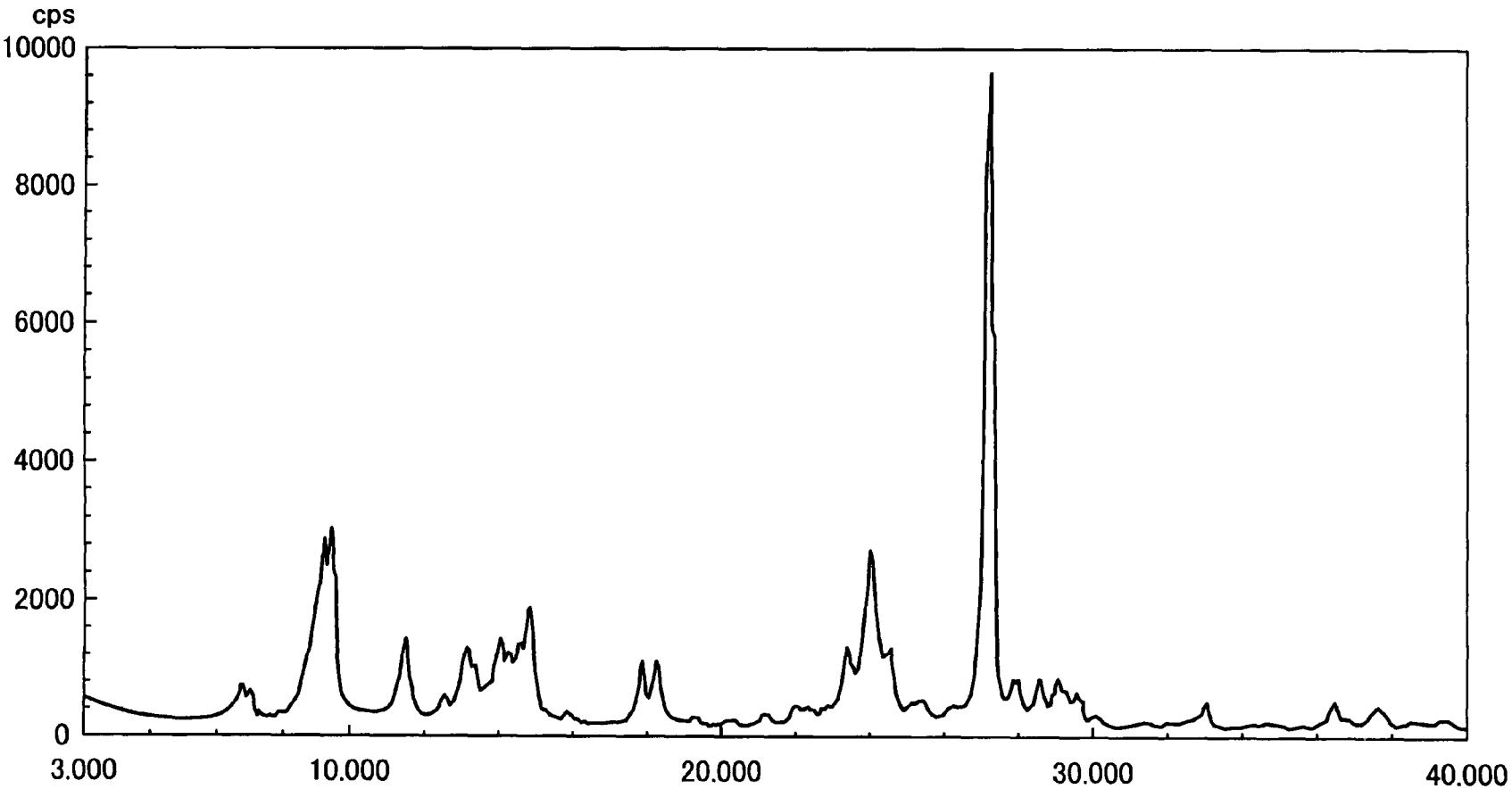
FIG. 18 is an X-ray diffraction spectrum of the Measurement Example 1.

The spectrum in FIG. 18 has two independent peaks at low angles of 7.3 and 7.5°, and they are different from each other. The spectrum in FIG. 19 has only one peak at a low angle of 7.5°, and is apparently different from the spectrum in FIG. 18.

Consequently, the minimum diffraction peak at a lowest Bragg (2θ) angle of 7.3° of the titanylphthalocyanine crystal of the present invention is different from peaks at 7.5° of known titanylphthalocyanine crystals.

This application claims priority and contains subject matter related to Japanese Patent Application No. 2005-237588 filed on Aug. 18, 2005, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor, comprising:

an electroconductive substrate;

an intermediate layer, located overlying the electroconductive substrate; and a photosensitive layer, located overlying the intermediate layer, wherein the intermediate layer comprises a N-alkoxymethylated nylon, and the N-alkoxymethylated nylon comprises a component having a molecular weight not greater than 5,000 in an amount of from 3.3 to 10% by weight.

2. The electrophotographic photoreceptor of claim 1, wherein the N-alkoxymethylated nylon further comprises a component having a molecular weight not greater than 1,000 in an amount of from 0.3 to 5% by weight.

3. The electrophotographic photoreceptor of claim 1, wherein the N-alkoxymethylated nylon has a conductivity of from 1.5 to 15 μS/cm.

4. The electrophotographic photoreceptor of claim 1, wherein the intermediate layer comprises a resin layer including the N-alkoxymethylated nylon.

5. The electrophotographic photoreceptor of claim 4, wherein the resin layer comprises:

a first resin layer as a antimoire layer comprising a dispersed filler; and a second resin layer as a charge blocking layer comprising the N-alkoxymethylated nylon and the charge blocking layer does not comprise a dispersed filler.

6. The electrophotographic photoreceptor of claim 5, wherein the antimoire layer overlies the charge blocking layer.

7. The electrophotographic photoreceptor of claim 5, wherein a thickness of the charge blocking layer is not greater than 2.0 μm.

8. The electrophotographic photoreceptor of claim 1, wherein the photosensitive layer comprises a charge generation layer and a charge transport layer.

9. The electrophotographic photoreceptor of claim 8, wherein the charge generation layer comprises a titanylphthalocyanine as a charge generation material.

10. The electrophotographic photoreceptor of claim 9, wherein the titanylphthalocyanine has a CuKα 1.542 Å X-ray diffraction spectrum comprising plural diffraction peaks, wherein a maximum diffraction peak is observed at a Bragg (2θ) angle of 27.2°; main peaks are observed at 9.4°, 9.6° and 24.0°; and a minimum diffraction peak is observed at 7.3°;

and no diffraction peak is observed at an angle greater than 7.3° and less than 9.4° and at 26.3°, wherein said angles may vary by ±0.2°, and has an average primary particle diameter not greater than 0.25 μm.

11. The electrophotographic photoreceptor of claim 9, wherein the photosensitive layer or the charge generation layer is formed by a method comprising:

dispersing the titanylphthalocyanine in a solvent until an average particle size is not greater than 0.3 μm and a standard deviation thereof is not greater than 0.2 μm to prepare a dispersion;

filtering the dispersion with a filter having an effective pore size not greater than 3 μm to prepare a filtered dispersion; and coating the filtered dispersion on the intermediate layer.

12. The electrophotographic photoreceptor of claim 9, wherein the titanylphthalocyanine is prepared by a method comprising:

subjecting a titanylphthalocyanine, which is either amorphous or low-crystalline, and which has a maximum diffraction peak having a half width not less than 1° at a Bragg (2θ) angle of from 7.0 to 7.5°±0.2° when a specific X-ray of CuKα having a wavelength of 1.542 Å irradiates the titanylphthalocyanine and an average primary particle diameter not greater than 0.1 μm, to crystal conversion using an organic solvent in the presence of water; and separating the titanylphthalocyanine from the organic solvent before the titanylphthalocyanine shows crystal growth such that the average primary particle diameter becomes not less than 0.25 μm.

13. The electrophotographic photoreceptor of claim 9, wherein the titanylphthalocyanine does not comprise a halogenated material.

14. The electrophotographic photoreceptor of claim 12, wherein the amorphous titanylphthalocyanine is prepared by an acid paste method, and wherein the amorphous titanylphthalocyanine is washed with ion-exchange water until a pH of the ion-exchanged water is from 6 to 8 or a specific conductivity of the ion-exchanged water is not greater than 8.

15. The electrophotographic photoreceptor of claim 12, wherein a weight of the organic solvent is at least 30 times as much as the weight of the amorphous titanylphthalocyanine.

16. The electrophotographic photoreceptor of claim 1, further comprising a protection layer, located overlying the photosensitive layer.

17. The electrophotographic photoreceptor of claim 16, wherein the protection layer comprises an inorganic pigment or a metal oxide having a specific resistivity not less than $10^{10}$ Ω·cm.

18. The electrophotographic photoreceptor of claim 17, wherein the metal oxide is a member selected from the group consisting of alumina, titanium oxide and silica.

19. The electrophotographic photoreceptor of claim 17, wherein the metal oxide is α-alumina.

20. An image forming apparatus, comprising:

at least one image forming unit comprising:

the electrophotographic photoreceptor according to claim 1;

a charger configured to charge the electrophotographic photoreceptor;

an irradiator configured to irradiate the electrophotographic photoreceptor to form an electrostatic latent image thereon;

an image developer configured to develop the electrostatic latent image with a developer comprising a toner to form a toner image on the electrophotographic photoreceptor; and a transferer configured to transfer the toner image onto a transfer material.

* * * * *